US011448178B2

(12) United States Patent
Taguchi et al.

(10) Patent No.: US 11,448,178 B2
(45) Date of Patent: Sep. 20, 2022

(54) SWITCH CONTROL CIRCUIT AND IGNITER

(71) Applicant: ROHM CO., LTD., Kyoto (JP)

(72) Inventors: Atsushi Taguchi, Kyoto (JP); Akira Daicho, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 77 days.

(21) Appl. No.: 16/969,882

(22) PCT Filed: Feb. 22, 2019

(86) PCT No.: PCT/JP2019/006734
§ 371 (c)(1),
(2) Date: Aug. 13, 2020

(87) PCT Pub. No.: WO2019/176501
PCT Pub. Date: Sep. 19, 2019

(65) Prior Publication Data

US 2020/0408182 A1 Dec. 31, 2020

(30) Foreign Application Priority Data

Mar. 13, 2018 (JP) ..... JP2018-045701
Jul. 4, 2018 (JP) ..... JP2018-127728

(51) Int. Cl.
*F02P 3/055* (2006.01)
*F02P 3/04* (2006.01)
(Continued)

(52) U.S. Cl.
CPC ..... *F02P 3/0552* (2013.01); *F02P 3/0435* (2013.01); *F02P 3/051* (2013.01); *F02P 3/055* (2013.01);
(Continued)

(58) Field of Classification Search
None
See application file for complete search history.

(56) References Cited

U.S. PATENT DOCUMENTS 3,288,125 A * 11/1966 Guyton ..... F02P 3/051 123/654
3,340,861 A * 9/1967 Schiff ..... F02P 15/12 315/209 T
(Continued)

FOREIGN PATENT DOCUMENTS

CN 111819358 A * 10/2020 ..... F02P 11/00
DE 112019001263 T5 * 12/2020 ..... F02P 11/00
(Continued)

OTHER PUBLICATIONS

Office Action issued for Chinese Patent Application No. 201980017899.9, dated Aug. 31, 2021, 16 pages including English translation.
(Continued)

*Primary Examiner* — Kevin R Steckbauer
(74) *Attorney, Agent, or Firm* — Hamre, Schumann, Mueller & Larson, P.C.

(57) ABSTRACT

A switch control circuit controls a switch element connected to a primary coil of an ignition coil in accordance with an ignition signal. The switch element includes a transistor and a protection element connected between a collector and gate of the transistor. The switch control circuit uses a voltage at a gate terminal controlling the transistor or a voltage corresponding to a collector current of the transistor as a detection voltage and generates a status detection signal corresponding to a change in the detection voltage.

13 Claims, 41 Drawing Sheets

(51) Int. Cl.

| | |
|---|---|
| ***F02P 11/00*** | (2006.01) |
| ***H01T 15/00*** | (2006.01) |
| ***F02P 3/05*** | (2006.01) |
| *F02P 3/045* | (2006.01) |

(52) U.S. Cl.
CPC ..... *F02P 3/0554* (2013.01); *F02P 3/0556* (2013.01); *F02P 3/0558* (2013.01); *F02P 11/00* (2013.01); *H01T 15/00* (2013.01); *F02P 3/0442* (2013.01); *F02P 3/0456* (2013.01)

(56) References Cited

U.S. PATENT DOCUMENTS 3,581,725 A * 6/1971 Hemphill ..... F02P 3/0552 315/209 T
3,749,974 A * 7/1973 Kissel ..... F02P 3/0552 315/209 T
3,838,672 A * 10/1974 Richards ..... F02P 3/051 123/644
3,881,458 A * 5/1975 Roozenbeek ..... F02P 3/0453 123/610
3,882,840 A * 5/1975 Adamian ..... F02P 3/0453 123/644
3,901,205 A * 8/1975 Brungsberg ..... F02P 15/12 315/209 T
3,937,193 A * 2/1976 Kim ..... F02P 3/0453 123/611
4,008,698 A * 2/1977 Gartner ..... F02P 3/051 123/611
4,057,740 A * 11/1977 Arguello ..... H03K 3/033 327/227
4,117,819 A * 10/1978 Jarrett ..... F02P 3/051 315/209 T
RE29,862 E * 12/1978 Roozenbeek ..... F02P 3/0453 123/146.5 A
4,149,508 A * 4/1979 Kirk, Jr. ..... F02P 3/0884 315/209 CD
4,170,209 A * 10/1979 Petrie ..... F02P 3/0453 123/609
4,185,603 A * 1/1980 Sohner ..... F02P 3/0552 123/609
4,248,200 A * 2/1981 Sugiura ..... F02P 3/0453 123/644
4,275,701 A * 6/1981 Arguello ..... F02P 3/0435 123/146.5 A
4,291,661 A * 9/1981 Gerry ..... F02P 3/005 315/209 T
4,292,569 A * 9/1981 Gerry ..... F02P 3/01 315/176
4,307,691 A * 12/1981 Nagae ..... F02P 5/155 123/406.66
4,308,848 A * 1/1982 Pfaff ..... F02P 3/051 315/209 T
4,362,144 A * 12/1982 Yamaguchi ..... F02P 3/0453 123/644
4,395,999 A * 8/1983 McKechnie ..... F02P 3/0453 123/634
4,402,299 A * 9/1983 Nakao ..... F02P 3/051 123/632
4,411,246 A * 10/1983 Sugiura ..... F02P 5/155 123/611
4,434,779 A * 3/1984 Yamamoto ..... F02P 3/0453 123/611
4,451,774 A * 5/1984 Akita ..... H02J 7/0047 320/123
4,469,082 A * 9/1984 Nishitoba ..... F02P 3/0453 123/644
4,492,213 A * 1/1985 Yamamoto ..... F02P 3/051 123/623
4,617,906 A * 10/1986 Hill ..... F02P 3/051 123/644
4,809,668 A * 3/1989 Toyama ..... F02P 5/1556 123/609
5,014,675 A * 5/1991 Koiwa ..... F02P 3/0453 123/609
5,035,229 A * 7/1991 Koiwa ..... F02P 3/0453 123/179.5
5,070,853 A * 12/1991 Koiwa ..... F02P 3/0453 123/609
5,109,827 A * 5/1992 Nobe ..... F02P 3/051 123/651
5,139,004 A * 8/1992 Gose ..... F02P 3/0552 123/644
5,558,071 A * 9/1996 Ward ..... H01F 38/12 123/598
5,581,131 A * 12/1996 Urushiwara ..... H03K 17/08126 307/10.6
5,603,308 A * 2/1997 Ooyabu ..... H03K 17/567 323/284
5,611,318 A * 3/1997 Kesler ..... F02P 3/0554 315/119
5,652,520 A * 7/1997 Kawamoto ..... F02P 17/12 324/402
5,811,857 A 9/1998 Assaderaghi et al.
5,819,713 A * 10/1998 Kesler ..... F02P 11/00 307/41
6,034,397 A * 3/2000 Voldman ..... H01L 27/0251 257/335
6,111,393 A * 8/2000 Regazzi ..... F02P 1/083 323/267
6,286,491 B1 * 9/2001 Fukatsu ..... F02P 3/0554 123/644
6,336,448 B1 * 1/2002 Furuhata ..... F02P 3/053 123/644
6,360,720 B1 * 3/2002 Kesler ..... F02P 3/051 123/406.55
6,539,928 B2 * 4/2003 Kohno ..... F02P 3/04 123/652
6,595,194 B1 * 7/2003 Ito ..... F02P 3/0435 123/644
6,672,295 B2 * 1/2004 Kohno ..... F02P 3/0552 123/655
6,814,066 B2 * 11/2004 Ando ..... F02P 3/0435 123/644
6,955,164 B2 * 10/2005 Kesler ..... F02P 3/055 123/644
7,013,882 B2 * 3/2006 Long ..... F02P 3/0453 123/609
7,051,724 B2 * 5/2006 Uruno ..... F02P 3/051 257/E29.198
7,131,437 B2 * 11/2006 Ando ..... F02P 3/0552 123/644
7,176,744 B2 * 2/2007 Goudo ..... H03K 17/08122 327/434
7,467,626 B2 * 12/2008 Naruse ..... G01L 23/225 123/406.27
7,530,350 B2 * 5/2009 Oono ..... F02P 3/0442 123/644
7,541,858 B2 * 6/2009 Yukutake ..... F02P 3/0552 315/209 T
9,013,224 B2 * 4/2015 Trecarichi ..... F02P 3/0435 123/578
9,350,142 B2 * 5/2016 Obe ..... F02P 3/0435
9,531,377 B2 * 12/2016 Yamamoto ..... F02P 3/096
9,600,005 B2 * 3/2017 Hayashi ..... G05F 1/56
9,644,596 B2 * 5/2017 Naito ..... F02P 3/05
9,726,140 B2 * 8/2017 Okuda ..... F02P 17/10
9,920,735 B2 * 3/2018 Yamaguchi ..... F02P 3/0435
10,907,607 B2 * 2/2021 Nodake ..... F02P 3/0453
11,162,469 B2 * 11/2021 Nodake ..... F02D 41/22
2002/0040709 A1 * 4/2002 Kohno ..... F02P 3/04 123/605
2003/0116149 A1 * 6/2003 Kohno ..... F02P 3/04 123/644
2004/0200463 A1 * 10/2004 Ando ..... F02P 3/0435 123/630

(56) References Cited

U.S. PATENT DOCUMENTS

2004/0216724 A1* 11/2004 Uruno ..... H01L 29/7395 257/E29.198
2005/0046278 A1* 3/2005 Long ..... F02P 3/0453 307/10.1
2005/0178372 A1* 8/2005 Kesler ..... G01K 7/01 374/E7.035
2005/0252496 A1* 11/2005 Ando ..... F02P 3/0552 123/644
2006/0022609 A1* 2/2006 Yukutake ..... F02P 3/0552 315/209 T
2006/0077000 A1* 4/2006 Goudo ..... H03K 17/0822 327/434
2006/0152865 A1* 7/2006 Nair ..... F02P 3/0554 361/35
2008/0006256 A1* 1/2008 Oono ..... F02P 3/055 123/644
2008/0135017 A1* 6/2008 Naruse ..... G01L 23/225 123/406.12
2013/0068204 A1* 3/2013 Trecarichi ..... F02P 3/0435 123/594
2014/0062324 A1* 3/2014 Obe ..... H01T 15/00 315/200 R
2015/0084533 A1* 3/2015 Naito ..... F02P 3/05 315/209 T
2015/0205314 A1* 7/2015 Hayashi ..... G05F 1/56 323/217
2015/0381170 A1* 12/2015 Yamamoto ..... H03K 17/687 327/109
2016/0061178 A1* 3/2016 Yamaguchi ..... F02P 7/077 323/299
2016/0084214 A1* 3/2016 Okuda ..... F02P 15/006 123/604
2019/0136820 A1* 5/2019 Yamagishi ..... F02P 3/0453
2020/0240385 A1* 7/2020 Ueno ..... F02P 3/0442
2020/0340441 A1* 10/2020 Nodake ..... F02P 3/0552
2020/0408182 A1* 12/2020 Taguchi ..... F02P 3/055
2021/0131396 A1* 5/2021 Nodake ..... H03K 17/0828

FOREIGN PATENT DOCUMENTS

JP H0893611 4/1996
JP 2008002392 1/2008
JP 2014051904 3/2014
JP 2016065462 4/2016
JP 2016089674 5/2016
JP 2016089674 A * 5/2016 ..... F02P 11/00
JP 2016098776 5/2016
WO WO-2019176501 A1 * 9/2019 ..... F02P 11/00

OTHER PUBLICATIONS

International Search Report and Written Opinion issued for International Patent Application No. PCT/JP2019/006734, dated May 14, 2019, 10 pages including English translation of Search Report.
Office Action issued for Japanese Patent Application No. 2020-505726, dated May 10, 2022, 12 pages including English machine translation.

* cited by examiner

SWITCH CONTROL CIRCUIT AND IGNITER

TECHNICAL FIELD

Related to switch control circuit and igniter

BACKGROUND ART

A conventional ignition device of a gasoline vehicle includes an igniter that controls an ignition coil connected to a spark plug. The igniter includes a switch element, which is connected to the ignition coil, and a control circuit, which on-off controls the switch element in accordance with an ignition instruction signal provided from an engine control unit (ECU) (for example, refer to Patent Document 1). The switch element is on-off controlled so that the igniter generates high voltage, which is supplied to the spark plug, with the ignition coil.

PRIOR ART DOCUMENT

Patent Document

Patent Document 1: Japanese Laid-Open Patent Publication No. 2016-098776

SUMMARY OF THE INVENTION

Problems that the Invention is to Solve

The spark plug may not produce a spark in which case a misfire will occur. A misfire may affect engine rotation or the like. Thus, there is a need to detect a status of misfire.

It is an object of the present invention to provide a switch control circuit and an igniter that allow for misfire status detection.

Means for Solving the Problem

A switch control circuit according to one aspect of the present disclosure is a switch control circuit that controls a switch element connected to a primary coil of an ignition coil in accordance with an ignition signal. The switch element includes a transistor and a protection element connected between a collector and gate of the transistor. The switch control circuit includes a status detection circuit that uses a voltage at a gate terminal controlling the transistor or a voltage corresponding to a collector current of the transistor as a detection voltage and generates a status detection signal corresponding to a change in the detection voltage.

An ignitor according to a further aspect of the present disclosure includes a switch element connected to a primary coil of an ignition coil and a switch control circuit that controls the switch element in accordance with an ignition signal. The switch element includes a transistor and a protection element connected between a collector and gate of the transistor. The switch control circuit includes a status detection circuit that uses a voltage at a gate terminal controlling the transistor or a voltage corresponding to a collector current of the transistor as a detection voltage and generates a status detection signal corresponding to a change in the detection voltage.

A switch control circuit according to a further aspect of the present disclosure is a switch control circuit that controls a switch element connected to a primary coil of an ignition coil in accordance with an ignition signal. The switch element includes a transistor and a protection element connected between a terminal, which is connected to the primary coil, and a control terminal of the transistor. A status detection circuit uses a collector voltage of the transistor as a detection voltage and generates a status detection signal corresponding to a change in the detection voltage.

An ignitor according to a further aspect of the present disclosure includes a switch element connected to a primary coil of an ignition coil and a switch control circuit that controls the switch element in accordance with an ignition signal. The switch element includes a transistor and a protection element connected between a terminal, which is connected to the primary coil, and a control terminal of the transistor. The switch control circuit includes a status detection circuit that uses a collector voltage of the transistor as a detection voltage and generates a status detection signal corresponding to a change in the detection voltage.

Effects of the Invention

The aspects of the present disclosure allow for misfire status detection.

MODES FOR CARRYING OUT THE INVENTION

Embodiments and modified examples will hereafter be described with reference to the drawings. The embodiments and modified examples described below exemplify configurations and methods for embodying a technical concept and are not intended to limit the material, shape, structure, arrangement, dimensions, and the like of each component to the description. The embodiments and modified examples described below may undergo various modifications.

In the present specification, "a state in which member A is connected to member B" includes a case in which member A and member B are directly connected physically and a case in which member A and member B are indirectly connected by another member that does not affect the electric connection state.

Similarly, "a state in which member C is arranged between member A and member B" includes a case in which member A is directly connected to member C or member B is directly connected to member C and a case in which member A is indirectly connected to member C by another member that does not affect the electric connection state or member B is indirectly connected to member C by another member that does not affect the electric connection state.

First Embodiment

A first embodiment will now be described.

Figure 1:
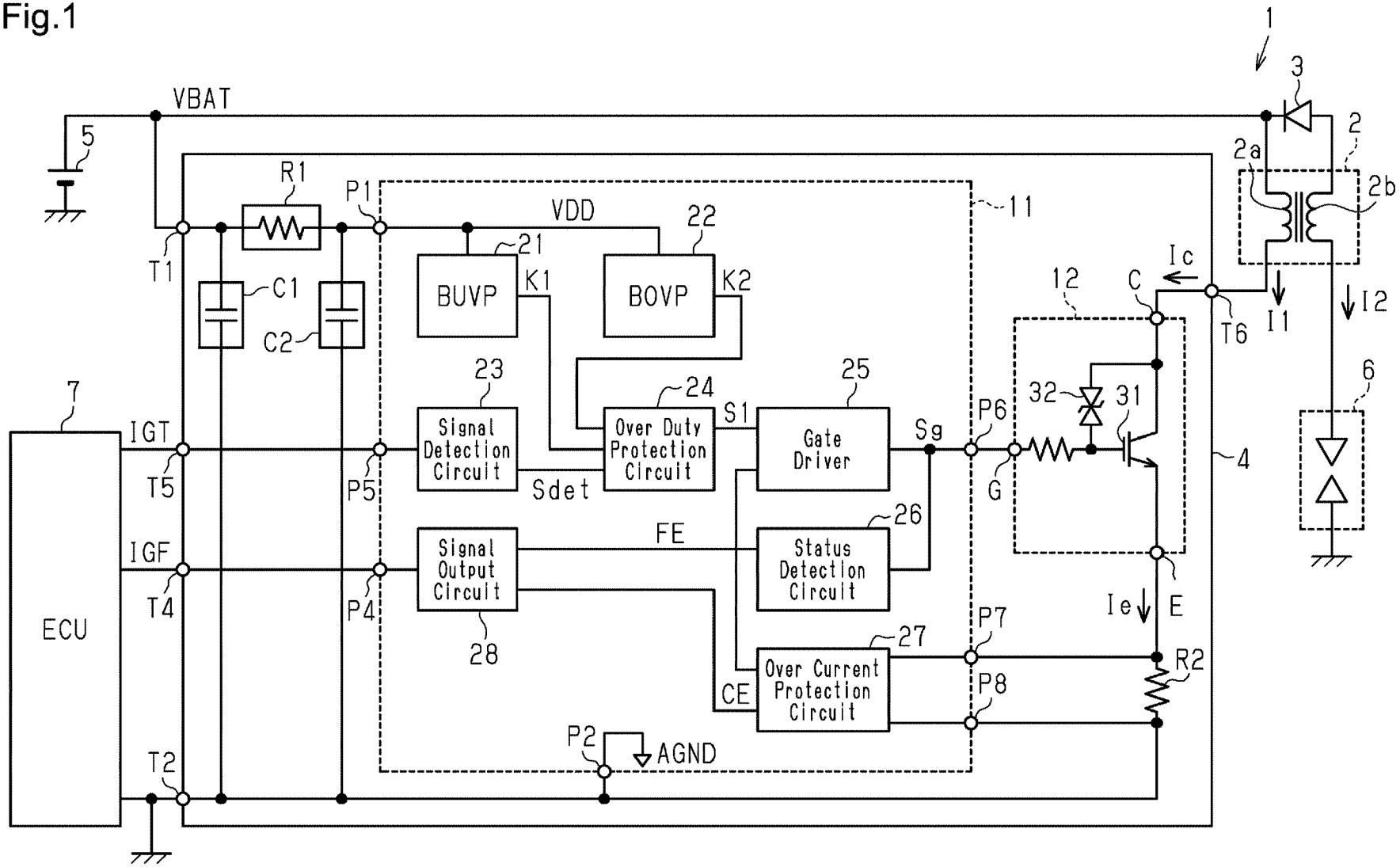
FIG. 1 is a schematic block circuit diagram showing an ignition device of a first embodiment.
Figure 5:
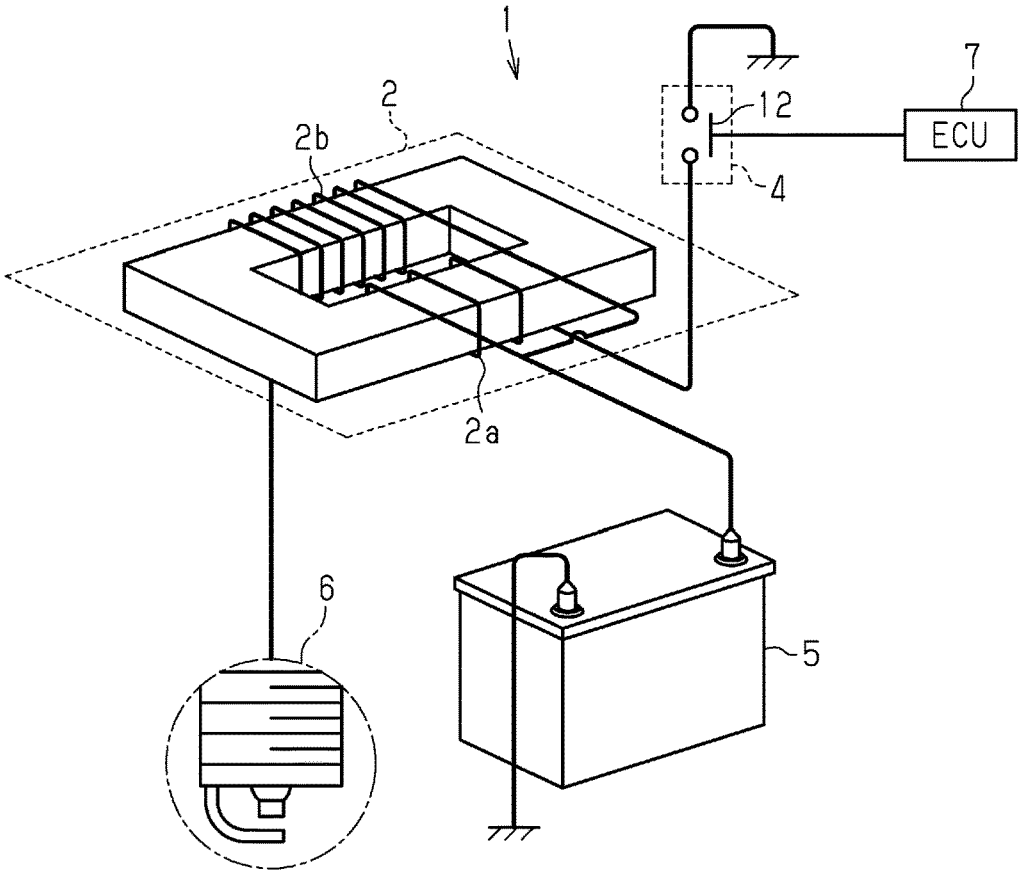
FIG. 5 is a schematic diagram of the ignition device.

As shown in FIGS. 1 and 5, the ignition device 1 includes an ignition coil 2, a diode 3 (refer to FIG. 1), and an igniter 4. The ignition coil 2 includes a primary coil 2*a* and a secondary coil 2*b*. A first terminal of the primary coil 2*a* is connected to a battery 5 and the cathode of the diode 3, and a second terminal of the primary coil 2*a* is connected to an output terminal of the igniter 4. A first terminal of the secondary coil 2*b* is connected to the anode of the diode 3, and a second terminal of the secondary coil 2*b* is connected to a spark plug 6.

The igniter 4, which includes a switch control circuit 11 and a switch element 12, on-off controls a switch element 12 based on an ignition instruction signal IGT provided from an ECU 7. When the switch element 12 is turned on by the ignition instruction signal IGT, battery voltage VBAT is applied to the primary coil 2*a* of the ignition coil 2, and current I1 flowing to the primary coil 2*a* increases over time. When the switch element 12 is turned off by the ignition instruction signal IGT, the current I1 of the primary coil 2*a* is interrupted. In this case, primary voltage V1, which is proportional to the time derivative of the current I1, is generated at the primary coil 2*a*. Further, secondary voltage V2, which is the product of the primary voltage V1 and the turns ratio, is generated at the secondary coil 2*b*. With the secondary voltage V2 generated in this manner, the spark plug 6 produces a spark.

As shown in FIG. 1, the igniter 4 includes a high potential power terminal T1, which is supplied with the battery voltage VBAT from the battery 5, and an output terminal T6, which is connected to the primary coil 2*a* of the ignition coil 2. Further, the igniter 4 includes an input terminal T5, which is connected to the ECU 7, a signal output terminal T4, and a low potential power terminal T2.

The ignition instruction signal IGT from the ECU 7 is input to the signal input terminal T5. The igniter 4 outputs an ignition confirmation signal IGF from the signal output terminal T4.

The igniter 4 includes the switch control circuit 11, the switch element 12, a resistor R1, capacitors C1 and C2, and a resistor R2 and is modularized and accommodated in a single package.

A first terminal of the resistor R1 is connected to the high potential power terminal T1, and a second terminal of the resistor R1 is connected to a high potential power terminal P1 of the switch control circuit 11. A first terminal of the capacitor C1 is connected between the high potential power terminal T1 and the low potential power terminal T2. The capacitor C2 is connected between a second terminal of the resistor R1 and the low potential power terminal T2. The battery voltage VBAT is supplied via the resistor R1 as a high potential power voltage VDD to the switch control circuit 11. The switch control circuit 11 is actuated by the high potential power voltage VDD. The resistor R1, for example, reduces surge voltage superimposed on the battery voltage VBAT, and mitigates stress acting on the switch control circuit 11. The capacitor C1, for example, reduces noise (e.g., spike noise) superimposed on the battery voltage VBAT and stabilizes the high potential power voltage VDD. The capacitor C2, for example, functions as a bypass capacitor that stabilizes the high potential power voltage VDD.

The switch control circuit 11 includes an input terminal P5, which receives the ignition instruction signal IGT via the input terminal T5, and a signal output terminal P4, which outputs the ignition confirmation signal IGF. Further, the switch control circuit 11 includes an output terminal P6, which is connected to the switch element 12, input terminals P7 and P8, which are connected to the two terminal of the resistor R2, and a low potential power terminal P2, which is connected to the low potential power terminal T2.

The switch control circuit 11 includes an under voltage protection circuit 21, an over voltage protection circuit 22, a signal detection circuit 23, an over duty protection circuit 24, a gate driver 25, a status detection circuit 26, an over current protection circuit (current detection circuit) 27, and a signal output circuit 28.

The under voltage protection (BUVP: Battery Under Voltage Protection) circuit 21 compares a drive voltage VDD with a predetermined threshold value and outputs a detection signal K1 having a level corresponding to the comparison result. The threshold value of the under voltage protection circuit 21 is set, for example, in correspondence with a lower limit voltage of an operable voltage range of the switch control circuit 11. The over voltage protection (BOVP: Battery Over Voltage Protection) circuit 22 compares the drive voltage with a predetermined threshold voltage and outputs a detection signal K2 having a level corresponding to the comparison result. The threshold voltage of the over voltage protection circuit 22 is set, for example, in correspondence with an upper limit voltage of the operable voltage range of the switch control circuit 11.

The signal detection circuit (signal detector) 23 includes a filter circuit and a comparator. The signal detection circuit 23 detects the ignition instruction signal IGT from the ECU 7 and outputs a received signal Sdet. The over duty protection circuit 24 generates a control signal Si that is provided to the gate driver 25 from the received signal Sdet of the signal detection circuit 23, the detection signal K1 of the under voltage protection circuit 21, and the detection signal K2 of the over voltage protection circuit 22. Further, the over duty protection circuit 24 generates the control signal Si from the received signal Sdet so that the switch element 12 is not turned on over a predetermined duty protection time.

The gate driver (Gate Drive) 25 outputs a gate signal Sg from the control signal Si that turns on and off the switch element 12. The switch element 12 is formed by a single semiconductor chip including a transistor 31. The transistor 31 is, for example, an insulated gate bipolar transistor (IGBT). Terminals (C, G, and E) of the transistor 31 may be referred to as terminals of the semiconductor chip, or the switch element 12.

The gate signal Sg, which is output from the gate driver 25, is provided via the output terminal P6 to gate terminal G of the switch element 12. The over current protection circuit 27 detects the state of the collector current Ic (emitter current Ie) of the switch element 12 from a detection voltage (emitter voltage Ve) at a node between the emitter terminal E of the switch element 12 and the resistor R2 and generates a detection signal CE corresponding to the detection result. The gate driver 25 lowers the level of a voltage Vsg of the gate signal Sg based on the detection signal CE. This limits the collector current Ic to less than or equal to the upper limit.

The status detection circuit (Ignition Status Detector) 26 uses the voltage at the gate terminal G that controls the transistor 31 of the switch element 12 as a detection voltage and outputs a detection signal FE corresponding to the detection voltage. The gate terminal G is provided with the gate signal Sg from the gate driver 25. Accordingly, the status detection circuit 26 uses the voltage of the gate signal Sg (gate voltage Vsg) as the detection voltage, detects the ignition status of the spark plug 6 from the detection voltage, and outputs the detection signal FE. For example, the status detection circuit 26 outputs the detection signal FE at a high level in a case where the spark plug 6 produces a spark, that is, in a normal state in which normal ignition occurs, and outputs the detection signal FE at a low level in a case where the spark plug 6 does not produce a spark, that is, in a misfire state in which normal ignition does not occur.

The signal output (output logic) circuit 28 combines various types of signals including the detection signal CE of the overcurrent protection circuit 27 with the detection signal FE of the status detection circuit 26 to generate the ignition confirmation signal IGF and output the ignition confirmation signal IGF. The ignition confirmation signal IGF is provided via the signal output terminal P4 of the switch control circuit 11 and the signal output terminal T4 of the igniter 4 to the ECU 7.

The switch element 12 includes the transistor 31 and a protection element 32 and is integrated on a single semiconductor substrate manufactured through a high-voltage process.

The protection element 32 is arranged between the gate and collector of a power transistor for the purpose of protection from over voltage. The protection element 32 includes, for example, a diode that is anti-series-connected between the gate and collector of the transistor 31. The diode is, for example, a Zener diode. When the transistor 31 is turned off and the primary current I1 flowing to the primary coil 2*a* of the ignition coil 2 is interrupted, the back electromotive force of the primary coil 2*a* generates a high voltage at the collector terminal C of the switch element 12. When a voltage that is greater than or equal to the clamp voltage of the protection element 32 is applied between the gate and collector of the transistor 31, the protection element 32 turns on the transistor 31 and releases the energy accumulated in the primary coil 2*a* of the ignition coil 2 to protect the transistor 31. The protection element 32 improves the avalanche tolerance of the transistor 31.

The switch element 12 may include a protection element connected between the gate and emitter of the transistor 31. The protection element includes a diode (e.g., Zener diode) anti-series-connected between the gate and the emitter of the transistor 31 and clamps over voltage (e.g., surge noise or the like) between the gate and emitter at a predetermined voltage for the purpose of protection from over voltage.

The emitter terminal E of the switch element 12 is connected via the resistor R2 to the low potential power terminal T2.

Figure 2A:
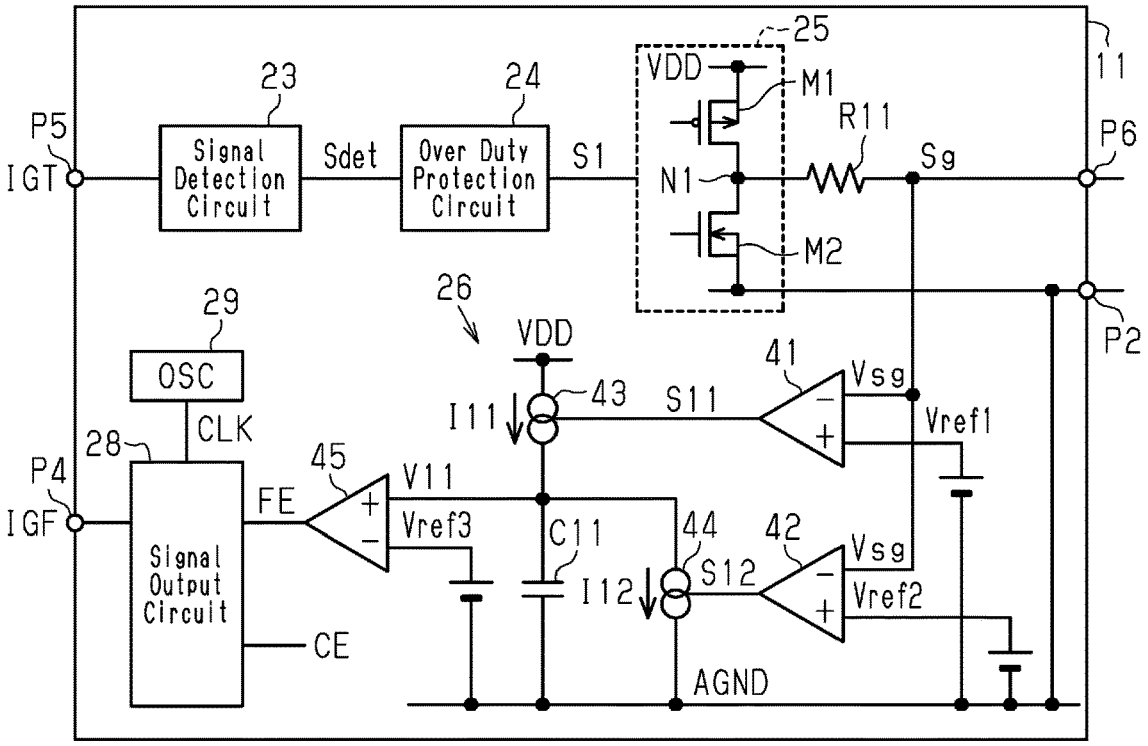
FIG. 2A is a schematic block circuit diagram showing a switch control circuit of the first embodiment.

As shown in FIG. 2A, the gate driver 25 includes transistors M1 and M2 that are series-connected between a wire that transmits the drive voltage VDD (hereafter referred to as the power line VDD) and a wire that transmits a low potential voltage AGND (hereafter referred to as the ground line AGND). The transistor M1 is, for example, a P-channel Metal Oxide Semiconductor Field Effect Transistor (PMOSFET), and the transistor M2 is, for example, an N-channel MOSFET (NMOSFET). A node N1 between the transistor M1 and the transistor M2 is connected via the resistor R11 to the output terminal P6.

The status detection circuit 26 includes comparators 41 and 42, current sources 43 and 44, a capacitor C11, and a comparator 45.

The inverting input terminals of the comparators 41 and 42 are supplied with the gate signal Sg (gate voltage Vsg). The non-inverting input terminal of the comparator 41 is supplied with the reference voltage Vref1, and the non-inverting input terminal of the comparator 41 is supplied with the reference voltage Vref2. The reference voltages Vref1 and Vref2 are set in correspondence with a change in the voltage Vsg. The comparator 41 compares the gate voltage Vsg and the reference voltage Vref1 and outputs a signal S11 having a level that is in accordance with the comparison result. The comparator 42 compares the gate voltage Vsg and the reference voltage Vref2 and outputs a signal S12 having a level that is in accordance with the comparison result.

A first terminal of the current source 43 is connected to the power line VDD and supplied with the drive voltage VDD. The current source 43 corresponds to a "first current source." A second terminal of the current source 43 is connected to a first terminal of the capacitor C11, and a second terminal of the capacitor C11 is connected to the ground line AGND. The current source 44 is connected in parallel to the capacitor C11. The current source 43 is activated or inactivated in response to the output signal S11 of the comparator 41. The activated current source 43 produces a flow of a predetermined current I11. The current I11 charges the capacitor C11 and increases a voltage V11 at the first terminal of the capacitor C11.

The current source 44 is activated or inactivated in response to the output signal S12 of the comparator 42. The current source 44 corresponds to a "second current source." The activated current source 44 produces a flow of a predetermined current I12. The current I12 discharges the capacitor C11 and decreases the voltage V11 at the first terminal of the capacitor C11. The first terminal of the capacitor C11 is connected to the non-inverting terminal of the comparator 45, and the inverting terminal of the comparator 45 is supplied with a reference voltage Vref3. The comparator 45 compares the voltage V11 at the first terminal of the capacitor C11 with the reference voltage Vref3 and outputs the detection signal FE in accordance with the comparison result.

The signal output circuit 28 receives the detection signal FE, which is output from the comparator 45, and the detection signal CE, which is output from the overcurrent protection circuit 27 shown in FIG. 1. Further, the signal output circuit 28 is provided with a clock signal CLK, which has a predetermined frequency, from an oscillator (OSC) 29. The clock signal CLK is, for example, a system clock or a signal obtained by frequency-dividing the system clock, and used to receive the ignition control signal or the like. The signal output circuit 28 is actuated in accordance with the clock signal CLK to output the ignition confirmation signal IGF, which combines the detection signals CE and FE.

Figure 3A:
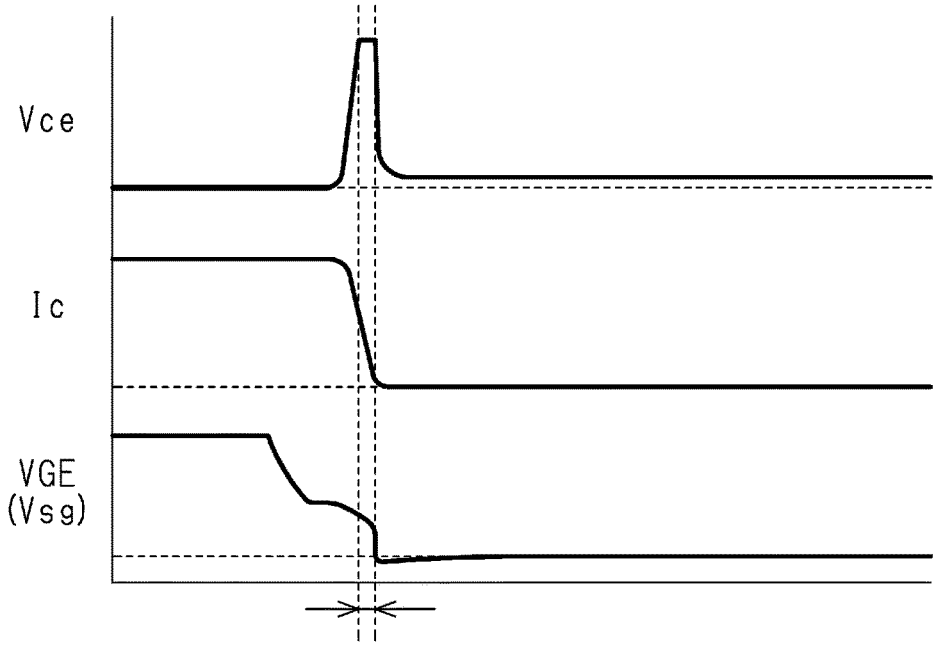
FIG. 3A is a waveform chart illustrating the voltage at each part of an igniter during a normal ignition.
Figure 3B:
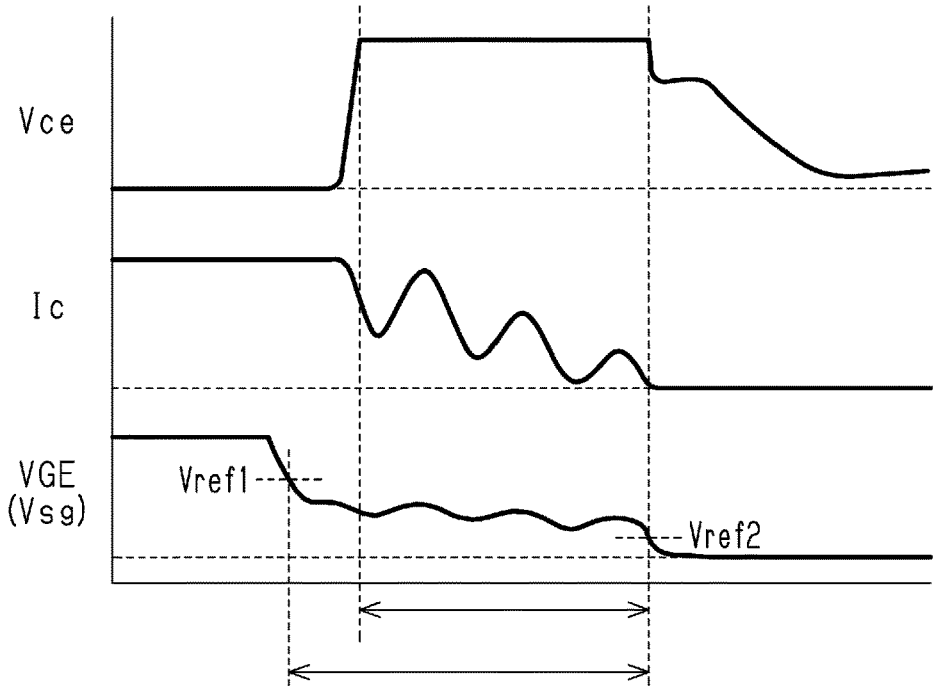
FIG. 3B is a waveform chart illustrating the voltage at each part of an igniter during a misfire.

FIGS. 3A and 3B show changes in a collector-emitter voltage Vce of the switch element 12 (transistor 31), the collector current Ic, and a gate-emitter voltage VGE (gate voltage Vsg).

As shown in FIG. 3A, when the transistor 31, which is shown in FIG. 1, is turned off and the primary current of the ignition coil 2 is interrupted, the self-induction effect generates a large back electromotive force at the primary coil 2*a* of the ignition coil 2. This suddenly increases the collector-emitter voltage Vce. The mutual induction effect with the primary coil 2*a* generates a large electromotive force, which corresponds to the turns ratio, at the secondary coil 2*b*. The electromotive force of the secondary coil 2*b*, which is generated in this manner, applies an extremely high secondary voltage V2 to the spark plug 6 so that the spark plug 6 produces a spark. When a spark is produced in a normal manner, energy is lost. This readily decreases the collector current Ic of the transistor 31 and suddenly decreases the collector-emitter voltage Vce in accordance with the collector current Ic. Further, the collector current Ic and the gate-emitter voltage VGE (gate voltage Vsg) become a low potential level (0). In this manner, when the spark plug 6 is ignited in a normal manner, the gate-emitter voltage VGE (gate voltage Vsg) and the collector current Ic decrease to a predetermined level within a short period.

As shown in FIG. 3B, in a case where the spark plug 6 does not produce a spark, the collector-emitter voltage Vce is maintained as a high voltage. The gate-emitter voltage VGE (gate voltage Vsg) slowly decreases. Further, the parasitic capacitance and inductance of the ignition coil 2 gradually decreases the collector current Ic as it repeatedly increases and decreases. When the gate-emitter voltage VGE (gate voltage Vsg) and the collector current Ic becomes lower than predetermined values, the collector-emitter voltage Vce decreases.

In this manner, in accordance with the status of the spark plug 6, the gate-emitter voltage VGE and the collector current Ic decrease differently, and the period during which the collector-emitter voltage Vce is maintained at a high level becomes different.

The status detection circuit 26 shown in FIGS. 1 and 2A detect the status of the spark plug 6 from these voltage changes and outputs the detection signal FE. In the present embodiment, the status detection circuit 26 detects the status from the gate voltage Vsg and outputs the detection signal FE. Then, the signal output circuit 28 combines the detection signal FE of the status detection circuit 26 with another signal to generate the ignition confirmation signal IGF. The ignition confirmation signal IGF, which is combined in this manner, is output from the signal output terminal P4. This allows the detection results of a plurality of detection circuits to be output from the same signal output terminal P4 and limits enlargement of the igniter 4.

As shown in FIG. 2A, the status detection circuit 26 compares the gate voltage Vsg and the reference voltages Vref1 and Vref2 with the comparators 41 and 42. The reference voltages Vref1 and Vref2 are set for the gate voltage Vsg in correspondence with the period during which the collector-emitter voltage Vce is maintained at a high level (period shown by arrows), as shown in FIG. 3B.

The output signal S11 of the comparator 41 charges the capacitor C11, and the output signal S12 of the comparator 42 discharges the capacitor C11. Accordingly, the voltage V11 at the first terminal of the capacitor C11 corresponds to changes in the gate-emitter voltage VGE (the gate voltage Vsg) shown in FIGS. 3A and 3B.

Figure 2B:
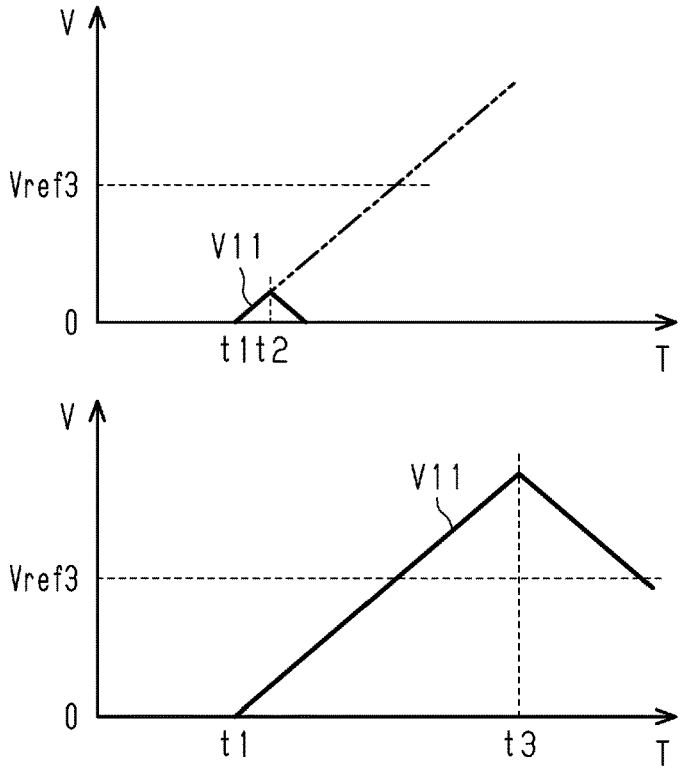
FIG. 2B is a waveform chart illustrating the operation of a misfire detection circuit.

The upper part of FIG. 2B shows changes in the voltage V11 in correspondence with FIG. 3A. In FIG. 2B, the horizontal axis represents time, and the vertical axis represents voltage. At time t1, when the gate voltage Vsg becomes lower than the reference voltage Vref1, the current source 43 shown in FIG. 2A charges the capacitor C11 and increases the voltage V11. When the spark plug 6 shown in FIGS. 1 and 5 produces a spark in a normal manner, at time t2, the gate voltage Vsg becomes less than the reference voltage Vref2. As a result, the current source 44 shown in FIG. 2A discharges the capacitor C11 and decreases the voltage V11. The reference voltage Vref3 shown in FIG. 2A is set to be higher than the voltage V11 that increases and decreases within such a short period. Thus, the comparator 45 outputs the detection signal FE at a high level.

The lower part of FIG. 2B shows changes in the voltage V11 in correspondence with FIG. 3B. At time t1, when the gate voltage Vsg becomes lower than the reference voltage Vref1, the current source 43 shown in FIG. 2A charges the capacitor C11 and increases the voltage V11. When the spark plug 6 shown in FIGS. 1 and 5 does not produce a spark in a normal manner, at time t3, the gate voltage Vsg becomes less than the reference voltage Vref2. As a result, the current source 44 shown in FIG. 2A discharges the capacitor C11 and decreases the voltage V11.

From time t1 to time t3, the voltage V11 is higher than the reference voltage Vref3. As a result, the comparator 45 outputs the detection signal FE at a low level. As the voltage V11 decreases and becomes lower than the reference voltage Vref3, the comparator 45 outputs the detection signal FE at a high level.

The signal output circuit 28 shown in FIGS. 1 and 2A generate the ignition confirmation signal IGF based on the detection signal FE.

Figure 4:
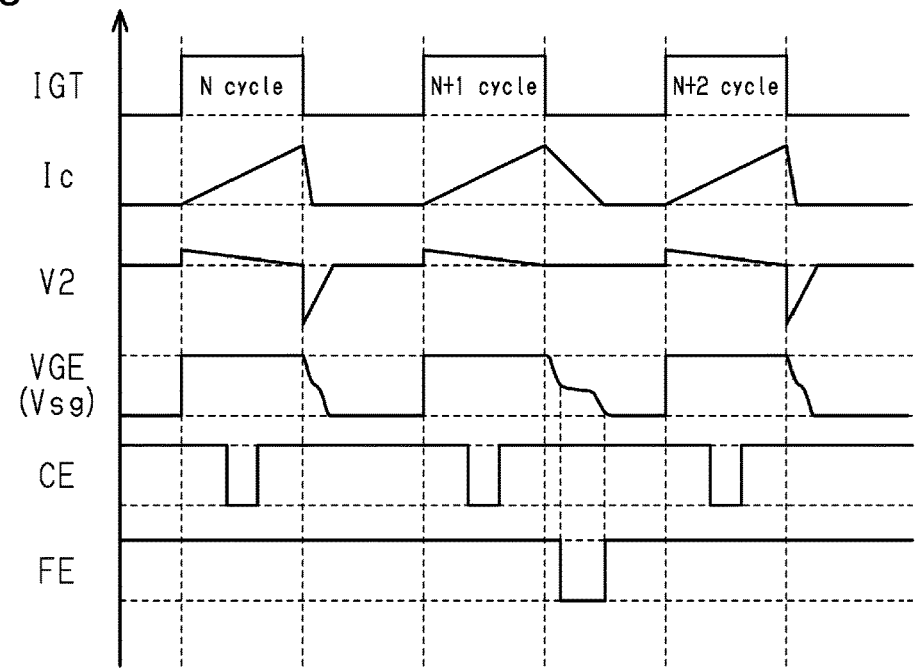
FIG. 4 is a waveform chart illustrating the operation of the switch control circuit.

FIG. 4 is a waveform chart illustrating an example of the operation of the igniter 4.

The ECU 7 shown in FIG. 1 outputs the pulse-shaped ignition instruction signal IGT in predetermined ignition cycles. FIG. 4 shows N cycle, N+1 cycle, and N+2 cycle. A case in which normal ignition occurs in N cycle and ignition does not occur in N+1 cycle will now be described.

In N cycle, during a period in which the ignition instruction signal IGT has a high level, the igniter 4 turns on the transistor 31 of the switch element 12. When the transistor 31 is turned on, the battery voltage VBAT is applied between the two terminals of the primary coil 2*a*, and the current flowing via the primary coil 2*a* and the transistor 31, namely, the collector current Ic of the transistor 31, increases over time.

The overcurrent protection circuit 27 shown in FIG. 1 generates the pulse-shaped detection signal CE based on the collector current Ic that increases during the period in which the ignition instruction signal IGT has a high level.

When the ignition instruction signal IGT shifts to a low level, the igniter 4 turns off the transistor 31 and interrupts the collector current Ic, namely, the primary current of the primary coil 2*a*. In this case, the primary voltage V1, which is proportional to the time derivative of a current Ic, is generated at the primary coil 2*a*. Further, the secondary voltage V2, which is proportional to the primary voltage V1, is generated at the secondary coil 2*b*.

When a spark is produced in a normal manner, the gate-emitter voltage VGE (gate voltage Vsg) and the collector current Ic decrease within a short period. Thus, the status detection circuit 26 shown in FIGS. 1 and 2A outputs the detection signal FE at a high level.

Next, in N+1 cycle, the igniter 4 turns on the transistor 31 of the switch element 12 during a period in which the ignition instruction signal IGT has a high level. The overcurrent protection circuit 27 shown in FIG. 1 generates the pulse-shaped detection signal CE based on the collector current Ic that increases during the period in which the ignition instruction signal IGT has a high level.

When the ignition instruction signal IGT shifts to a low level, the igniter 4 turns off the transistor 31 and interrupts the collector current Ic, namely, the primary current of the primary coil 2*a*. When a spark is not produced, the collector current Ic and the gate-emitter voltage VGE decrease over a long period. The status detection circuit 26 shown in FIGS. 1 and 2A generate the detection signal FE at a low level based on the gate-emitter voltage VGE (gate voltage Vsg). The ignition confirmation signal IGF, which combines the detection signal FE, allows a defective spark (misfire) to be easily found.

As shown in FIG. 2A, the status detection circuit 26 charges and discharges the capacitor C11 based on the output signals S11 and S12 of the comparators 41 and 42, which compare the gate voltage Vsg and the reference voltages Vref1 and Vref2, and outputs the detection signal FE based on the charge voltage V11 of the capacitor C11. Accordingly, even if the gate voltage Vsg is fluctuated by noise or the like, erroneous operations caused by the noise can be avoided. For example, when the gate voltage Vsg becomes lower than the reference voltage Vref1, the current source 43 activated by the output signal S11 of the comparator 41 produces a flow of the current I11 that starts charging the capacitor C11. Then, when the gate voltage Vsg becomes higher than the reference voltage Vref1 due to noise or the like, the output signal S11 of the comparator 41 inactivates the current source 43. That is, only the charging of the capacitor C11 is stopped, and the charge voltage V11 of the capacitor C11 is not decreased. Then, when the gate voltage Vsg becomes lower than the reference voltage Vref1 again, the current source 43 activated by the output signal S11 of the comparator 41 restarts charging of the capacitor C11. In this manner, fluctuation of the charge voltage V11 of the capacitor C11, which would be caused by noise or the like, is decreased. This reduces erroneous determination of the comparator 45 that would result from the charge voltage V11 of the capacitor C11 due to noise or the like.

Igniter Package

Figure 7:
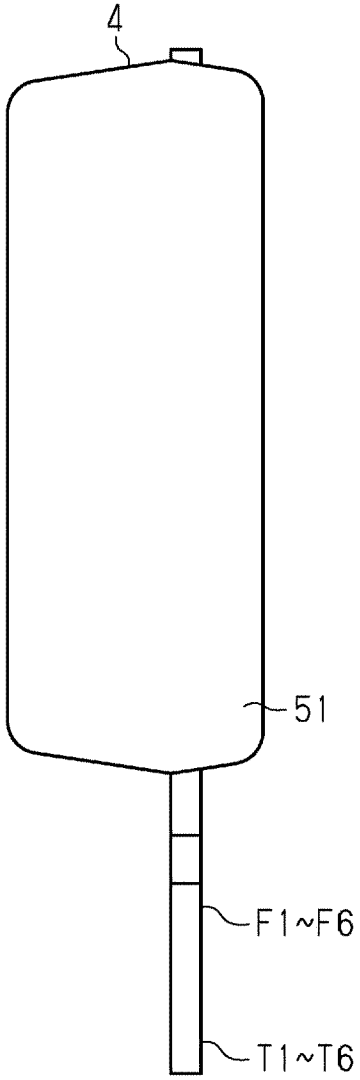
FIG. 7 is a schematic side view showing the one example of the outer appearance of the igniter.
Figure 6:
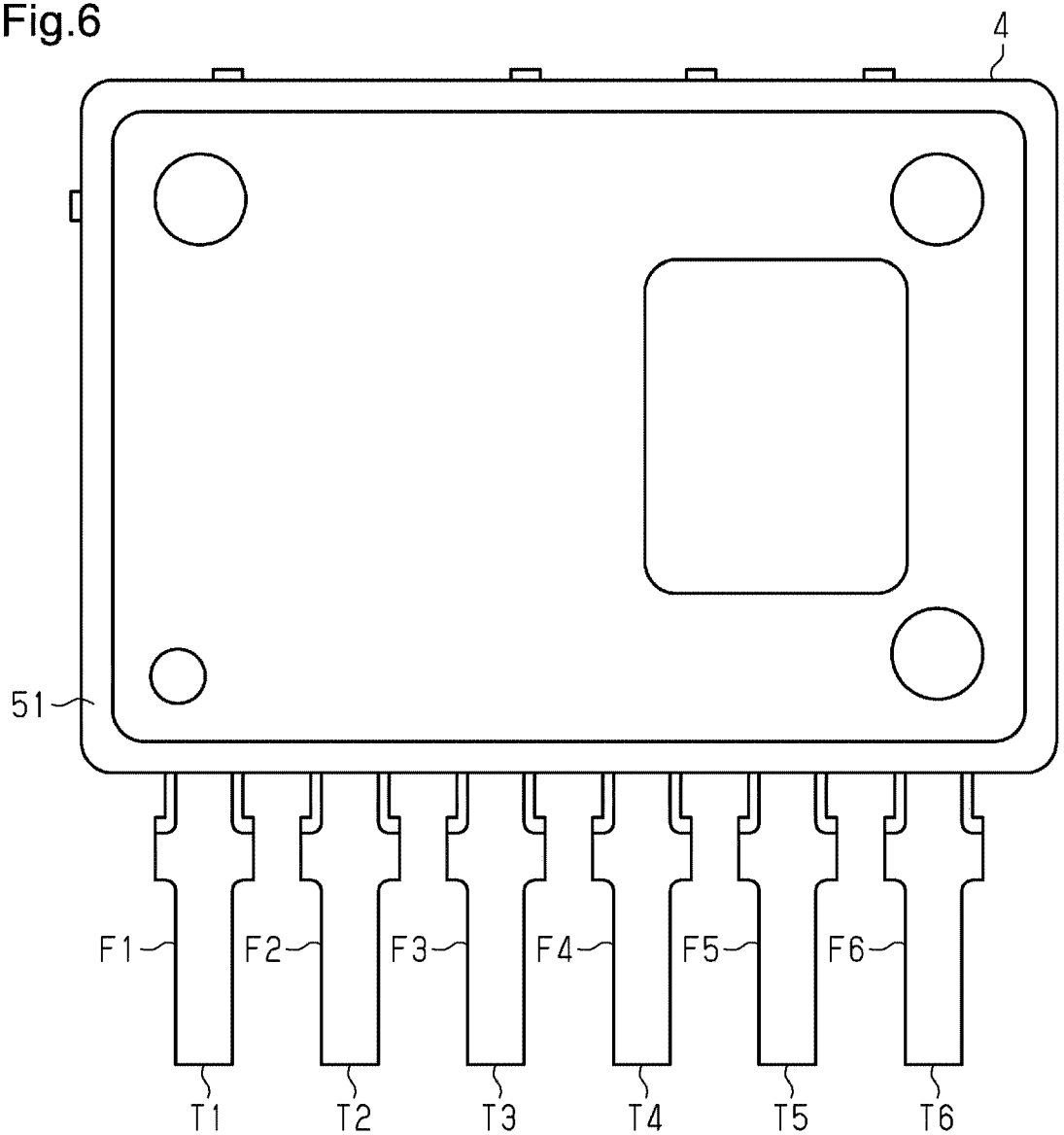
FIG. 6 is a schematic plan view showing one example of the outer appearance of the igniter.
Figure 8:
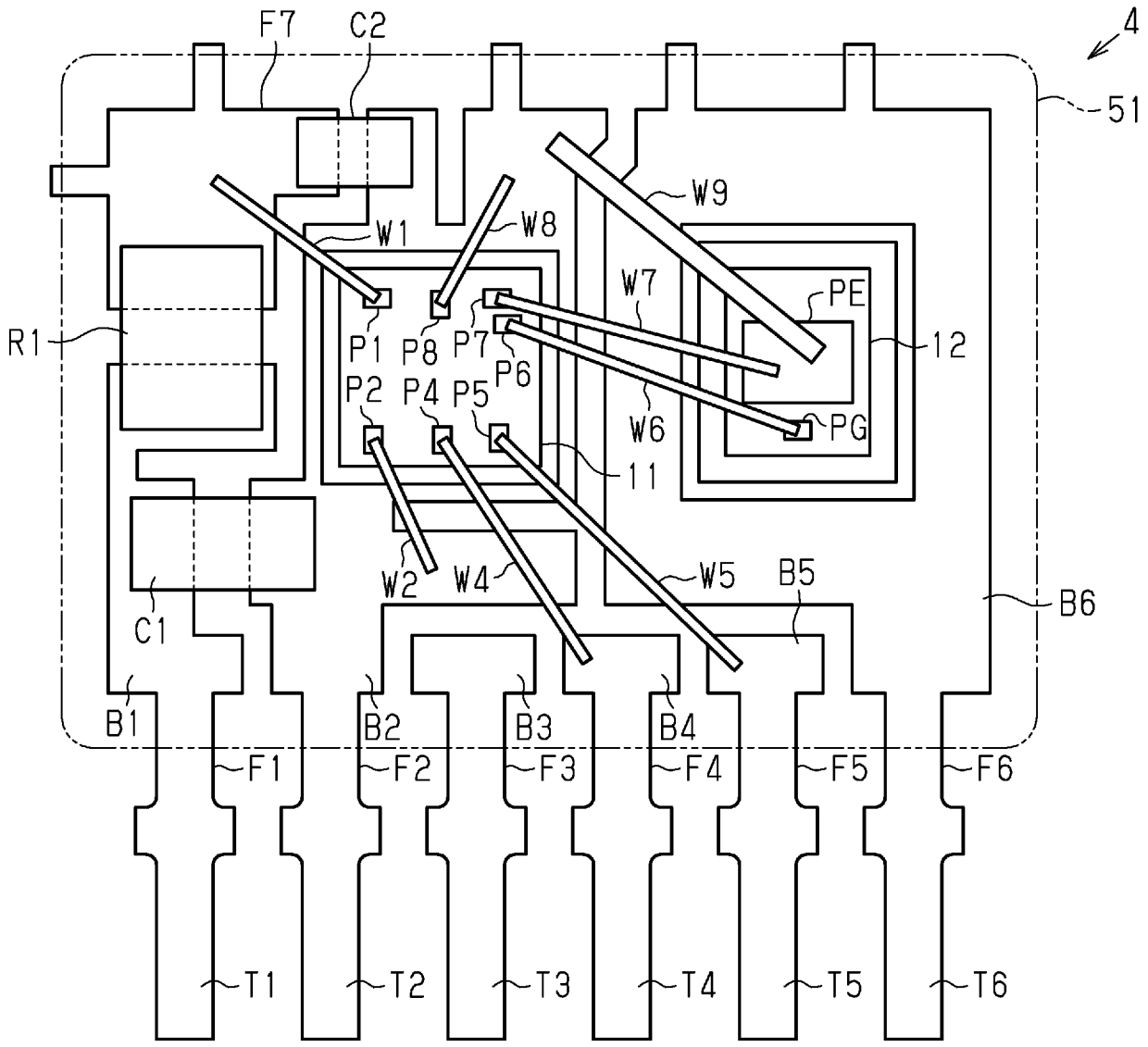
FIG. 8 is a schematic plan view showing one example of the inner configuration of the igniter.

FIGS. 6, 7, and 8 show the package of the igniter 4. FIGS. 6 and 7 show the outer appearance of the package. FIG. 8 shows the components of the igniter 4 mounted on lead frames. FIG. 8 shows an encapsulation resin 51 with double-dashed lines.

As shown in FIGS. 6 and 7, the igniter 4 includes the encapsulation resin 51, which encapsulates parts of the lead frames and components of the igniter 4, and lead frames F1, F2, F3, F4, F5, and F6, which project out of the encapsulation resin 51. The encapsulation resin 51 is substantially box-shaped and has one side surface from which the lead frames F1 to F6 project. The igniter 4 further includes a lead frame F7 arranged in the encapsulation resin 51. The lead frames F1 to F7 may be formed from a conductive metal, for example, copper (Cu), a Cu alloy, nickel (Ni), a Ni alloy, 42 alloy, or the like. A Pd plating, an Ag plating, a Ni/Pd/Ag plating, or the like may be applied to the surface of each of the lead frames F1 to F7. The encapsulation resin 51 may be an insulative resin, for example, epoxy resin.

As shown in FIG. 8, the lead frames F1 to F6 include mount portions B1 to B6 and lead portions T1 to T6 extending from the mount portions B1 to B6. The lead portions T1 to T6 correspond to the terminals of the igniter 4.

The resistor R1 is connected between the mount portion B1 of the lead frame F1 and the lead frame F7. The capacitor C1 is connected between the mount portion B1 of the lead frame F1 and the mount portion B2 of the lead frame F2. The capacitor C1 is mounted closer to the lead portions T1 and T2 of the lead frames F1 and F2 than the resistor R1. Further, the capacitor C2 is connected between the mount portion B2 of the lead frame F2 and the lead frame F7. The capacitor C2 and the capacitor C1 are mounted on opposite sides of the resistor R1. The resistor R1 and the capacitors C1 and C2 are connected by, for example, an Ag paste, solder, or the like.

A switch control device 11 is mounted on the mount portion B2 of the lead frame F2, and the switch element 12 is mounted on the mount portion B6 of the lead frame F6. The switch control device 11 is an IC chip on which the switch control circuit 11 shown in FIGS. 1 and 2A is formed. The switch control device 11 and the switch element 12 are connected by, for example, an Ag paste, solder, or the like. The lower surface of the switch element 12 includes a collector electrode PC (refer to FIG. 10), and the collector electrode PC is connected by an Ag paste, solder, or the like to the mount portion B6.

A gate pad PG and an emitter pad PE, which correspond to the gate terminal G and the emitter terminal E shown in FIG. 1, are exposed from the upper surface of the switch element 12.

Pads P1, P2, P4, P5, P6, P7, and P8, which correspond to the terminals shown in FIG. 1, are exposed from the upper surface of the switch control device 11. Pad P1 is connected by wire W1 to the lead frame F7. Pad P2 is connected by wire W2 to the mount portion B2 of the lead frame F2. Pad P4 is connected by wire W4 to the mount portion B4 of the lead frame F4. Pad P5 is connected by wire W5 to the mount portion B5 of the lead frame F5. Pad P6 is connected by wire W6 to the gate pad PG of the switch element 12. Pad P7 is connected by wire W7 to the emitter pad PE of the switch element 12. The emitter pad PE of the switch element 12 is connected by wire W9 to the mount portion B2 of the lead frame F2. Pad P8 of the switch control device 11 is connected by wire W8 to the mount portion B2 of the lead frame F2.

Wires W1, W2, W4, W5, W6, W7, and W8 are, for example, aluminum wires each having a diameter of, for example, 125 μm. Wire W9 is, for example, an aluminum wire having a diameter of, for example, 250 μm. Wire W9 has a resistance of several mΩ to several tens of mΩ for example, 5 mΩ. The resistance component of wire W9 functions as the resistor R2 shown in FIG. 1.

Plan View

Figure 9:
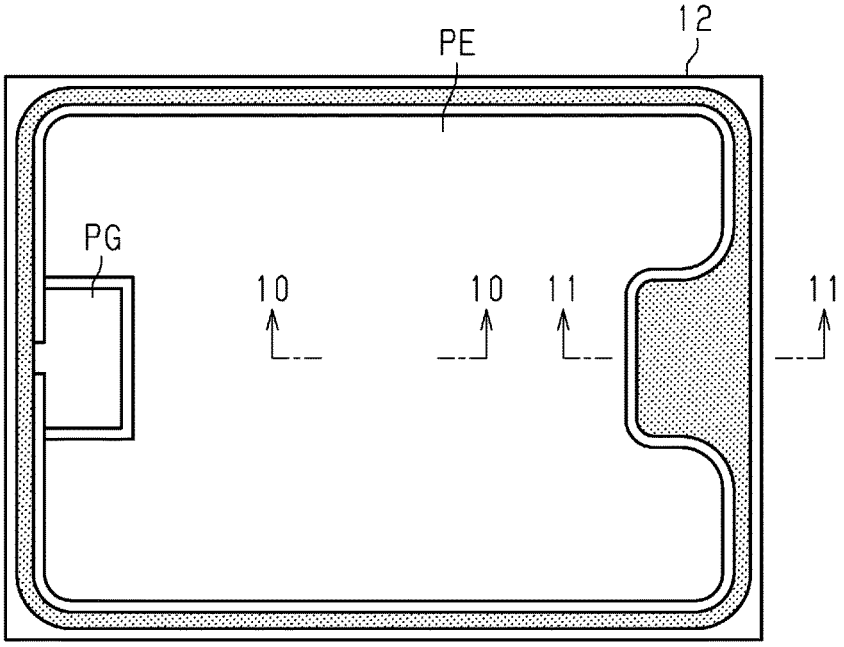
FIG. 9 is a schematic plan view of a switch element.

As shown in FIG. 9, the switch element 12 is rectangular and has an upper surface on which the gate electrode (gate pad) PG and the emitter electrode (emitter pad) PE are formed, and a lower surface on which the collector electrode PC (refer to FIG. 10) is formed. The switch element 12 includes a cell, in which transistors are formed, and the protection element 32 shown in FIG. 1, which is formed by the peripheral portion.

Cross-Sectional Structure of Switch Element (Cell)

Figure 10:
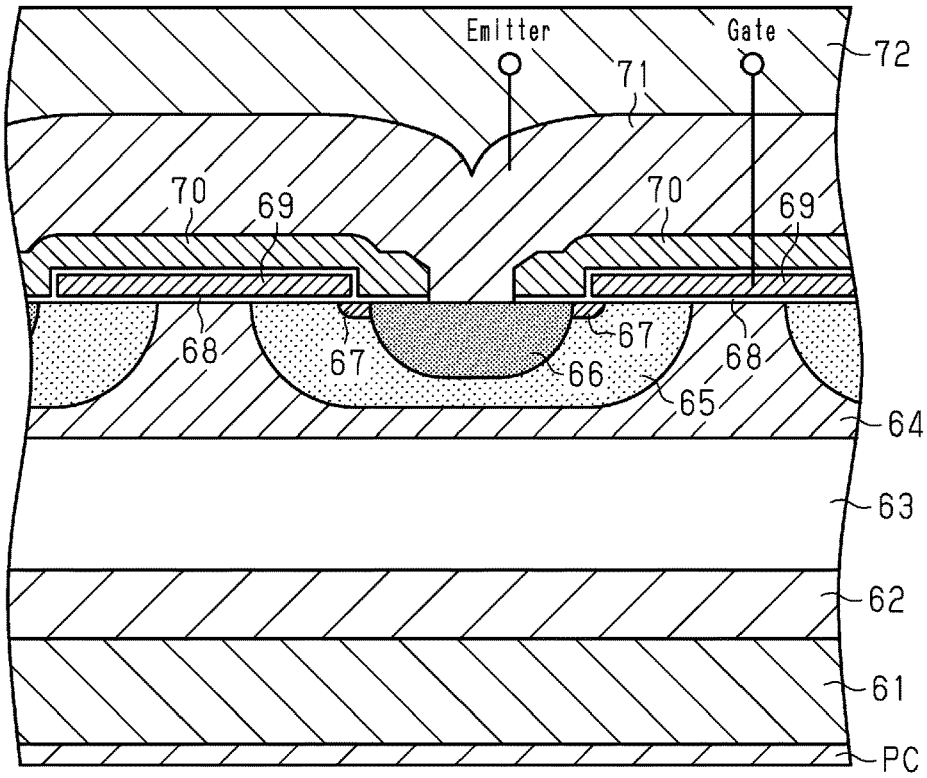
FIG. 10 is a schematic cross-sectional view of the switch element.

FIG. 10 is a schematic cross-sectional view showing the cell of the switch element 12.

The switch element 12 includes an N+ buffer layer 62 and an N− epitaxial layer 63, which is formed on the upper surface of a P+ substrate 61, and the collector electrode PC, which is formed on the lower surface of the P+ substrate 61. The thickness from the lower surface of the P+ substrate 61 to the upper surface of the N− epitaxial layer 63 is, for example, 260 μm. The thickness of the P+ substrate 61 is, for example, 150 μm, and the total thickness of the N+ buffer layer 62 and the N− epitaxial layer 63 is, for example, 90 μm.

An N+ diffusion region 64 is formed on the upper surface of the N− epitaxial layer 63. P+ diffusion regions 65 are selectively formed in the N+ diffusion region 64. Further, a P++ diffusion region 66, which has a higher concentration than the P+ diffusion region 65, and an N++ diffusion region 67, which has a higher concentration than the N+ diffusion region 64, are selectively formed in the P+ diffusion regions 65.

A gate electrode 69 is arranged on the N+ diffusion region 64, which is sandwiched by the P+ diffusion regions 65, and the P+ diffusion regions 65 with a gate oxide film 68 located in between. Further, the gate electrode 69 is covered by an interlayer insulation film 70. The gate oxide film 68 is, for example, a silicon oxide film. The gate electrode 69 is formed from, for example, polysilicon. The interlayer insulation film 70 is, for example, a silicon oxide film, a titanium film, or a titanium film/titanium nitride film (Ti/TiN).

An emitter wire 71 is formed on the interlayer insulation film 70. The emitter wire 71 is formed from, for example, AlSiCu. The emitter wire 71 has a thickness of, for example, 4 μm. A protective layer 72 is formed on the emitter wire 71. The protective layer 72 is formed from, for example, a polyimide resin.

Cross-Sectional Structure of Switch Element (Peripheral Portion)

Figure 11:
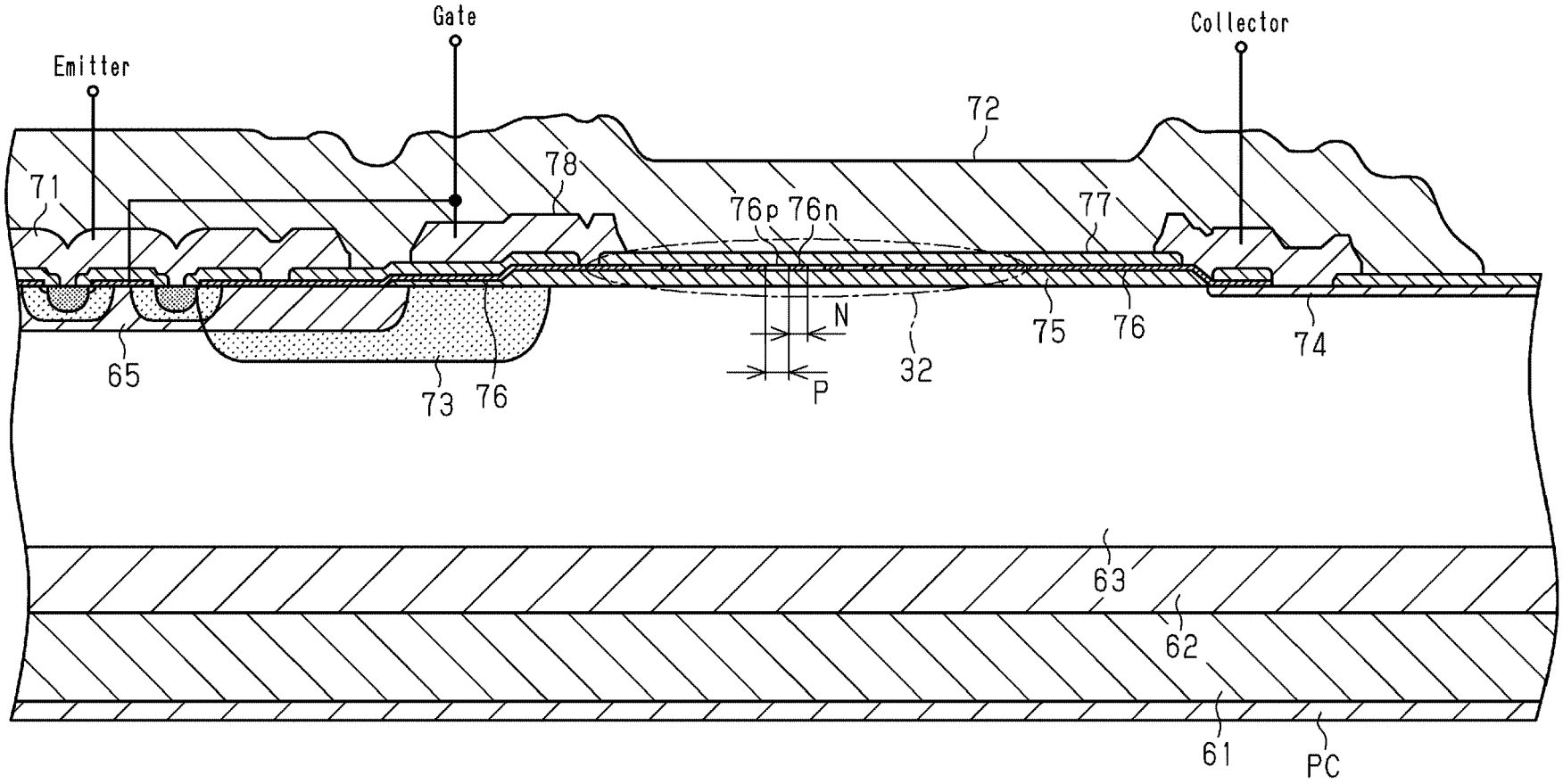
FIG. 11 is a schematic cross-sectional view of the switch element.

FIG. 11 is a schematic cross-sectional view showing the peripheral portion of the switch element 12.

A P+ diffusion region 73 and an N+ diffusion region 74 are selectively formed on the N− epitaxial layer 63. An oxide film 75 is selectively formed on the N− epitaxial layer 63. The oxide film 75 is formed to be thick on the N− epitaxial layer 63 and thin on the P+ diffusion region 73.

A polysilicon layer 76 is formed on the oxide film 75. A silicon oxide film 77 is formed on the polysilicon layer 76. A gate finger 78 is connected to the polysilicon layer 76. The gate finger 78 also serves as the gate side electrode of the protection element 32 between the gate and electrode of the transistor 31.

An N region 76*n* and a P region 76*p* are alternately formed in the polysilicon layer 76. The N region 76*n* and the P region 76*p* form the protection element 32 between the gate and collector of the transistor 31 shown in FIG. 1.

As described above, the present embodiment has the advantages described below.

(1-1) The status detection circuit 26 detects a status from the gate voltage Vsg and outputs the detection signal FE. Then, the signal output circuit 28 combines the detection signal FE of the status detection circuit 26 with another signal to generate the ignition confirmation signal IGF. The ignition confirmation signal IGF, which is combined in this manner, allows a defective spark (misfire) of the spark plug 6 to be easily found.

(1-2) The status detection circuit 26 outputs the ignition confirmation signal IGF from the signal output terminal P4. Accordingly, the detection results of a plurality of detection circuits can be output from the same signal output terminal P4, and enlargement of the igniter 4 is limited.

(1-3) The status detection circuit 26 charges and discharges the capacitor C11 based on the output signals S11 and S12 of the comparators 41 and 42, which compare the gate voltage Vsg with the reference voltages Vref1 and Vref2, and outputs the detection signal FE based on the charge voltage V11 of the capacitor C11. Accordingly, even if the gate voltage Vsg is fluctuated by noise or the like, erroneous operations caused by the noise can be avoided.

Modified Examples of First Embodiment

Modified examples of the first embodiment will now be described. In the description hereafter, same reference numerals are given to those components that are the same as the corresponding components of the first embodiment. Such components will not be described in detail.

Figure 12:
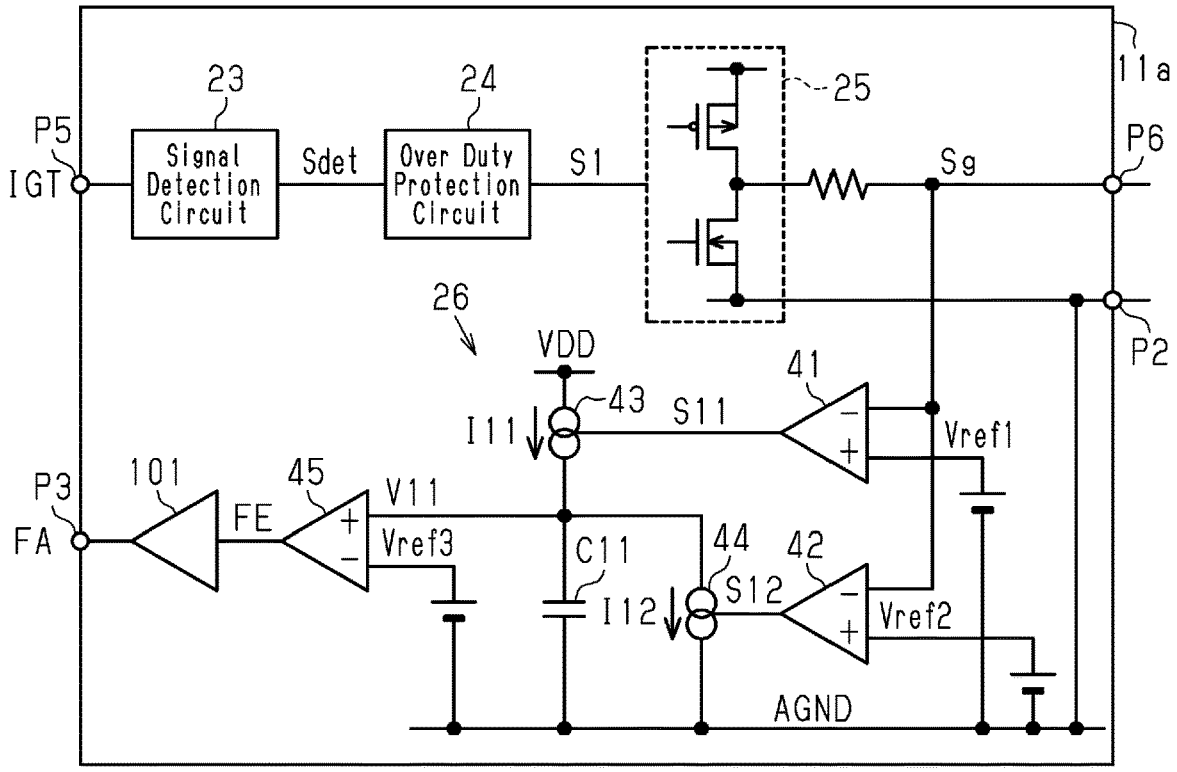
FIG. 12 is a schematic block circuit diagram showing a switch control circuit of a modified example.

As shown in FIG. 12, a switch control circuit 11*a* includes an output buffer 101 and a signal output terminal P3, to which the output terminal of the output buffer 101 is connected. The output buffer 101 receives the detection signal FE output from the comparator 45 of the status detection circuit 26. In this manner, the switch control circuit 11*a* includes the signal output terminal P3 dedicated to the output of a signal FA that indicates the ignition status. The signal FA is one example of a single ignition detection signal that does not include another detection signal.

Figure 13:
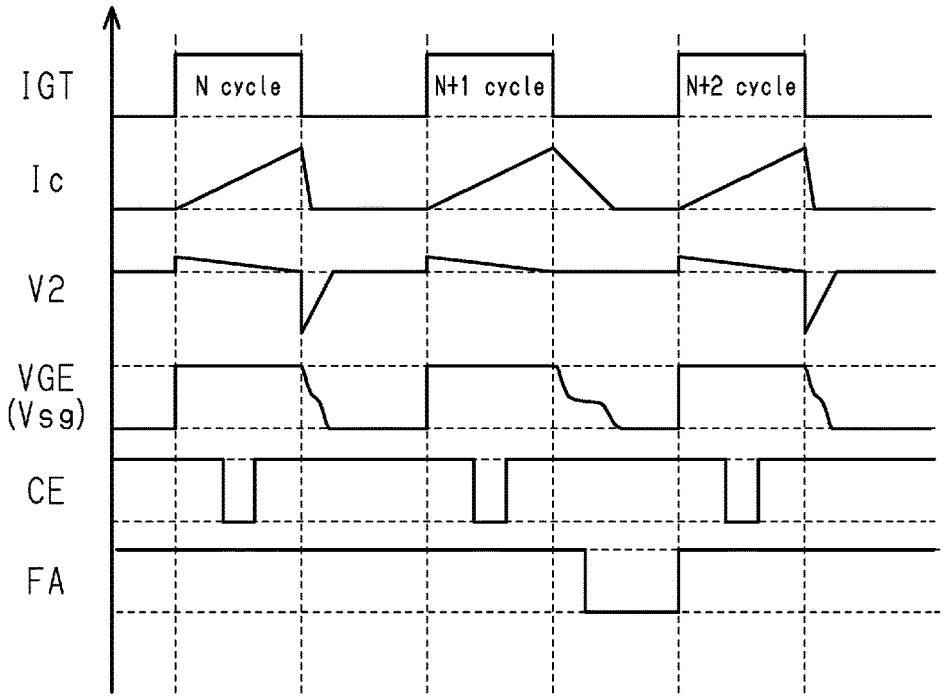
FIG. 13 is a waveform chart illustrating the operation of a switch control circuit of the modified example.

As shown in FIG. 13, the switch control circuit 11*a* outputs the pulsed detection signal CE based on the collector current Ic in N cycle, N+1 cycle, and N+2 cycle. Further, in accordance with the gate-emitter voltage VGE (the gate voltage Vsg) that changes in accordance with the ignition instruction signal IGT of N+1 cycle, the status detection circuit 26 outputs the signal FA, which is in accordance with the ignition status, before the ignition instruction signal IGT of subsequent N+2 cycle. In this manner, by outputting the signal FA separately from the detection signal CE, the ECU 7 can easily check the ignition status. Further, by outputting the signal FA before the ignition instruction signal IGT of N+2 cycle, the pulse width and the like of the ignition instruction signal IGT in the subsequent N+2 cycle can be adjusted.

Figure 14:
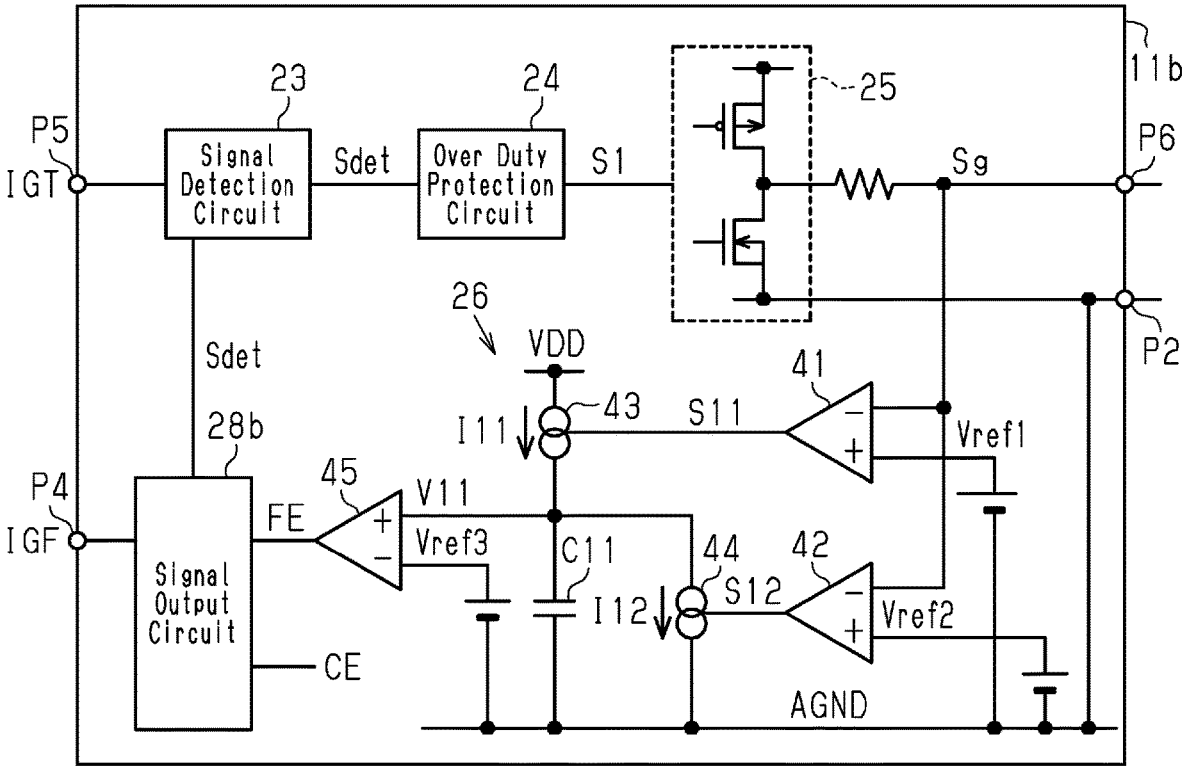
FIG. 14 is a schematic block circuit diagram showing a switch control circuit of a modified example.

As shown in FIG. 14, a switch control circuit 11*b* includes a signal output circuit 28*b*. The signal output circuit 28*b* is provided with the received signal Sdet, which is the ignition instruction signal IGT received from the signal detection circuit 23.

Figure 15:
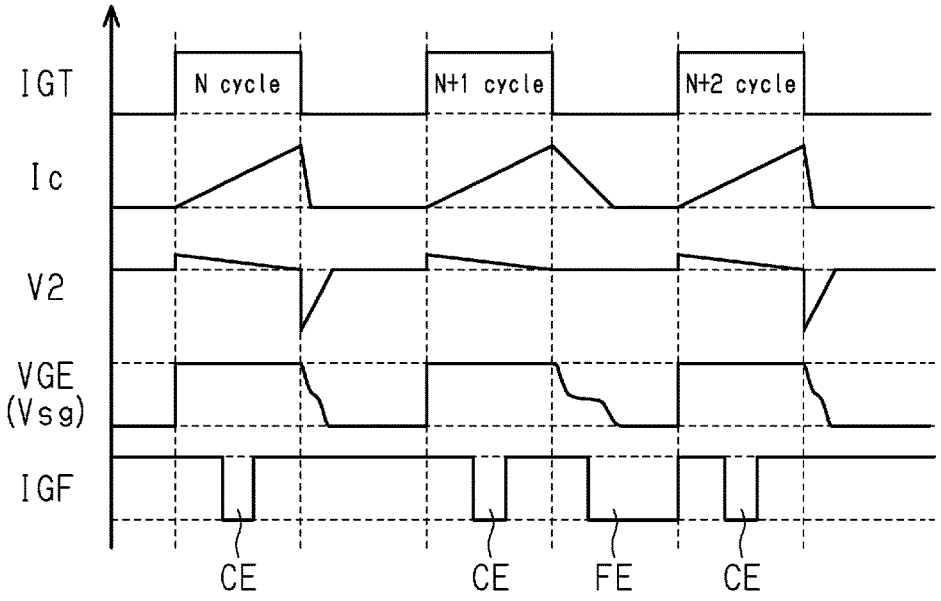
FIG. 15 is a waveform chart illustrating the operation of the switch control circuit of the modified example.

As shown in FIG. 15, the signal output circuit 28*b* generates the ignition confirmation signal IGF in accordance with a detection signal of the overcurrent protection circuit 27 based on the received signal Sdet during the period in which the ignition instruction signal IGT has a high level. Further, the signal output circuit 28*b* generates the ignition confirmation signal IGF in accordance with the detection signal FE of the status detection circuit 26 during the period in which the ignition instruction signal IGT has a low level. Such a switch control circuit 11*b* eliminates the need for a separate terminal that outputs the detection signal FE in correspondence with the status, limits enlargement of the switch control circuit 11*b*, and allows the ECU 7 to easily check the ignition status. Further, by outputting the detection signal FE before the ignition instruction signal IGT of N+2 cycle, the pulse width and the like of the ignition instruction signal IGT in the subsequent N+2 cycle can be adjusted.

Figure 16:
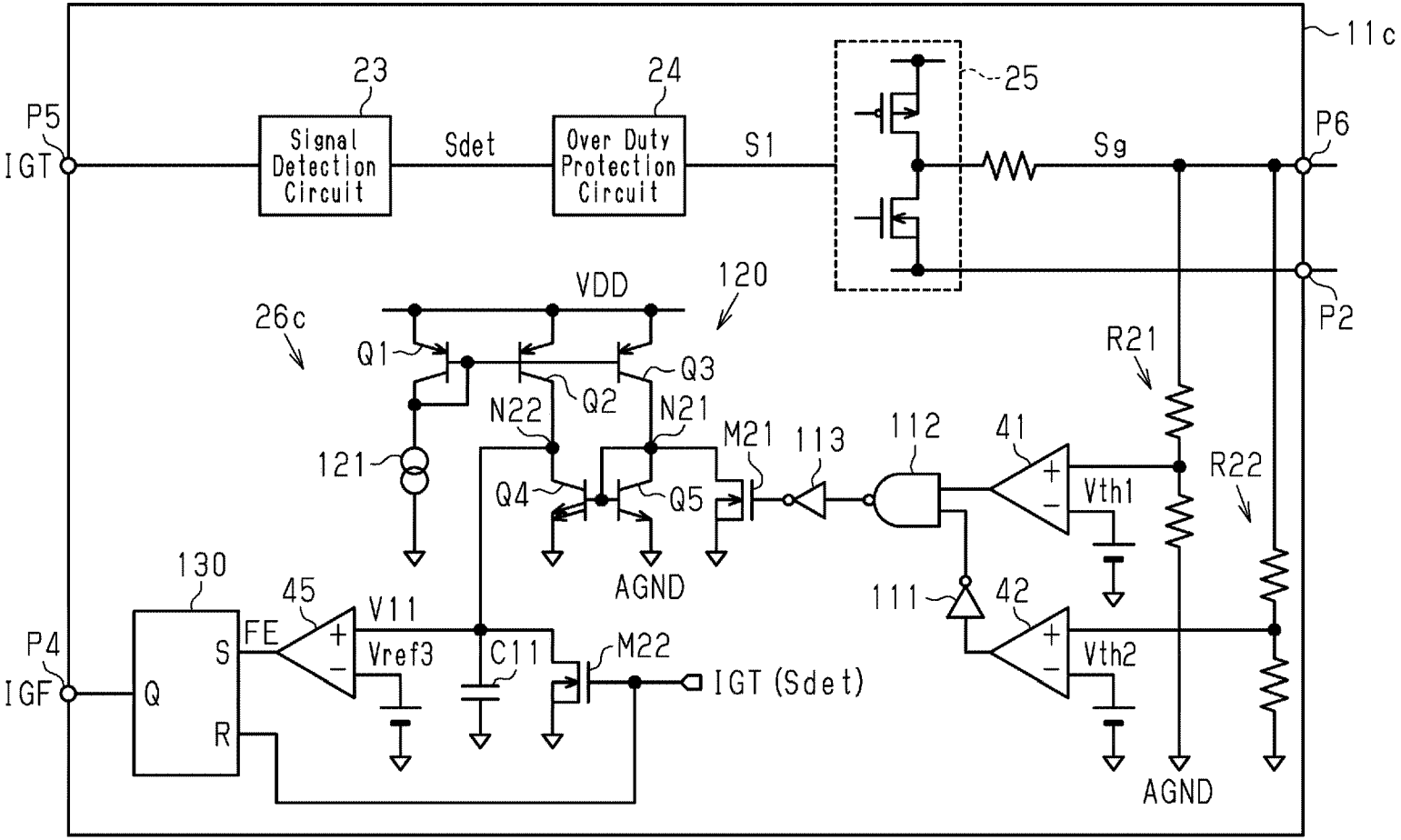
FIG. 16 is a schematic block circuit diagram showing a switch control circuit of a modified example.

As shown in FIG. 16, the switch control circuit 11*c* includes a status detection circuit 26*c*. The status detection circuit 26*c* includes the comparators 41 and 42, voltage-dividing resistors R21 and R22, inverter circuits 111 and 113, a NAND circuit 112, a charge-discharge circuit 120, the capacitor C11, transistors M21 and M22, and the comparator 45. The transistors M21 and M22 are, for example, NMOS-FETs.

The voltage-dividing resistors R21 and R22 are connected between the output terminal P6 and the ground line AGND. Output nodes of the voltage-dividing resistors R21 and R22 are connected to non-inverting terminals of the comparators 41 and 42. The inverting input terminal of the comparator 41 is supplied with a threshold voltage Vth1 and the inverting input terminal of the comparator 42 is supplied with a threshold voltage Vth2. The output terminal of the comparator 41 is connected to the input terminal of the NAND circuit 112, and the output terminal of the comparator 42 is connected via the inverter circuit 111 to the NAND circuit 112. The output terminal of the NAND circuit 112 is connected via the inverter circuit 113 to the gate terminal of the transistor M21. The source terminal of the transistor M21 is connected to the ground line AGND, and the drain terminal of the transistor M21 is connected to an input node N21 of the charge-discharge circuit 120.

The charge-discharge circuit 120 includes a current source 121 and transistors Q1 to Q5. The transistors Q1 to Q3 are, for example, PNP transistors, and the transistors Q4 and Q5 are, for example, NPN transistors. The emitters of the transistors Q1 to Q3 are connected to the power line VDD. The collector of the transistor Q1 is connected to a first terminal of the current source 121, and a second terminal of the current source 121 is connected to the ground line AGND. The bases of the transistors Q2 and Q3 are connected to the base and collector of the transistor Q1. The transistors Q1, Q2, and Q3 form a current-mirror circuit. The transistors Q2 and Q3 are configured so that the amount of flowing current is the same as the transistor Q1.

The collectors of the transistors Q2 and Q3 are connected to the collectors of the transistors Q4 and Q5, and the emitters of the transistors Q4 and Q5 are connected to the ground line AGND. Further, the collector of the transistor Q5 (input node N21) is connected to the bases of the two transistors Q4 and Q5. An output node N22 between the transistor Q2 and the transistor Q4 is connected to the capacitor C11. The transistor Q4 includes, for example, a plurality of parallel-connected transistors and is configured to produce a flow of current that is an integer multiple of the flow of current produced by the transistor Q5.

The transistor M22 is connected in parallel to the capacitor C11, and the gate of the transistor M22 is provided with the received signal Sdet. The gate of the transistor M21 may be provided with various types of internal detection signals of the switch control circuit 11*c* or a signal combining various types of signals.

The output terminal of the comparator 45 is connected to the set terminal S of a flip-flop circuit 130, and the reset terminal R of the flip-flop circuit 130 is provided with the signal provided to the gate of the transistor M22, namely, the received signal Sdet. The flip-flop circuit 130 outputs the ignition confirmation signal IGF from the output terminal Q.

In the status detection circuit 26*c*, the charge-discharge circuit 120 charges the capacitor C11 while the transistor M21 is on and discharges the capacitor C11 while the transistor M21 is off. The detection signal FE of the comparator 45, which detects the voltage V11 of the capacitor C11, sets the flip-flop circuit 130 and outputs the ignition confirmation signal IGF, which is in accordance with the ignition status, from the output terminal Q of the flip-flop circuit 130. Further, the received signal Sdet provided to the gate of the transistor M22 turns on the transistor M22 to shift the voltage V11 of the capacitor C11 to a low level and reset the flip-flop circuit 130.

Figure 17:
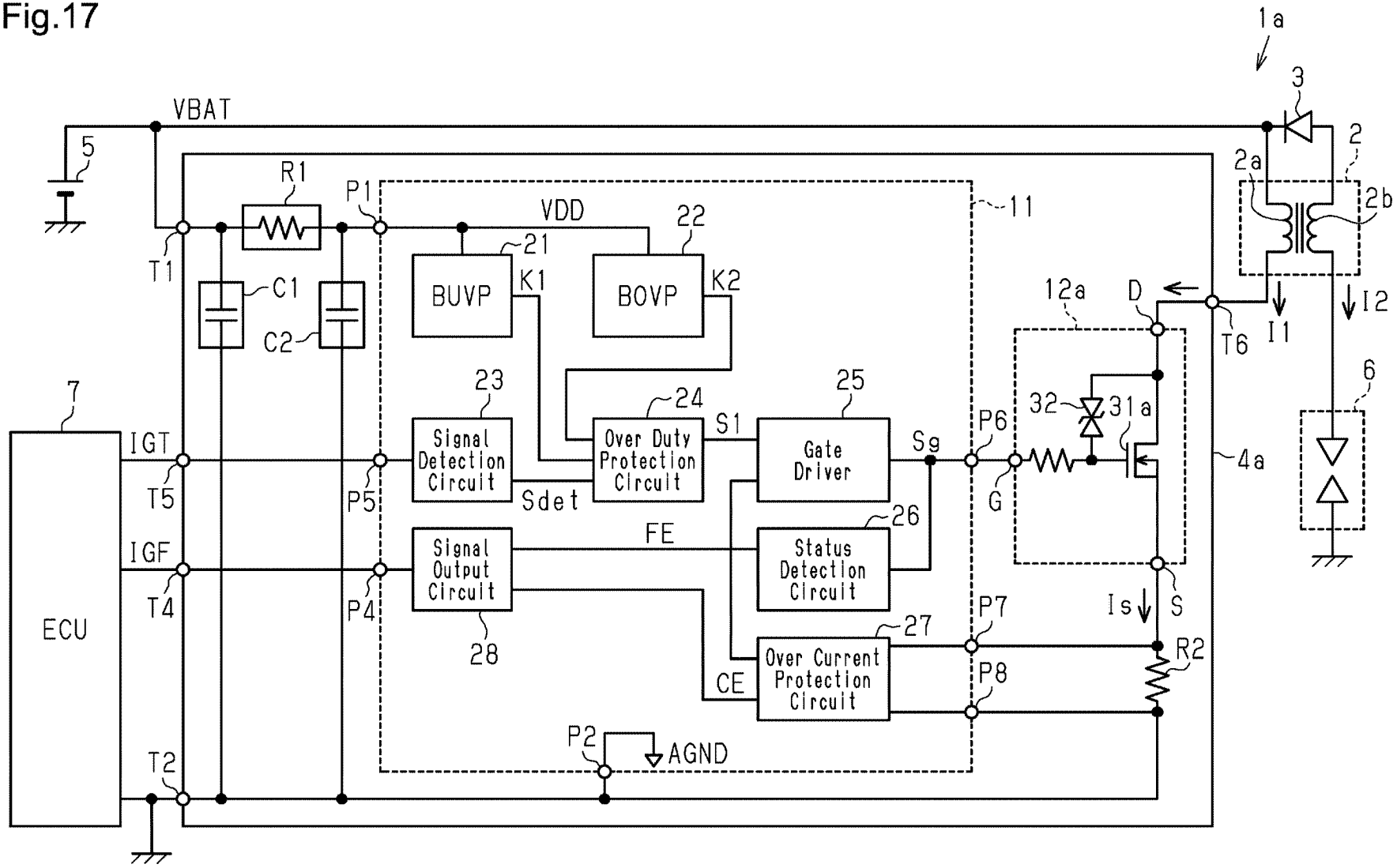
FIG. 17 is a schematic block circuit diagram showing an ignition device of a first embodiment.

As shown in FIG. 17, an ignition device 1*a* includes the ignition coil 2 and an igniter 4*a*.

The igniter 4*a* includes a switch element 12*a*, the switch control circuit 11, the resistor R1, the capacitors C1 and C2, and the resistor R2 and is modularized and accommodated in a single package. The switch control circuit 11 includes the under voltage protection circuit 21, the over voltage protection circuit 22, the signal detection circuit 23, the over duty protection circuit 24, the gate driver 25, the status detection circuit 26, the overcurrent protection circuit 27, and the signal output circuit 28.

The switch element 12*a* is formed by a single semiconductor chip including a transistor 31*a*. The transistor 31*a* is, for example, a SiC MOSFET. The protection element 32 is connected between the gate and drain of the transistor 31*a*. Terminals (S, G, and D) of the transistor 31*a* may be described as the terminals of the semiconductor chip, or the switch element 12*a*. The gate terminal of the transistor 31*a* is connected via a resistor to the output terminal P6 of the switch control circuit 11. The gate signal Sg, which is output from the gate driver 25, is provided via the output terminal P6 to the gate terminal G of the switch element 12*a*. The source terminal of the transistor 31*a* is connected to the resistor R2, and the drain terminal of the transistor 31*a* is connected via the output terminal T6 to the primary coil 2*a* of the ignition coil 2.

The igniter 4*a* on-off controls the switch element 12*a* based on the ignition instruction signal IGT provided from the ECU 7. By turning the switch element 12*a* on and off, the secondary voltage V2 generated at the secondary coil 2*b* of the ignition coil 2 produces a spark with the spark plug 6. The status detection circuit 26 of the switch control circuit 11 uses the voltage at the gate terminal G, which controls the transistor 31*a* of the switch element 12*a*, as a detection voltage and outputs the detection signal FE corresponding to the detection voltage. The signal output circuit 28 combines various types of signals including the detection signal CE of the overcurrent protection circuit 27 with the detection signal FE of the status detection circuit 26 to generate the ignition confirmation signal IGF and output the ignition confirmation signal IGF. The switch control circuit 11*a* of FIG. 12, the switch control circuit 11*b* of FIG. 14, or the like may be used as the switch control circuit 11.

In this manner, for example, in the igniter 4*a* with the switch element 12*a* including the transistor 31*a*, which is a SiC MOSFET, the ignition confirmation signal IGF allows a defective spark (misfire) of the spark plug 6 to be easily found in the same manner as the first embodiment.

Second Embodiment

A second embodiment will now be described.

In this embodiment, same reference numerals are given to those components that are the same as the corresponding components of the above embodiment.

Figure 18:
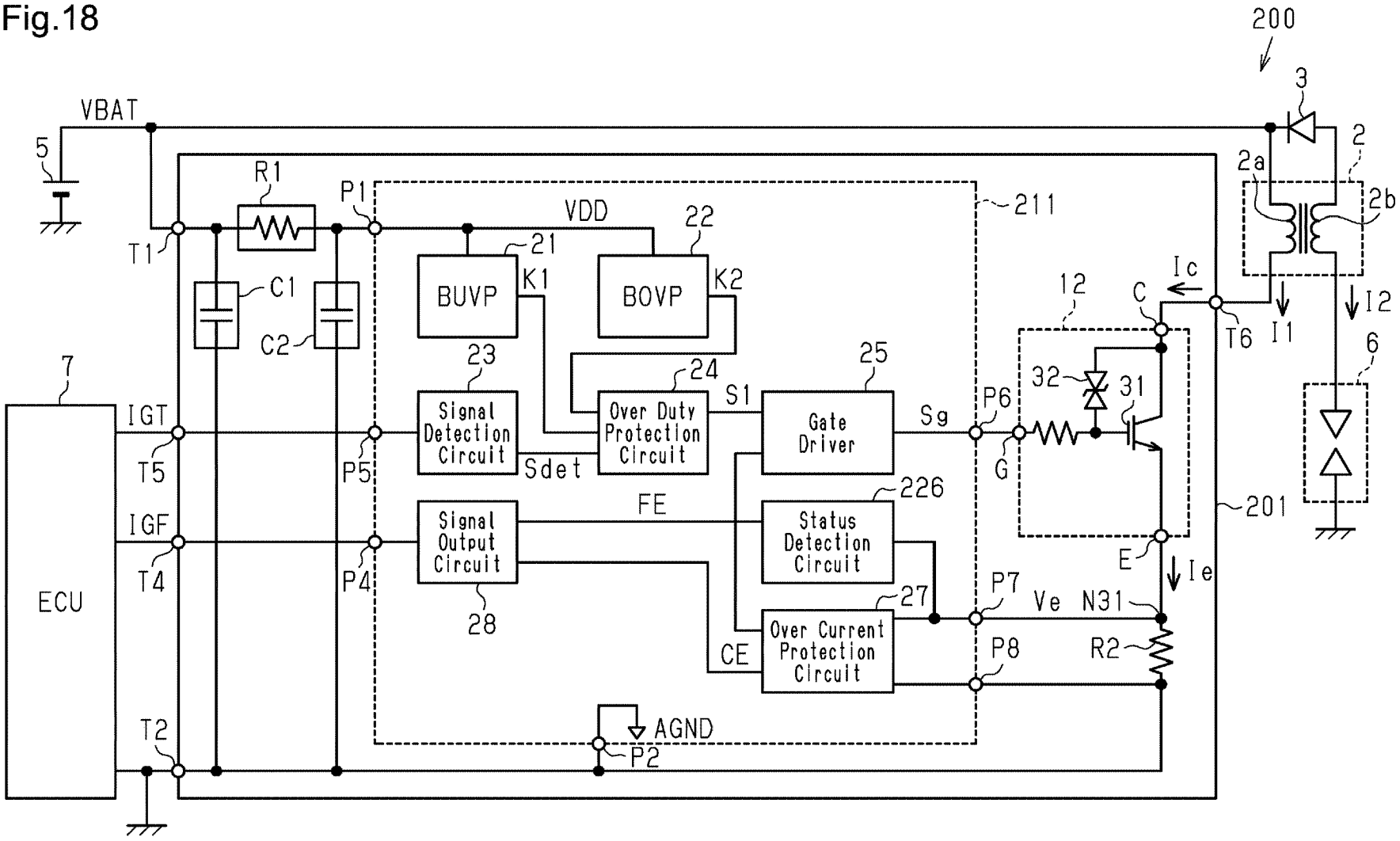
FIG. 18 is a schematic block circuit diagram showing an ignition device of a second embodiment.

As shown in FIG. 18, an ignition device 200 includes the ignition coil 2 and an igniter 201.

The igniter 201 includes the switch element 12, a switch control circuit 211, the resistor R1, the capacitors C1 and C2, and the resistor R2 and is modularized and accommodated in a single package.

The switch control circuit 211 includes the under voltage protection circuit 21, the over voltage protection circuit 22, the signal detection circuit 23, the over duty protection circuit 24, the gate driver 25, a status detection circuit 226, the overcurrent protection circuit 27, and the signal output circuit 28.

The status detection circuit (Ignition Status Detector) 226 uses the voltage corresponding to the collector current Ic of the transistor 31 of the switch element 12 as a detection voltage and outputs the detection signal FE in correspondence with a change in the detection voltage. The status detection circuit 226 of the present embodiment detects the ignition status of the spark plug 6 from the emitter current Ie (collector current Ic) flowing through the resistor R2 and outputs the detection signal FE. A first terminal of the resistor R2 is connected to the emitter of the switch element 12, and a second terminal of the resistor R2 is connected to the ground line AGND. Accordingly, the status detection circuit 226 detects the ignition status of the spark plug 6 from a voltage Ve at node N31 (detection node between switch element 12 and resistor R2) that changes in accordance with the collector current Ic. For example, the status detection circuit 226 outputs the detection signal FE at a high level in a case where the spark plug 6 produces a spark, that is, in a normal state in which normal ignition occurs, and outputs the detection signal FE at a low level in a case where the spark plug 6 does not produce a spark, that is, in a misfire state in which normal ignition does not occur.

Figure 19:
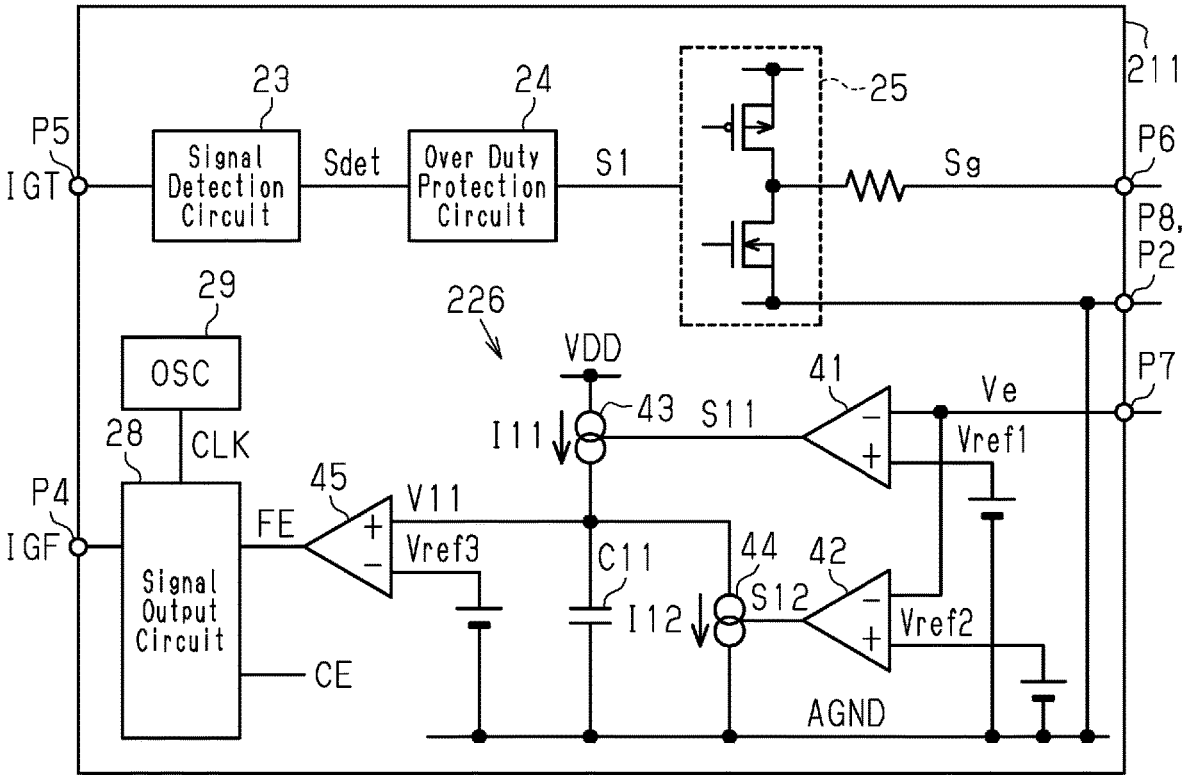
FIG. 19 is a schematic block circuit diagram showing a switch control circuit of the second embodiment.

As shown in FIG. 19, the status detection circuit 226 includes the comparators 41 and 42, the current sources 43 and 44, the capacitor C11, and the comparator 45.

The inverting input terminals of the comparators 41 and 42 are connected to an input terminal P7 and supplied with the voltage Ve.

The non-inverting input terminal of the comparator 41 is supplied with the reference voltage Vref1, and the non-inverting input terminal of the comparator 42 is supplied with the reference voltage Vref2. The reference voltages Vref1 and Vref2 are set in correspondence with a change in the voltage Ve.

The comparator 41 compares the voltage Ve and the reference voltage Vref1 and outputs the signal S11 having a level that is in accordance with the comparison result. The comparator 42 compares the voltage Ve and the reference voltage Vref2 and outputs the signal S12 having a level that is in accordance with the comparison result.

The first terminal of the current source 43 is connected to the power line VDD and supplied with the drive voltage VDD. A second terminal of the current source 43 is connected to a first terminal of the capacitor C11, and a second terminal of the capacitor C11 is connected to the ground line AGND. The current source 44 is connected in parallel to the capacitor C11.

The current source 43 is activated or inactivated in response to the output signal S11 of the comparator 41. The activated current source 43 produces a flow of a predetermined current I11. The current I11 charges the capacitor C11 and increases the voltage V11 at the first terminal of the capacitor C11.

The current source 44 is activated or inactivated in response to the output signal S12 of the comparator 42. The activated current source 44 produces a flow of a predetermined current I12. The current I12 discharges the capacitor C11 and decreases the voltage V11 at the first terminal of the capacitor C11.

The first terminal of the capacitor C11 is connected to the non-inverting terminal of the comparator 45, and the inverting terminal of the comparator 45 is supplied with a reference voltage Vref3.

The comparator 45 compares the voltage V11 at the first terminal of the capacitor C11 with the reference voltage Vref3 and outputs the detection signal FE in accordance with the comparison result.

The signal output circuit 28 receives the detection signal FE, which is output from the comparator 45, and the detection signal CE, which is output from the overcurrent protection circuit 27 shown in FIG. 1. Further, the signal output circuit 28 is provided with a clock signal CLK, which has a predetermined frequency, from an oscillator (OSC) 29.

The clock signal CLK is, for example, a system clock or a signal obtained by frequency-dividing the system clock, and used to receive the ignition control signal or the like.

The signal output circuit is actuated in accordance with the clock signal CLK to output the ignition confirmation signal IGF, which combines the detection signals FE and CE.

Figure 20A:
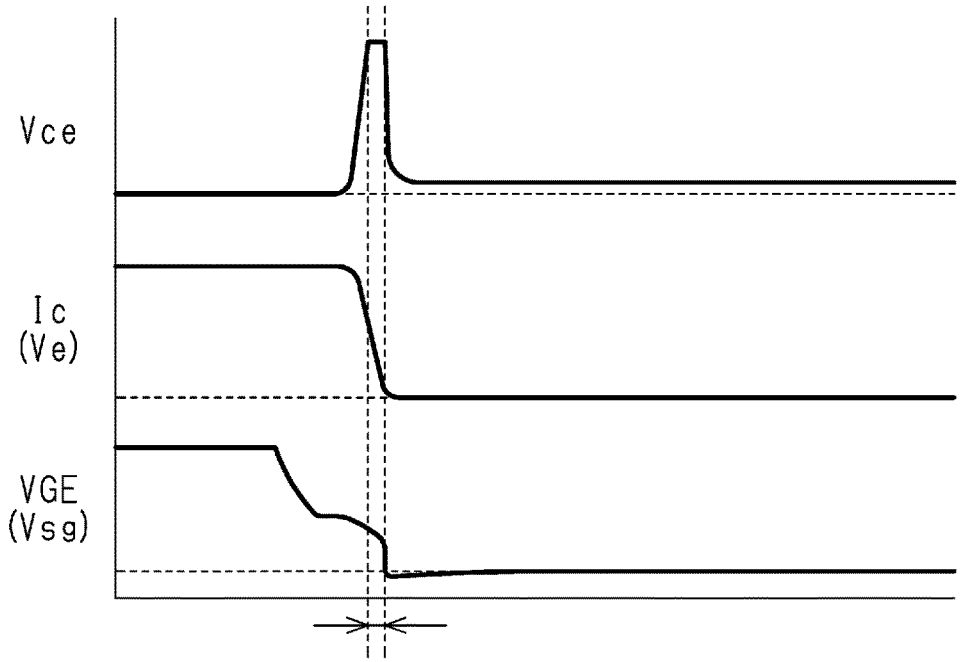
FIG. 20A is a waveform chart illustrating the voltage at each part of the igniter during a normal ignition.
Figure 20B:
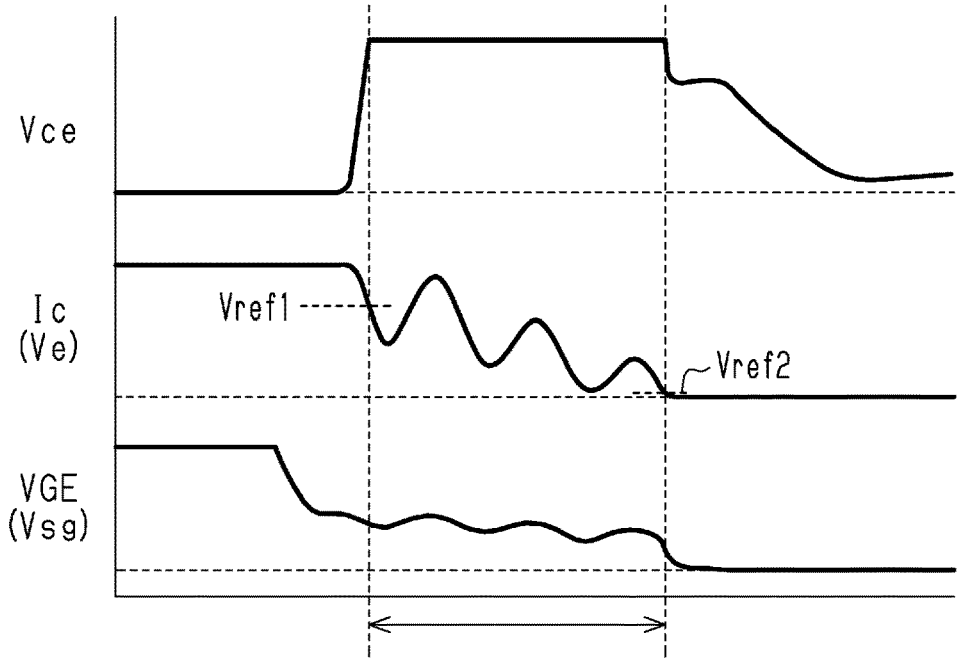
FIG. 20B is a waveform chart illustrating the voltage at each part of the igniter during a misfire.

FIGS. 20A and 20B show changes in the collector-emitter voltage Vce of the switch element 12 (transistor 31), the collector current Ic, and the gate-emitter voltage VGE (gate voltage Vsg).

As shown in FIG. 20A, when a spark is produced in a normal manner, energy is lost, the collector current Ic of the transistor 31 readily decreases, and the collector-emitter voltage Vce suddenly decreases in accordance with the collector current Ic. Further, potential levels of the collector current Ic and the gate-emitter voltage VGE (gate voltage Vsg) become low (0). In this manner, when the spark plug 6 is ignited in a normal manner, the gate-emitter voltage VGE (gate voltage Vsg) and the collector current Ic decrease to a predetermined level within a short period.

As shown in FIG. 20B, in a case where the spark plug 6 does not produce a spark, the collector-emitter voltage Vce is maintained as a high voltage. The gate-emitter voltage VGE (gate voltage Vsg) slowly decreases. Further, the parasitic capacitance and inductance of the ignition coil 2 gradually decreases the collector current Ic as it repeatedly increases and decreases. When the gate-emitter voltage VGE (gate voltage Vsg) and the collector current Ic becomes lower than predetermined values, the collector-emitter voltage Vce decreases.

In this manner, in accordance with the status of the spark plug 6, the gate-emitter voltage VGE (gate voltage Vsg) and the collector current Ic decrease differently, and the period during which the collector-emitter voltage Vce is maintained at a high level becomes different.

The status detection circuit 226 shown in FIG. 19 detects the status of the spark plug 6 from these voltage changes and outputs the detection signal FE. In the present embodiment, the status detection circuit 226 detects the status from the voltage Ve that corresponds to the collector current Ic. Then, the signal output circuit 28 combines the detection signal FE of the status detection circuit 226 with another signal to generate the ignition confirmation signal IGF. The ignition confirmation signal IGF, which is combined in this manner, is output from the signal output terminal P4. This allows the detection results of a plurality of detection circuits to be output from the same signal output terminal P4 and limits enlargement of the igniter 201.

As shown in FIG. 19, the status detection circuit 226 compares the collector current Ic (emitter voltage Ve: detection voltage shown in FIG. 18) and the reference voltages Vref1 and Vref2 with the comparators 41 and 42. The reference voltages Vref1 and Vref2 are set for the collector current Ic in correspondence with the period during which the collector-emitter voltage Vce is maintained at a high level (period shown by arrows), as shown in FIG. 20B.

The output signal S11 of the comparator 41 charges the capacitor C11, and the output signal S12 of the comparator 42 discharges the capacitor C11. Accordingly, the voltage V11 at the first terminal of the capacitor C11 corresponds to changes in the collector current Ic shown in FIGS. 20A and 20B.

As shown in FIG. 20B, the parasitic capacitance and inductance of the ignition coil 2 gradually decreases the collector current Ic as it repeatedly increases and decreases. Accordingly, after a detection voltage Ve, which is based on the collector current Ic, becomes lower than the reference voltage Vref1, the detection voltage Ve may become higher than the reference voltage Vref1. In this case, the charging of the capacitor C11 is interrupted by the output signal S11 of the comparator 41 shown in FIG. 19. Then, when the detection voltage Ve becomes lower than the reference voltage Vref1 again, charging of the capacitor C11 is restarted.

As described above, the present embodiment has the advantages described below.

(2-1) The status detection circuit 226 detects the status based on the detection voltage Ve corresponding to the collector current Ic of the transistor 31 and outputs the detection signal FE. Then, the signal output circuit 28 combines the detection signal FE of the status detection circuit 26 with another signal to generate the ignition confirmation signal IGF. The ignition confirmation signal IGF, which is combined in this manner, allows the status of a spark of the spark plug 6 to be easily checked.

Modified Examples of Second Embodiment

Modified examples of the second embodiment will now be described. In the description hereafter, same reference numerals are given to those components that are the same as the corresponding components of the first and second embodiments. Such components will not be described in detail.

Figure 21:
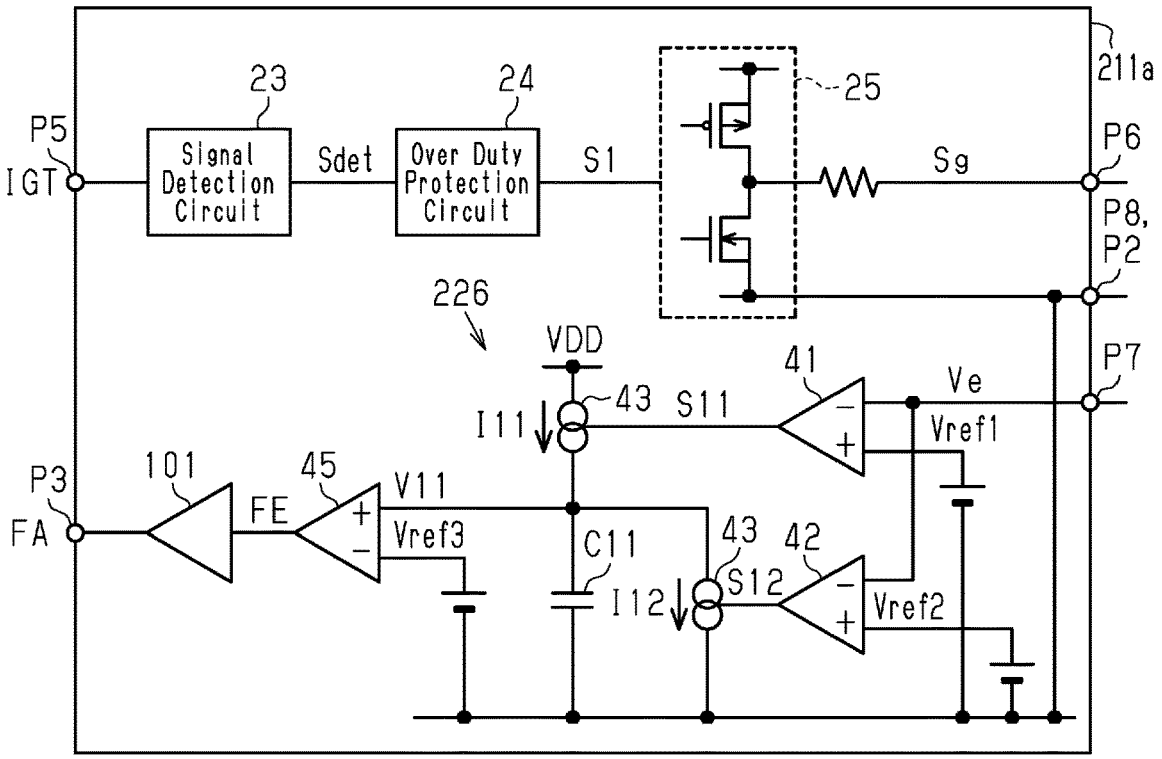
FIG. 21 is a schematic block circuit diagram showing a switch control circuit of a modified example.

As shown in FIG. 21, a switch control circuit 211*a* includes the output buffer 101 and the signal output terminal P3, to which the output terminal of the output buffer 101 is connected. The output buffer 101 receives the detection signal FE output from the comparator 45 of the status detection circuit 226. In this manner, the switch control circuit 211*a* includes the signal output terminal P3 dedicated to the output of the signal FA that indicates the ignition status. In this manner, by outputting the signal FA separately from the ignition conformation signal IGF, the ECU 7 can easily check the ignition status. Further, by outputting the signal FA before the ignition instruction signal IGT of N+2 cycle, the pulse width and the like of the ignition instruction signal IGT in the subsequent N+2 cycle can be adjusted.

Figure 22:
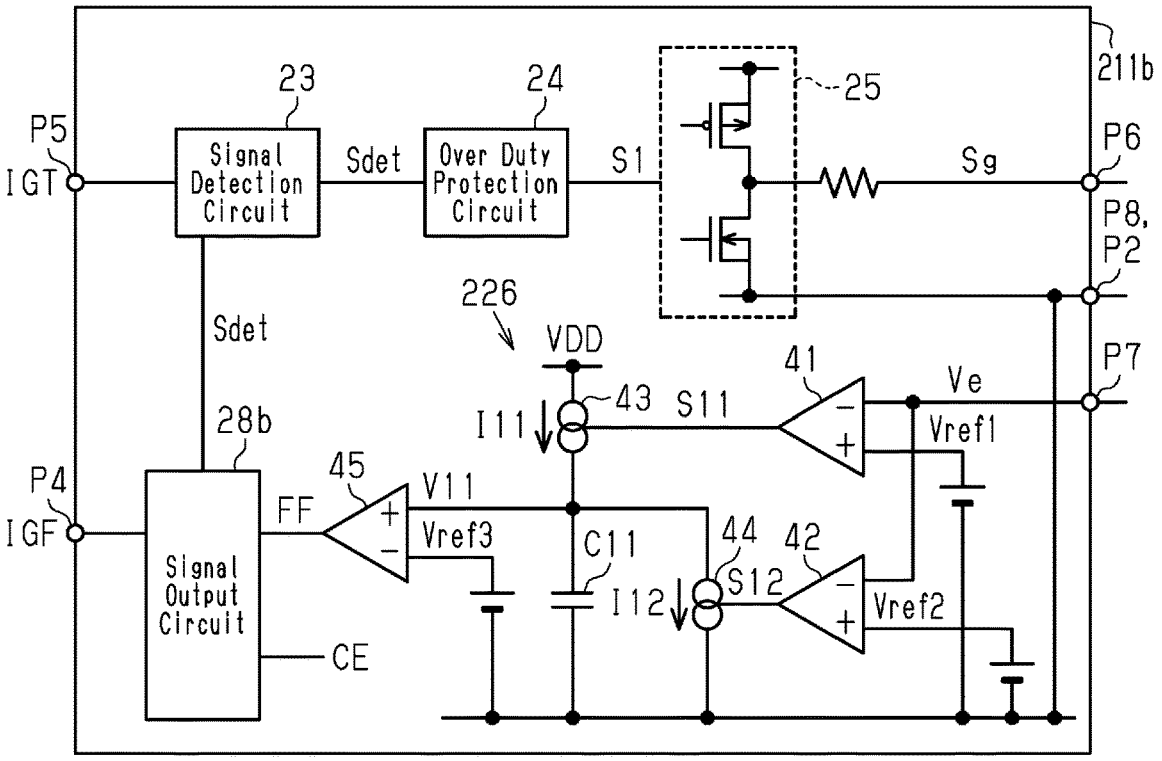
FIG. 22 is a schematic block circuit diagram showing a switch control circuit of a modified example.

As shown in FIG. 22, a switch control circuit 211*b* includes the signal output circuit 28*b*. The signal output circuit 28*b* is provided with the received signal Sdet, which is the ignition instruction signal IGT received from the signal detection circuit 23. Such a switch control circuit 211*b* eliminates the need for a separate terminal that outputs the signal FE in correspondence with the status, limits enlargement of the switch control circuit 211*b*, and allows the ECU 7 to easily check the ignition status. Further, by outputting the signal FE before the ignition instruction signal IGT of N+2 cycle as illustrated in FIG. 15, the signal output circuit 28*b* can adjust the pulse width and the like of the ignition instruction signal IGT in the subsequent N+2 cycle.

Addition

Figure 23:
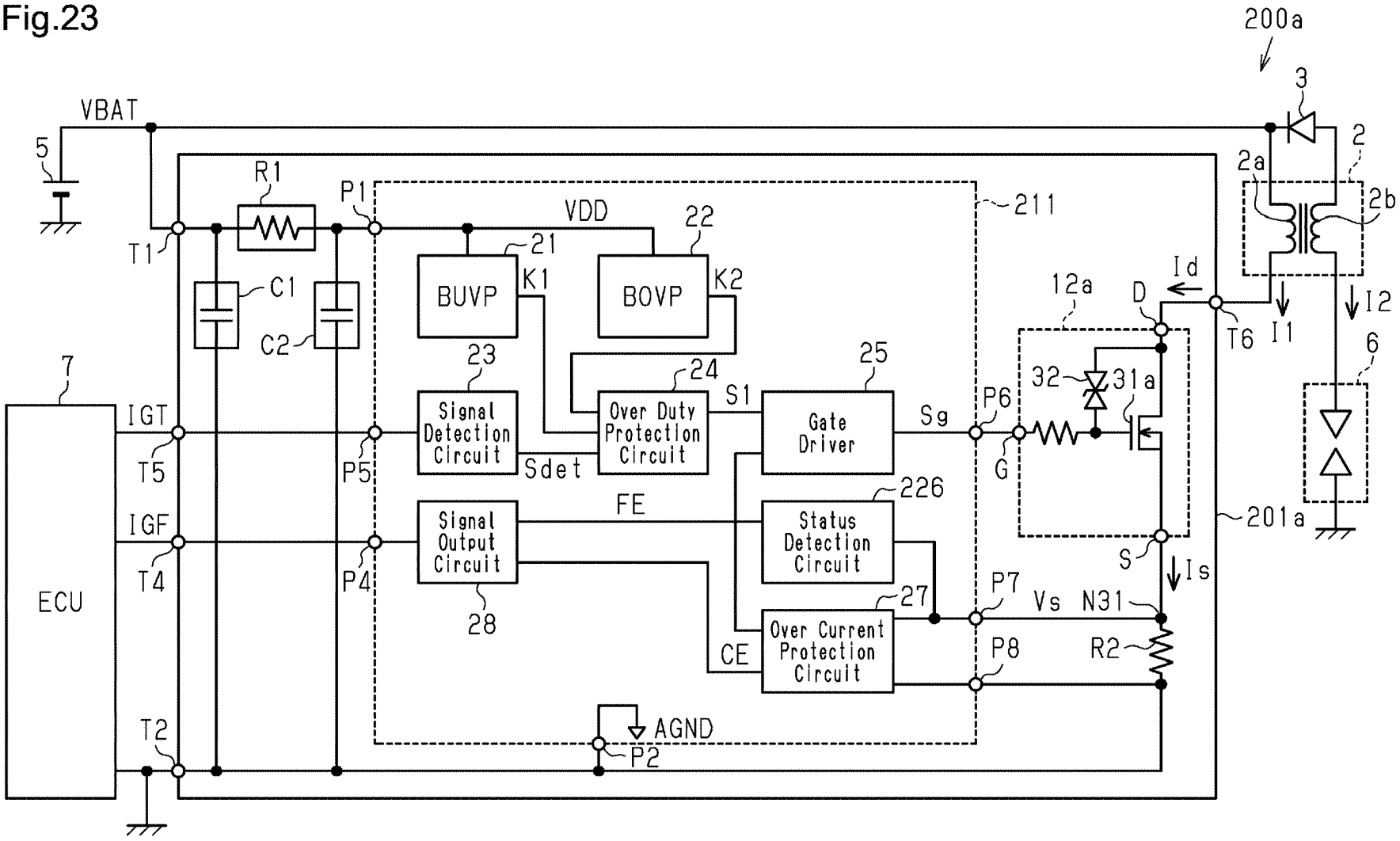
FIG. 23 is a schematic block circuit diagram showing an ignition device of a modified example.

As shown in FIG. 23, an ignition device 200*a* includes the ignition coil 2 and an igniter 201*a*.

The igniter 201*a* includes the switch element 12*a*, the switch control circuit 211, the resistor R1, the capacitors C1 and C2, and the resistor R2 and is modularized and accommodated in a single package.

The switch control circuit 211 includes the under voltage protection circuit 21, the over voltage protection circuit 22, the signal detection circuit 23, the over duty protection circuit 24, the gate driver 25, the status detection circuit 226, the overcurrent protection circuit 27, and the signal output circuit 28.

The switch element 12*a* is formed by a single semiconductor chip including a transistor 31*a*. The transistor 31*a* is, for example, a SiC MOSFET. The status detection circuit 226 of the switch control circuit 211 uses a voltage Vs corresponding to a drain current Id of the transistor 31*a* of the switch element 12*a* as a detection voltage and outputs the detection signal FE corresponding to a change in the detection voltage. For example, the status detection circuit 226 detects the ignition status of the spark plug 6 from a source current Is (drain current Id) flowing through the resistor R2 and outputs the detection signal FE. The signal output circuit 28 combines various types of signals including the detection signal CE of the overcurrent protection circuit 27 with the detection signal FE of the status detection circuit 226 to generate the ignition confirmation signal IGF and output the ignition confirmation signal IGF. The switch control circuit 211*a* of FIG. 21, the switch control circuit 211*b* of FIG. 22, or the like may be used as the switch control circuit 211.

In this manner, for example, in the igniter 201*a* with the switch element 12*a* including the transistor 31*a*, which is a SiC MOSFET, the ignition confirmation signal IGF allows a defective spark (misfire) of the spark plug 6 to be easily found in the same manner as the second embodiment.

Third Embodiment

A third embodiment will now be described.

In this embodiment, same reference numerals are given to those components that are the same as the corresponding components of the above embodiments. Such components will not be described in detail.

Figure 24:
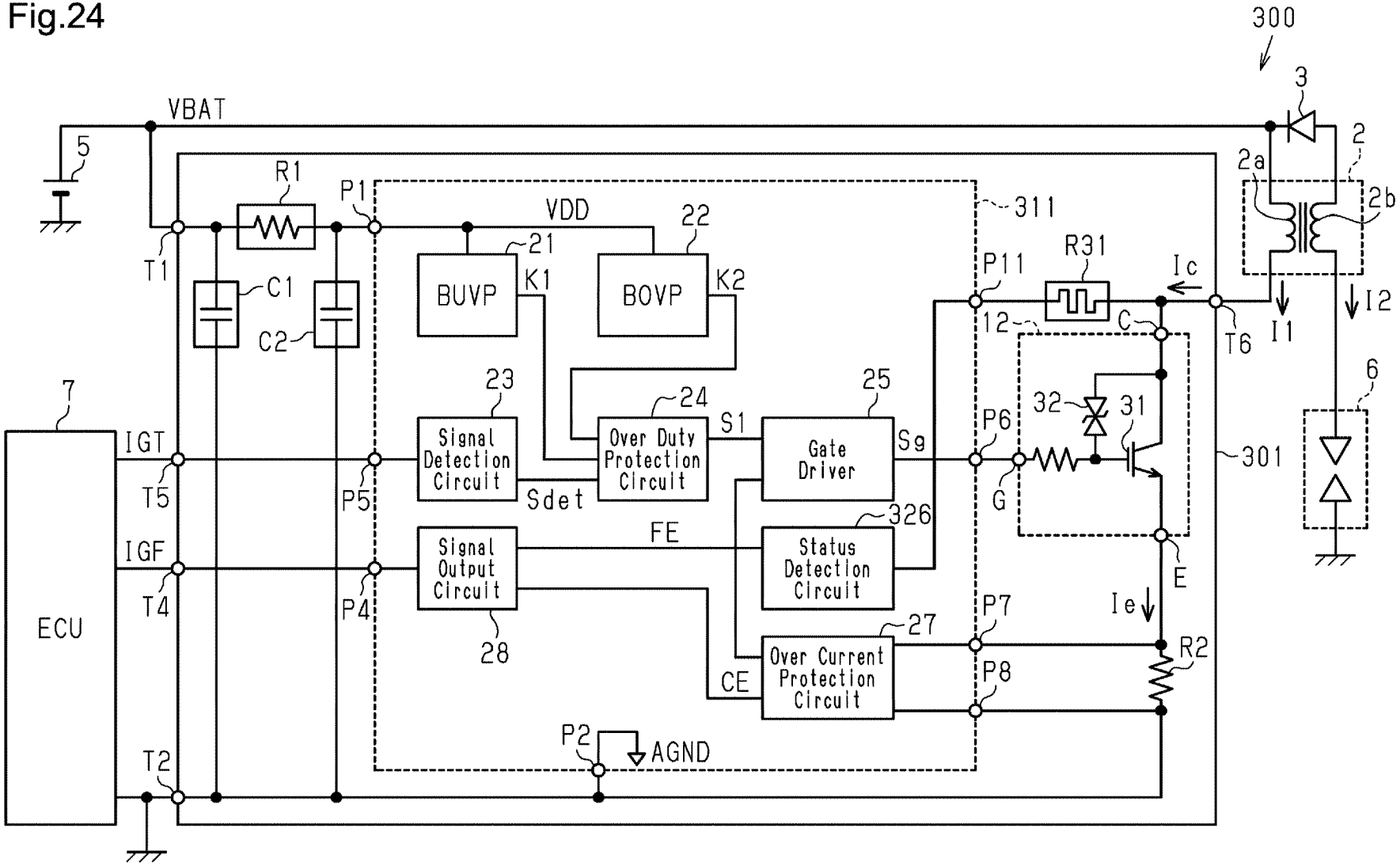
FIG. 24 is a schematic block circuit diagram showing an ignition device of a third embodiment.

As shown in FIG. 24, an ignition device 300 of the present embodiment includes the ignition coil 2 and an igniter 301.

The igniter 301 includes the switch element 12, a switch control circuit 311, the resistor R1, the capacitors C1 and C2, the resistor R2, a resistor R31 and is modularized and accommodated in a single package.

The switch control circuit 311 includes the high potential power terminal P1, the low potential power terminal P2, the output terminal P4, the input terminal P5, the output terminal P6, the input terminals P7 and P8, and an input terminal P11. The switch control circuit 311 receives the ignition instruction signal IGT via the input terminal P5. The switch control circuit 311 outputs the ignition confirmation signal IGF from the output terminal P4. The switch control circuit 311 detects the emitter current Ie of the switch element 12 from the potential difference between the two terminals of the resistor R2 connected to the input terminals P7 and P8.

The input terminal P11 of the switch control circuit 311 is connected to a first terminal of the resistor R31, and a second terminal of the resistor R31 is connected to the collector terminal C of the switch element 12.

The switch control circuit 311 includes the under voltage protection circuit 21, the over voltage protection circuit 22, the signal detection circuit 23, the over duty protection circuit 24, the gate driver 25, a status detection circuit 326, the overcurrent protection circuit 27, and the signal output circuit 28.

The status detection circuit 326 is connected via the input terminal P11 to the first terminal of the resistor R31. That is, the status detection circuit 326 is connected via the resistor R31 to the collector terminal C of the switch element 12.

The status detection circuit 326 uses the voltage corresponding to a collector voltage Vc of the transistor 31 of the switch element 12 as a detection voltage Vc2 and outputs the detection signal FE in correspondence with a change in the detection voltage Vc2. The status detection circuit 326 of the present embodiment is connected via the resistor R31 to the collector terminal C of the switch element 12. Accordingly, the status detection circuit 326 receives a voltage that is proportional to the collector voltage Vc as the detection voltage Vc2. The resistor R31 is, for example, a high-voltage resistor. A plurality of series-connected resistors for voltages lower than the resistor R31 may be used.

The threshold voltage Vth1 corresponding to the detection voltage Vc2 is set for the status detection circuit 326. The status detection circuit 326 compares the detection voltage Vc2 and the threshold voltage Vth1 to detect the status of the spark plug 6. Then, the status detection circuit 326 outputs the detection signal FE having a level corresponding to the detected status. In the present embodiment, the status detection circuit 326 monitors the time during which the detection voltage Vc2 is exceeding the threshold voltage Vth1 and detects the status of the spark plug 6 in accordance with the time. Then, the status detection circuit 326 outputs the detection signal FE having a level corresponding to the detected status.

The signal output circuit 28 combines various types of signals including the detection signal CE of the overcurrent protection circuit 27 with the detection signal FE of the status detection circuit 326 to generate the ignition confirmation signal IGF and output the ignition confirmation signal IGF. The ignition confirmation signal IGF is provided via the signal output terminal P4 of the switch control circuit 11 and the signal output terminal T4 of the igniter 4 to the ECU 7.

The switch element 12 includes the transistor 31 and a protection element 32 and is integrated on a single semiconductor substrate manufactured through a high-voltage process. The protection element 32 functions as a voltage clamp element that clamps the voltage (emitter-collector voltage) applied to the transistor 31 to protect the transistor 31.

Figure 25:
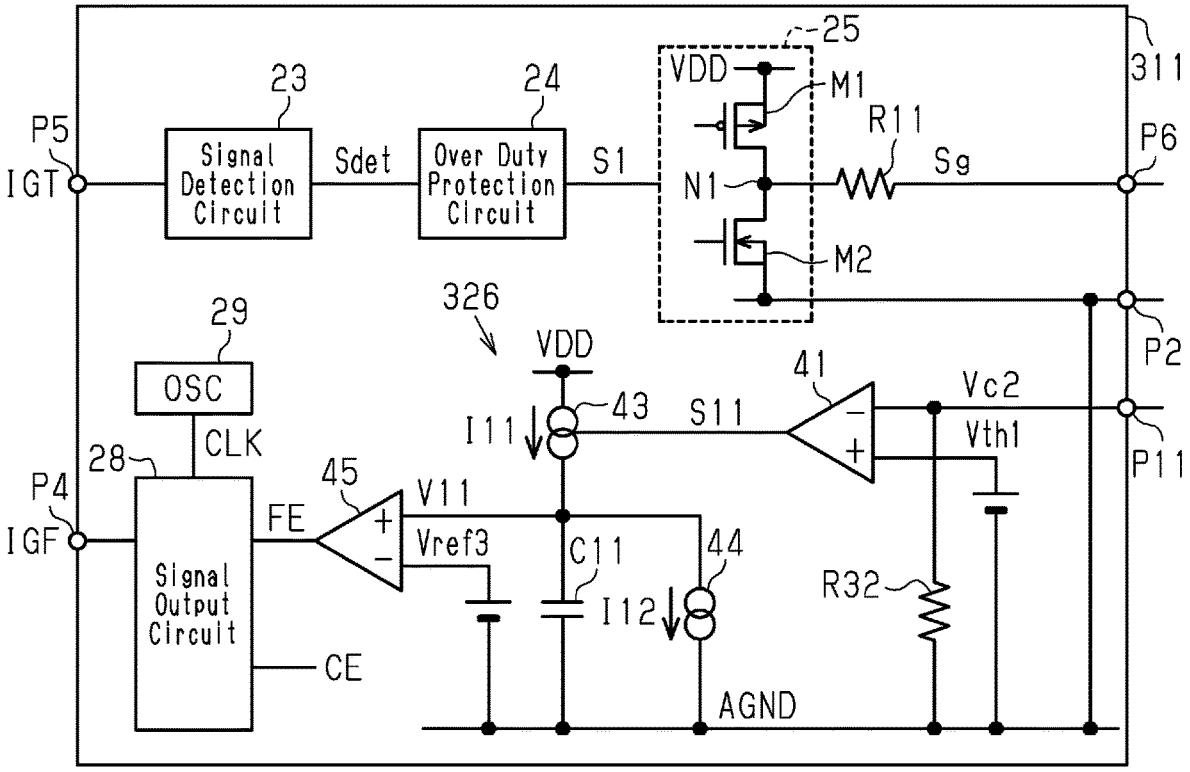
FIG. 25 is a schematic block circuit diagram showing a switch control circuit of the third embodiment.

As shown in FIG. 25, the status detection circuit 326 includes the comparator 41, the current sources 43 and 44, the capacitor C11, the comparator 45, and a resistor R32.

The inverting input terminal of the comparator 41 is connected via the input terminal P11 to the resistor R31 of FIG. 24. Further, the inverting input terminal of the comparator 41 is connected to a first terminal of the resistor R32, and a second terminal of the resistor R32 is connected to the ground line AGND. The resistor R32 and the resistor R31 of FIG. 24 form a voltage-dividing resistor that divides the collector voltage Vc. The resistor R31 corresponds to "the first resistor," and the resistor R32 corresponds to "the second resistor." That is, the inverting input terminal of the comparator 41 is supplied with a divisional voltage Vc2, which is obtained by dividing the collector voltage Vc by the resistance ratio of the resistor R31 of FIG. 24 and the resistor R32. The divisional voltage Vc2 is proportional to the collector voltage Vc and thus may be referred to as the collector voltage of the switch element 12. The resistances of the resistors R31 and R32 are set to generate the collector voltage Vc2 that can be input to the comparator 41. For example, the resistance of the resistor R31 to the resistance of the resistor R32 may be 100:1.

The non-inverting input terminal of the comparator 41 is supplied with a reference voltage Vth1. The reference voltage Vth1 is set in correspondence with a change in the collector voltage Vc2. The comparator 41 compares the collector voltage Vc2 and the reference voltage Vth1 and outputs the signal S11 having a level that is in accordance with the comparison result.

The first terminal of the current source 43 is connected to the power line VDD and supplied with the drive voltage VDD. A second terminal of the current source 43 is connected to a first terminal of the capacitor C11, and a second terminal of the capacitor C11 is connected to the ground line AGND. The current source 44 is connected in parallel to the capacitor C11.

The current source 43 is activated or inactivated in response to the output signal S11 of the comparator 41. The activated current source 43 produces a flow of a predetermined current I11. The current I11 charges the capacitor C11 and increases the voltage V11 at the first terminal of the capacitor C11. The current source 44 produces the flow of the predetermined current I12. The current I12 discharges the capacitor C11 and decreases the voltage V11 at the first terminal of the capacitor C11.

The first terminal of the capacitor C11 is connected to the non-inverting terminal of the comparator 45, and the inverting terminal of the comparator 45 is supplied with a reference voltage Vref3. The comparator 45 compares the voltage V11 at the first terminal of the capacitor C11 with the reference voltage Vref3 and outputs the detection signal FE in accordance with the comparison result. The signal output circuit 28 is actuated in accordance with the clock signal CLK to output the ignition confirmation signal IGF, which combines the detection signal FE, which is output from the comparator 45, and the detection signal CE, which is output from the overcurrent protection circuit 27 of FIG. 24.

Figure 26A:
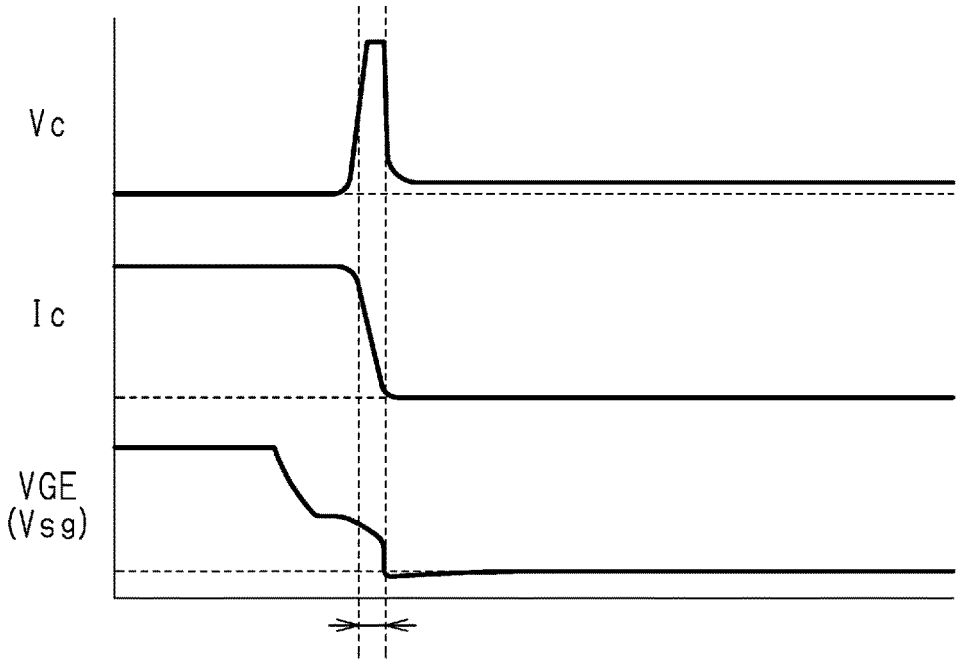
FIG. 26A is a waveform chart illustrating the voltage at each part of the igniter during a normal ignition.
Figure 26B:
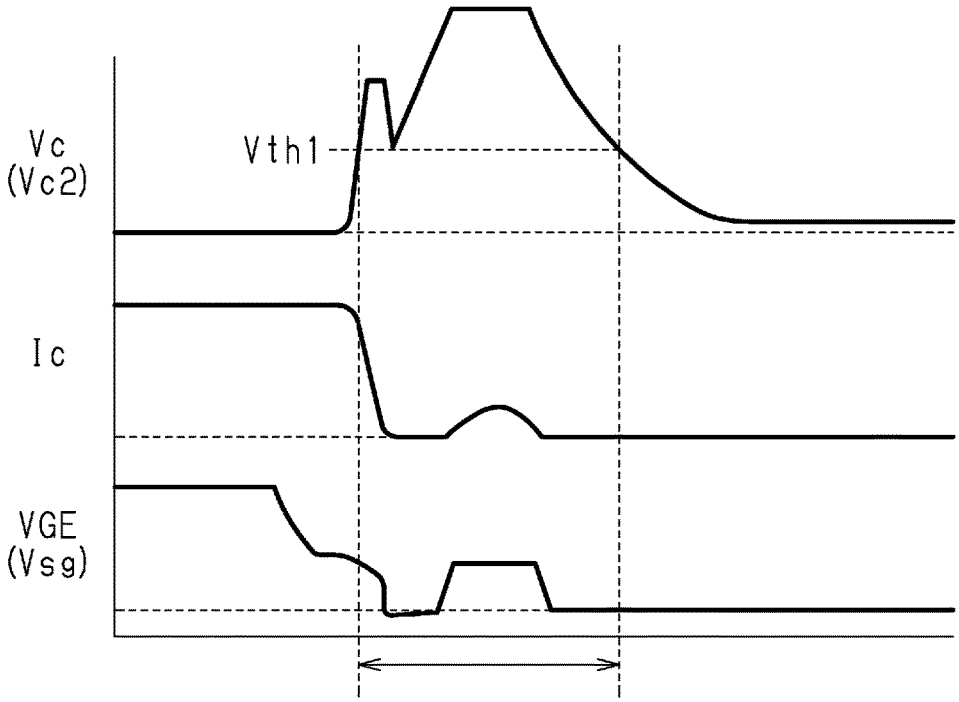
FIG. 26B is a waveform chart illustrating the voltage at each part of the igniter during a misfire.

FIGS. 26A and 26B show changes in the collector-emitter voltage (collector voltage Vc), the collector current Ic, and the gate-emitter voltage VGE (the gate voltage Vsg) of the switch element 12 (the transistor 31).

As shown in FIG. 26A, when the transistor 31, which is shown in FIG. 24, is turned off and the primary current of the ignition coil 2 is interrupted, the self-induction effect generates a large back electromotive force at the primary coil 2*a* of the ignition coil 2. This suddenly increases the collector-emitter voltage Vce. The mutual induction effect with the primary coil 2*a* generates a large electromotive force, which corresponds to the turns ratio, at the secondary coil 2*b*. The electromotive force of the secondary coil 2*b*, which is generated in this manner, applies an extremely high secondary voltage V2 to the spark plug 6 so that the spark plug 6 produces a spark. When a spark is produced in a normal manner, energy is lost. This readily decreases the collector current Ic of the transistor 31 and suddenly decreases the collector voltage Vc in accordance with the collector current Ic to a predetermined level. In this manner, when the spark plug 6 is ignited in a normal manner, the collector voltage Vc decreases to a predetermined level within a short period.

As shown in FIG. 26B, in a case where the spark plug 6 does not produce a spark, the collector voltage Vc (Vc2) is maintained as a high voltage. The gate-emitter voltage VGE (the gate voltage Vsg) slowly decreases. Further, the collector current Ic is decreased in accordance with the parasitic capacitance and inductance of the ignition coil 2.

In this manner, in accordance with the status of the spark plug 6, the collector voltage Vc (Vc2) is maintained at a high level. Further, the period during which the collector voltage Vc (Vc2) is maintained at a high level may be longer than the period during which the gate-emitter voltage VGE is maintained in a predetermined voltage range. Thus, status detection using the collector voltage Vc (Vc2) may be easier than when using the gate voltage Vsg.

The status detection circuit 326 of the present embodiment shown in FIGS. 24 and 25 detects the status from the collector voltage Vc (Vc2) to generate the detection signal FE. Then, the signal output circuit 28 combines the detection signal FE of the status detection circuit 326 with another signal to generate the ignition confirmation signal IGF. The ignition confirmation signal IGF, which is combined in this manner, is output from the signal output terminal P4. This allows the detection results of a plurality of detection circuits to be output from the same signal output terminal P4 and limits enlargement of the igniter 4.

As shown in FIG. 25, the status detection circuit 326 compares the collector voltage Vc2 and the reference voltage Vth1 with the comparator 41. The reference voltage Vth1 is set in correspondence with the period during which the collector voltage Vc (Vc2) is maintained at a high level (period shown by arrows), as shown in FIG. 26B. A reference voltage Vth is set in correspondence with the collector voltage Vc2, and the collector voltage Vc2 is a value corresponding to the collector voltage Vc and the resistance ratio of the resistor R31 of FIG. 24 and the resistor R32 of FIG. 25. For instance, the reference voltage Vth1 is set to measure the period in which, for example, the collector voltage Vc is 100 V (volts) to 300 V or greater, for example, 200 V or greater. The resistance ratio of the resistor R31 and the resistor R32 is, for example, 100:1. Thus, the reference voltage Vth1 is set in a range of 1 V to 3 V, for example, 2 V.

The current source 43, which is activated by the output signal S11 of the comparator 41, charges the capacitor C11. The current source 44 discharges the capacitor C11. Accordingly, the voltage V11 at the first terminal of the capacitor C11 corresponds to changes in the collector voltage Vc (Vc2) shown in FIGS. 26A and 26B.

Figure 27:
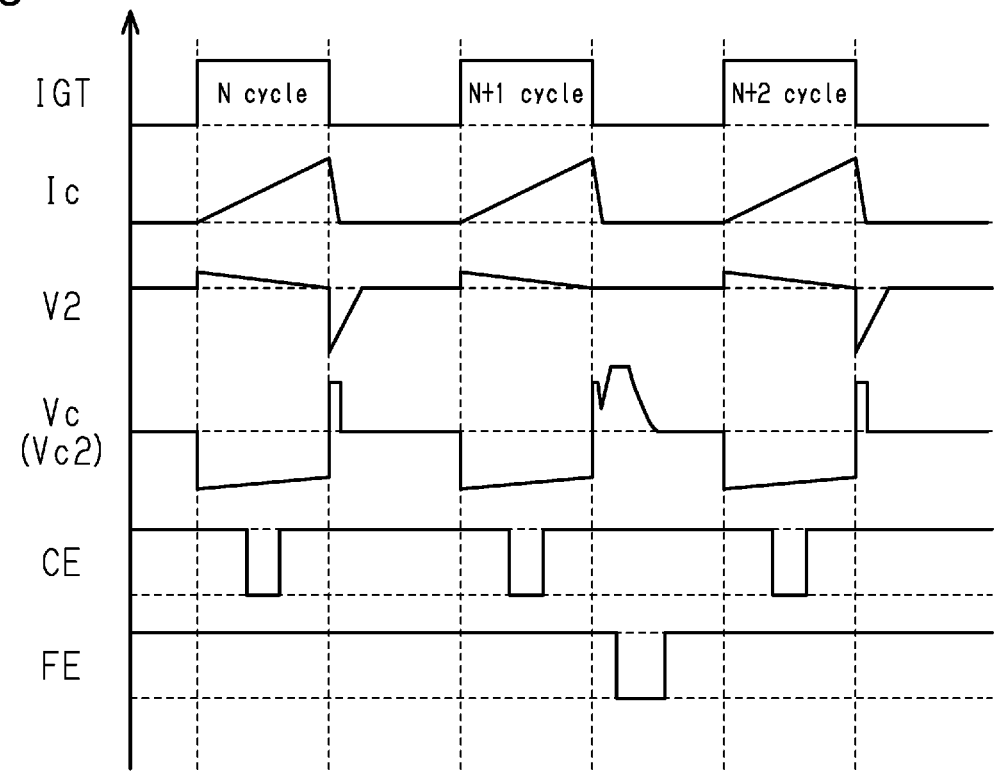
FIG. 27 is a waveform chart illustrating the operation of the switch control circuit.

FIG. 27 is a waveform chart illustrating an example of the operation of the igniter 301.

The ECU 7 shown in FIG. 24 outputs the pulse-shaped ignition instruction signal IGT in predetermined ignition cycles. FIG. 27 shows N cycle, N+1 cycle, and N+2 cycle. A case in which normal ignition occurs in N cycle and ignition does not occur in N+1 cycle will now be described.

In each cycle, during a period in which the ignition instruction signal IGT has a high level, the igniter 301 turns on the transistor 31 of the switch element 12. When the transistor 31 is turned on, the battery voltage VBAT is applied between the two terminals of the primary coil 2*a*, and the current flowing via the primary coil 2*a* and the transistor 31, namely, the collector current Ic of the transistor 31 increases over time. The overcurrent protection circuit 27 shown in FIG. 24 generates the pulse-shaped detection signal CE based on the collector current Ic that is increased by the ignition instruction signal IGT.

When the ignition instruction signal IGT shifts to a low level, the igniter 301 turns off the transistor 31 and interrupts the collector current Ic, namely, the primary current of the primary coil 2*a*. In this case, the primary voltage V1, which is proportional to the time derivative of the current Ic, is generated at the primary coil 2*a*. Further, the secondary voltage V2, which is proportional to the primary voltage V1, is generated at the secondary coil 2*b*. When a spark is generated in a normal manner, the collector voltage Vc decreases within a short period. Thus, the status detection circuit 326 shown in FIGS. 24 and 25 output the detection signal FE at a high level.

Next, in N+1 cycle, the igniter 301 turns on the transistor 31 of the switch element 12 during a period in which the ignition instruction signal IGT has a high level. Then, when the ignition instruction signal IGT shifts to a low level, the igniter 301 turns off the transistor 31 and interrupts the collector current Ic, namely, the primary current of the primary coil 2*a*.

When a spark is not produced in a normal manner, the collector voltage Vc (Vc2) decreases over a long period. The status detection circuit 326 shown in FIGS. 24 and 25 generate the detection signal FE at a low level based on the collector voltage Vc (Vc2). The ignition confirmation signal IGF, which combines the detection signal FE, allows a defective spark (misfire) to be easily found.

Igniter Package

Figure 28:
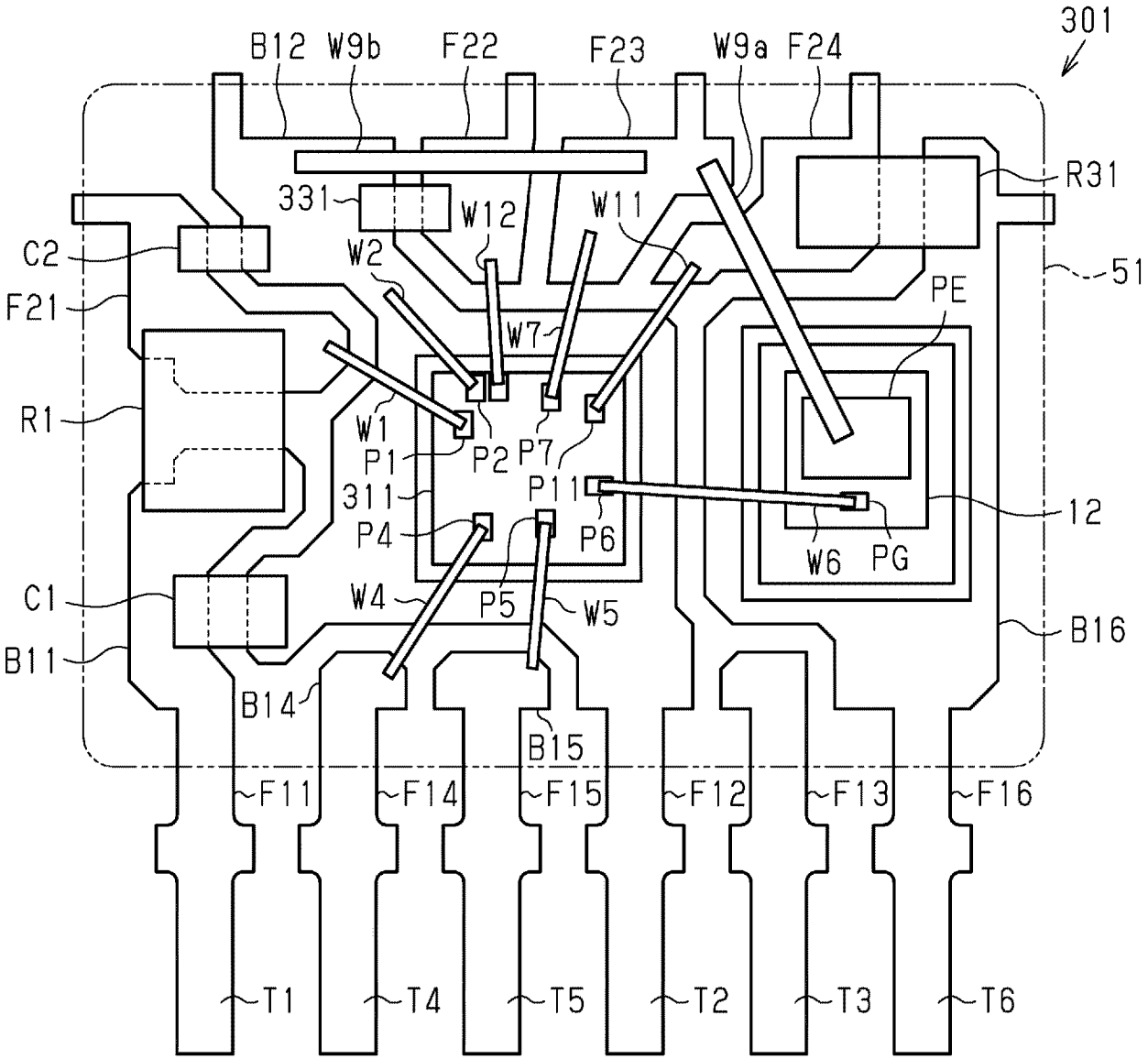
FIG. 28 is a schematic plan view showing one example of the inner configuration of the igniter.

FIG. 28 is a plan view showing one example of the inner configuration of the igniter 301.

The outer appearance of the igniter 301 is the same as the igniter 4 of the first embodiment and therefore not illustrated.

The igniter 301 includes lead frames F11 to F16 and F21 to F24 and the encapsulation resin 51 that encapsulates parts of the lead frames F11 to F16 and F21 to F24 and components of the igniter 301. FIG. 28 shows the encapsulation resin 51 with double-dashed lines. The encapsulation resin 51 is substantially box-shaped and has one side surface from which the lead frames F11 to F16 project as mounting connection terminals (lead portions) T1 to T6. The package is a six-pin Single Inline Package (SIP).

The lead frames F11 to F16 and F21 to F24 may be formed from a conductive metal, for example, copper (Cu), a Cu alloy, nickel (Ni), a Ni alloy, 42 alloy, or the like. A Pd plating, an Ag plating, a Ni/Pd/Ag plating, or the like may be applied to the surface of each of the lead frames F11 to F16 and F21 to F24.

The encapsulation resin 51 may be an insulative resin, for example, epoxy resin. Further, the encapsulation resin 51 has a predetermined color (e.g., black).

The lead frames F11 to F16 include mount portions B11 to B16 and the lead portions T1 to T6 extending from the mount portions B11 to B16. The lead portions T1 to T6 correspond to the terminals of the igniter 301.

The resistor R1 is connected between the mount portion B11 of the lead frame F11 and the lead frame F21. The capacitor C1 is connected between the mount portion B11 of the lead frame F11 and the mount portion B12 of the lead frame F12. The capacitor C1 is mounted closer to the lead portion T1 of the lead frame F11 than the resistor R1. The capacitor C2 is connected between the mount portion B12 of the lead frame F12 and the lead frame F21. The capacitor C2 and the capacitor C1 are mounted on opposite sides of the resistor R1. The resistor R1 and the capacitors C1 and C2 are connected to the lead frames by, for example, an Ag paste, solder, or the like.

A switch control device 311 is mounted on the mount portion B12 of the lead frame F12. The switch control device 311 is an IC chip (semiconductor device) that integrates the elements of the switch control circuit 311 shown in FIGS. 24 and 25 on a single semiconductor substrate. The switch control device 311 is connected to the lead frame F12 by, for example, an Ag paste, solder, or the like.

The switch element 12 is mounted on the mount portion B16 of the lead frame F16. The switch element 12 is connected to the lead frame F16 by, for example, an Ag paste, solder, or the like. The lower surface of the switch element 12 includes the collector electrode PC, and the collector electrode PC is connected to the lead frame F16.

The resistor R31 is connected between the mount portion B16 of the lead frame F16 and the lead frame F24. the resistor R31 is connected to the lead frames by, for example, an Ag paste, solder, or the like. The lead frame F24 is connected by wire W11 to a pad P11 of the switch control device 311.

A chip component 331 is connected between the mount portion B12 of the lead frame F12 and the lead frame F22. The chip component 331 is connected to the lead frames by, for example, an Ag paste, solder, or the like. The lead frame F22 is connected by wire W12 to the switch control device 311. The chip component 331 is an external circuit component of the switch control device 311 and may be, for example, a capacitor, a resistor, or the like. The chip component 331 and wire W12 may be omitted in accordance with the configuration and function of the switch control device 311.

The gate pad PG and the emitter pad PE are exposed from the upper surface of the switch element 12.

Pads P1, P2, P4, P5, P6, P7, and P8 are exposed from the upper surface of the switch control device 311. Pad P1 is connected by wire W1 to lead frame F21. Pad P2 is connected by wire W2 to the mount portion B12 of the lead frame F12. Pad P4 is connected by wire W4 to the mount portion B14 of the lead frame F14. Pad P5 is connected by wire W5 to the mount portion B15 of the lead frame F15. Pad P6 is connected by wire W6 to the gate pad PG of the switch element 12. Pad P7 is connected by wire W7 to lead frame F23. The emitter pad PE of the switch element 12 is connected by wire W9*a* to the lead frame F23. The lead frame F23 is connected by wire W9*b* to the mount portion B2 of the lead frame F2 of the lead frame F12.

Wires W1, W2, W4, W5, W6, W7, and W8 are, for example, aluminum wires each having a diameter of, for example, 125 μm.

Wires W9*a* and W9*b* are, for example, aluminum wires each having a diameter of, for example, 250 μm. Wire W9*b* has a resistance of several mΩ to several tens of mΩ for example, 5 mΩ. The resistance component of wire W9*b* functions as the resistor R2 shown in FIG. 1.

Structure of High-Voltage Resistor

Figure 29:
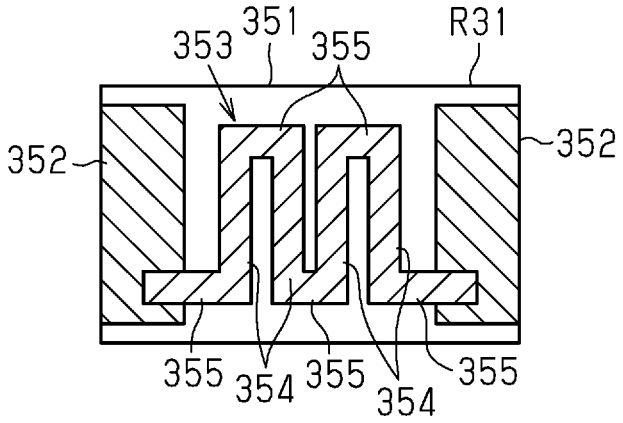
FIG. 29 is an explanatory diagram of a resistor element.

As shown in FIG. 29, the resistor R31 includes a substrate 351, two external electrodes 352, and a resistor body 353 between the two external electrodes 352. The substrate 351 has the form of a box-shaped plate. The substrate 351 is, for example, an alumina substrate. The external electrodes 352 are arranged on the two ends of the substrate 351. The external electrodes 352 are formed from, for example, a silver thick-film material, nickel plating, or the like. The resistor body 353 is arranged on the upper surface of the substrate 351 between the external electrodes 352. The resistor body 353 is formed on the substrate 351 by sintering, for example, a paste of a powder mixture of a metal material and glass and an organic binder. The resistor body 353 includes a plurality of wiring portions 354, extending parallel to the external electrodes 352, and wiring portions 355, connected in series to the external electrodes 352. The resistor R31, which includes the resistor body 353 shaped in such a manner, has high-voltage characteristics.

Figure 30:
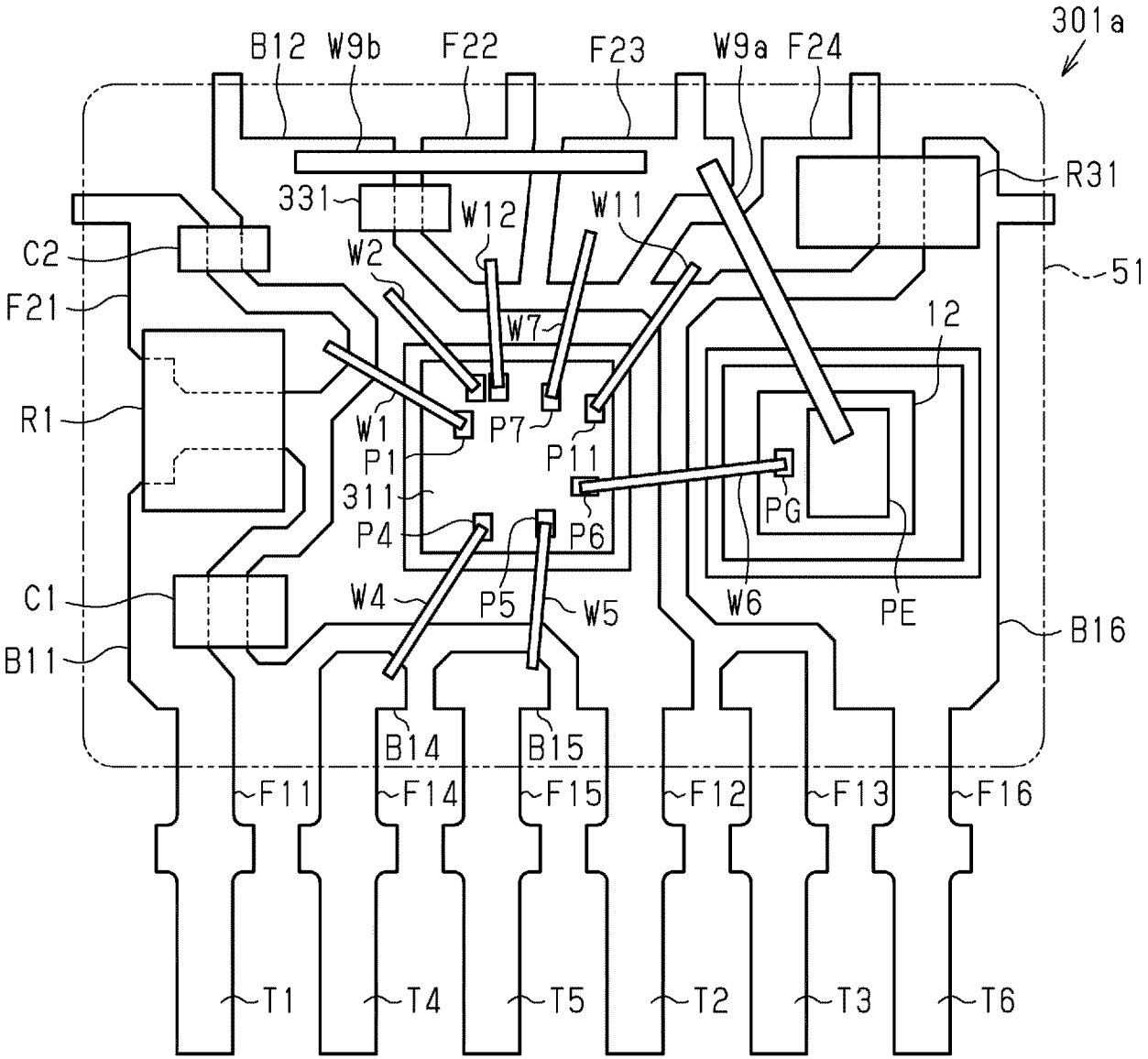
FIG. 30 is a schematic plan view showing one example of the inner configuration of the igniter.

FIG. 30 shows an igniter 301*a* of a modified example. The igniter 301*a* differs from the igniter 301 shown in FIG. 28 in the mounting direction of the switch element 12.

The switch element 12 is mounted on the mount portion B16 of the lead frame F16 and arranged with the gate pad PG directed toward the switch control device 311. Such mounting allows wire W6, which connects pad P6 of the switch control device 311 and the gate pad PG of the switch element 12, to be shortened.

As described above, the present embodiment has the advantages described below.

(3-1) The status detection circuit 326 detects the status from the collector voltage Vc (Vc2) and outputs the detection signal FE. Then, the signal output circuit 28 combines the detection signal FE of the status detection circuit 26 with another signal to generate the ignition confirmation signal IGF. The ignition confirmation signal IGF, which is combined in this manner, allows a defective spark (misfire) of the spark plug 6 to be easily found.

(3-2) The resistor R31, which is connected between the collector terminal C of the switch element 12 and the input terminal P11 of the switch control circuit 311, and the resistor R32, which is included in the switch control circuit 311, serve as voltage-dividing resistors to generate the collector voltage Vc2 that is proportional to the collector voltage Vc. The resistor R31 is a high-voltage resistor. Accordingly, the collector voltage Vc2, which can be input to the switch control circuit 311, is easily generated in proportion with the collector voltage Vc. Thus, the collector voltage Vc allows the status of the spark plug 6 to be easily checked.

Modified Examples of Third Embodiment

Modified examples of the third embodiment will now be described. In the description hereafter, same reference numerals are given to those components that are the same as the corresponding components of the first to third embodiments. Such components will not be described in detail.

Figure 31:
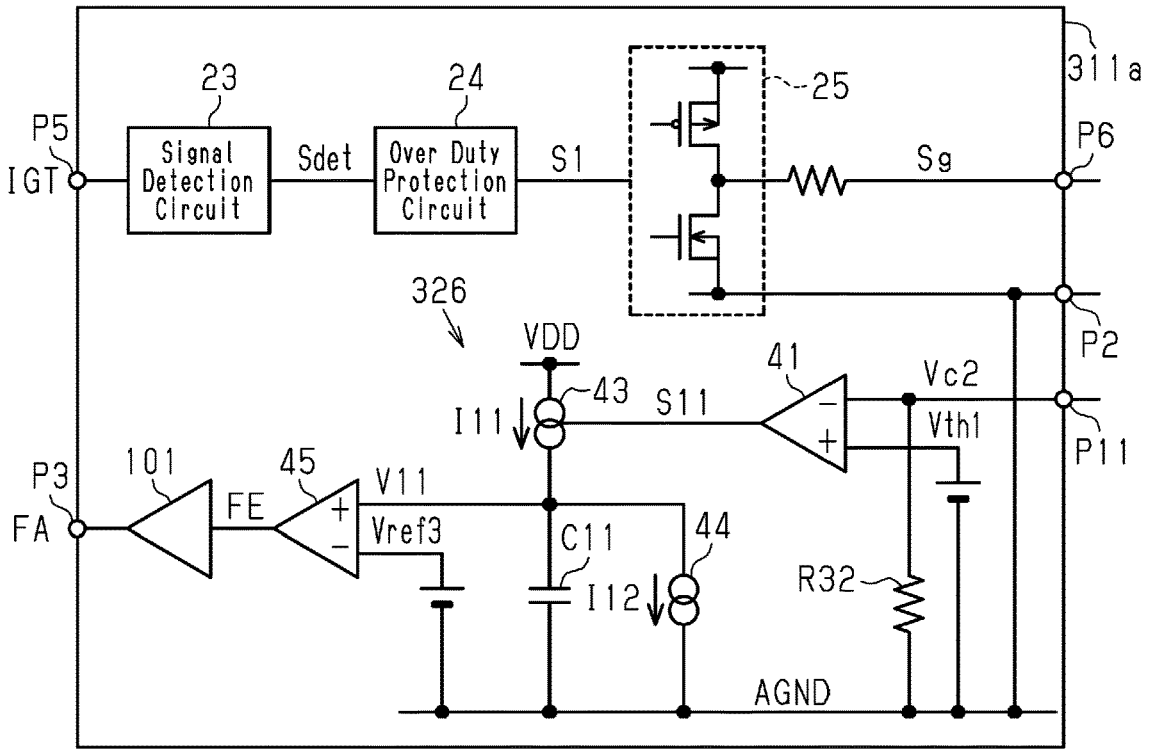
FIG. 31 is a schematic block circuit diagram showing a switch control circuit of a modified example.

As shown in FIG. 31, a switch control circuit 311*a* includes the output buffer 101, which receives the detection signal FE of the status detection circuit 326, and the signal output terminal P3, which is connected to the output terminal of the output buffer 101. In the switch control circuit 311*a*, the signal output terminal P3 is dedicated to the output of the signal FA that indicates the ignition status. The signal FA is one example of a single ignition detection signal that does not include another detection signal.

Figure 32:
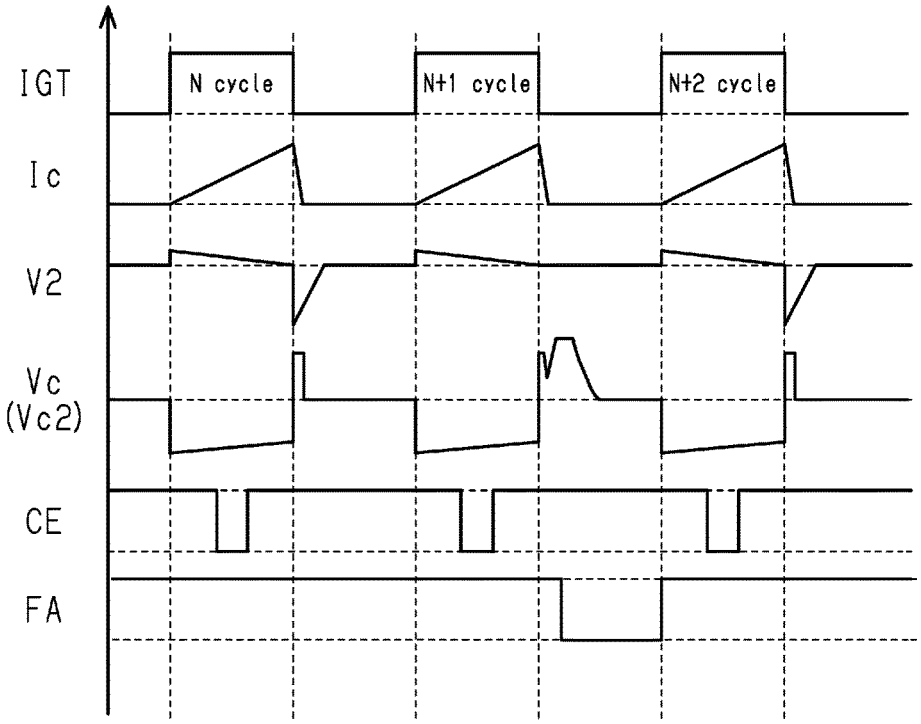
FIG. 32 is a waveform chart illustrating the operation of the switch control circuit of the modified example.

As shown in FIG. 32, the switch control circuit 311*a* outputs the signal FA in accordance with the ignition status until the ignition instruction signal IGT of the subsequent N+2 cycle in correspondence with the collector voltage Vc. In this manner, by outputting the signal FA separately from the detection signal CE, the ECU 7 can easily check the ignition status. Further, by outputting the signal FA before the ignition instruction signal IGT of N+2 cycle, the pulse width and the like of the ignition instruction signal IGT in the subsequent N+2 cycle can be adjusted.

Figure 33:
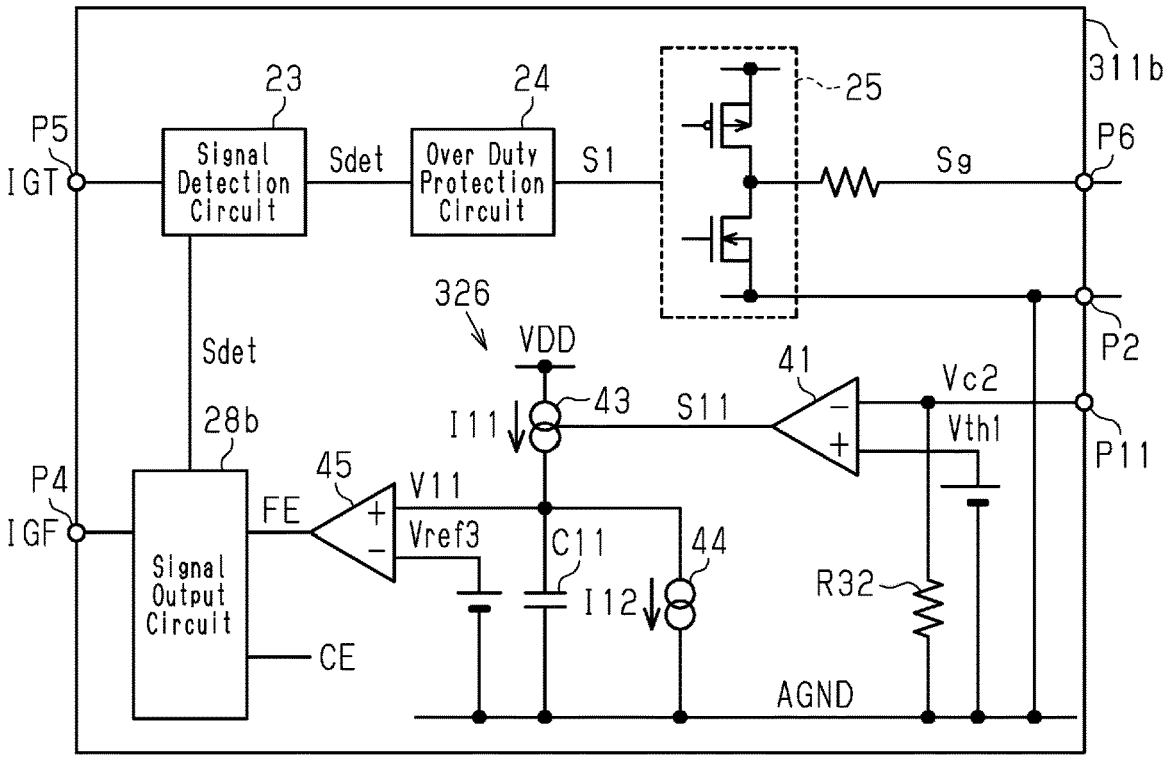
FIG. 33 is a schematic block circuit diagram showing a switch control circuit of a modified example.

As shown in FIG. 33, the switch control circuit 311*b* includes the signal output circuit 28*b* that receives the detection signal FE of the status detection circuit 326. The signal output circuit 28*b* is provided with the received signal Sdet, which is the ignition instruction signal IGT received from the signal detection circuit 23.

Figure 34:
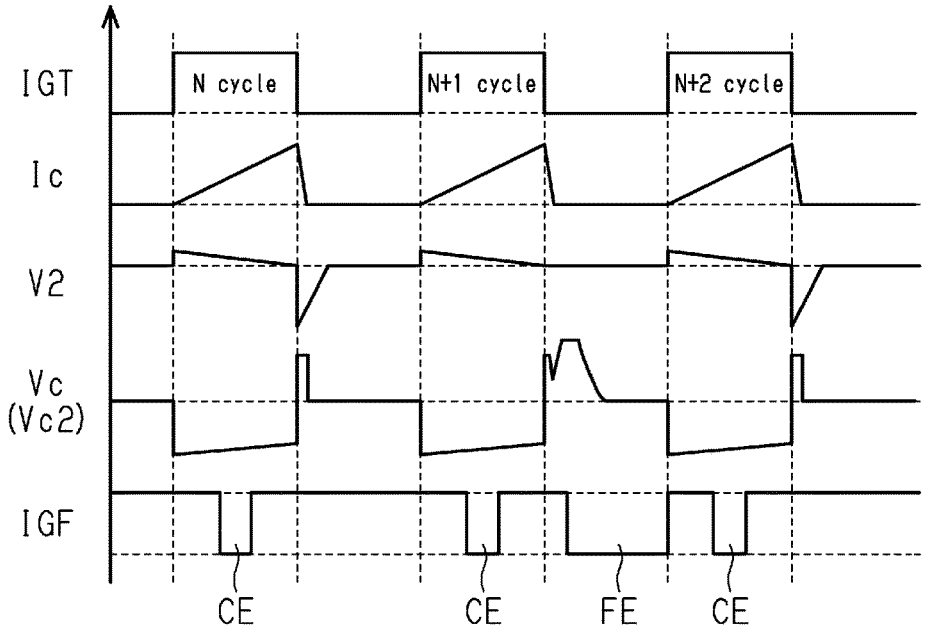
FIG. 34 is a waveform chart illustrating the operation of the switch control circuit of the modified example.

As shown in FIG. 34, the signal output circuit 28*b* generates the ignition confirmation signal IGF in accordance with the detection signal of the overcurrent protection circuit 27 or the like during a period in which the ignition instruction signal IGT has a high level and generates the ignition confirmation signal IGF in accordance with the collector voltage Vc during a period in which the ignition instruction signal IGT has a low level. Such a switch control circuit 311*b* eliminates the need for a separate terminal that outputs the detection signal FE in correspondence with the status, limits enlargement of the switch control circuit 311*b*, and allows the ECU 7 to easily check the ignition status. Further, by outputting the detection signal FE before the ignition instruction signal IGT of N+2 cycle, the pulse width and the like of the ignition instruction signal IGT in the subsequent N+2 cycle can be adjusted.

Figure 35:
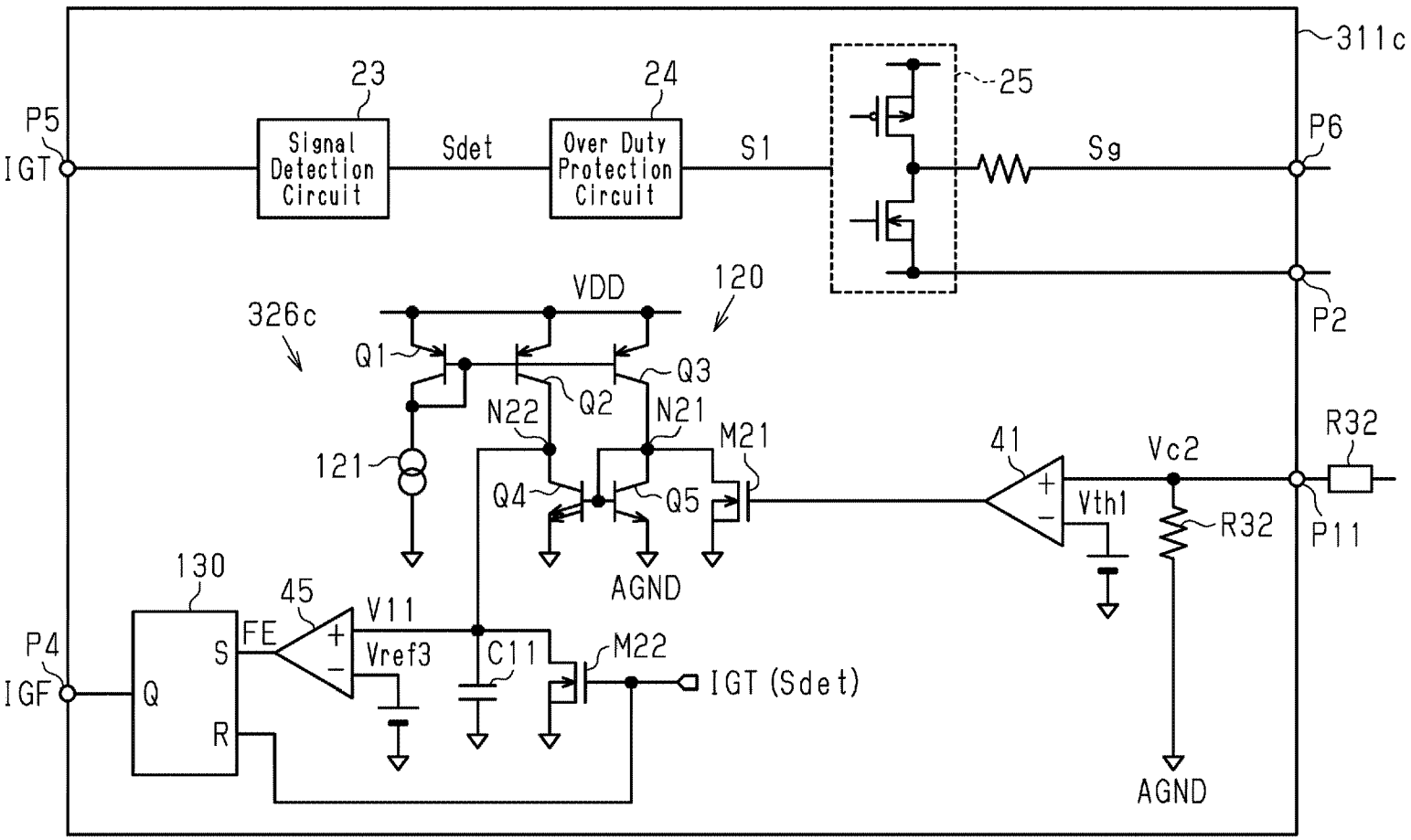
FIG. 35 is a schematic block circuit diagram showing a switch control circuit of a modified example.

As shown in FIG. 35, a switch control circuit 311*c* includes a status detection circuit 326*c*. The status detection circuit 326*c* includes the comparators 41 and 42, the voltage-dividing resistors R21 and R22, the inverter circuits 111 and 113, the NAND circuit 112, the charge-discharge circuit 120, the capacitor C11, the transistor M21 and M22, and the comparator 45. The transistors M21 and M22 are, for example, NMOSFETs.

The resistor R32 is connected via the input terminal P11 to the non-inverting terminal of the comparator 41 and one end of the resistor R32. The other end of the resistor R32 is connected to the ground line AGND. The inverting input terminal of the comparator 41 is supplied with the reference voltage Vth1. The output terminal of the comparator 41 is connected to the gate terminal of the transistor M21. The source terminal of the transistor M21 is connected to the ground line AGND, and the drain terminal of the transistor M21 is connected to the input node N21 of the charge-discharge circuit 120.

The charge-discharge circuit 120 includes a current source 121 and transistors Q1 to Q5. The transistors Q1 to Q3 are, for example, PNP transistors, and the transistors Q4 and Q5 are, for example, NPN transistors. The emitters of the transistors Q1 to Q3 are connected to the power line VDD. The collector of the transistor Q1 is connected to the first terminal of the current source 121, and the second terminal of the current source 121 is connected to the ground line AGND. The bases of the transistors Q2 and Q3 are connected to the base and collector of the transistor Q1. The transistors Q1, Q2, and Q3 form a current-mirror circuit. The transistors Q2 and Q3 are configured so that the amount of flowing current is the same as the transistor Q1.

The collectors of the transistors Q2 and Q3 are connected to the collectors of the transistors Q4 and Q5, and the emitters of the transistors Q4 and Q5 are connected to the ground line AGND. Further, the collector of the transistor Q5 (input node N21) is connected to the bases of the two transistors Q4 and Q5. The output node N22 between the transistor Q2 and the transistor Q4 is connected to the capacitor C11. The transistor Q4 includes, for example, a plurality of parallel-connected transistors and is configured to produce a flow of current that is an integer multiple of the flow of current produced by the transistor Q5.

The transistor M22 is connected in parallel to the capacitor C11, and the gate of the transistor M22 is provided with the received signal Sdet. The gate of the transistor M21 may be provided with various types of internal detection signals of the switch control circuit 311*c* or a signal combining various types of signals.

The output terminal of the comparator 45 is connected to the set terminal S of a flip-flop circuit 130, and the reset terminal R of the flip-flop circuit 130 is provided with the signal provided to the gate of the transistor M22, namely, the received signal Sdet. The flip-flop circuit 130 outputs the ignition confirmation signal IGF from the output terminal Q.

In the status detection circuit 326*c*, the charge-discharge circuit 120 charges the capacitor C11 while the transistor M21 is on and discharges the capacitor C11 while the transistor M21 is off. The detection signal FE of the comparator 45, which detects the voltage V11 of the capacitor C11, sets the flip-flop circuit 130 and outputs the ignition confirmation signal IGF, which is in accordance with the ignition status, from the output terminal Q of the flip-flop circuit 130. Further, the received signal Sdet provided to the gate of the transistor M22 turns on the transistor M22 to shift the voltage V11 of the capacitor C11 to a low level and reset the flip-flop circuit 130.

Figure 36:
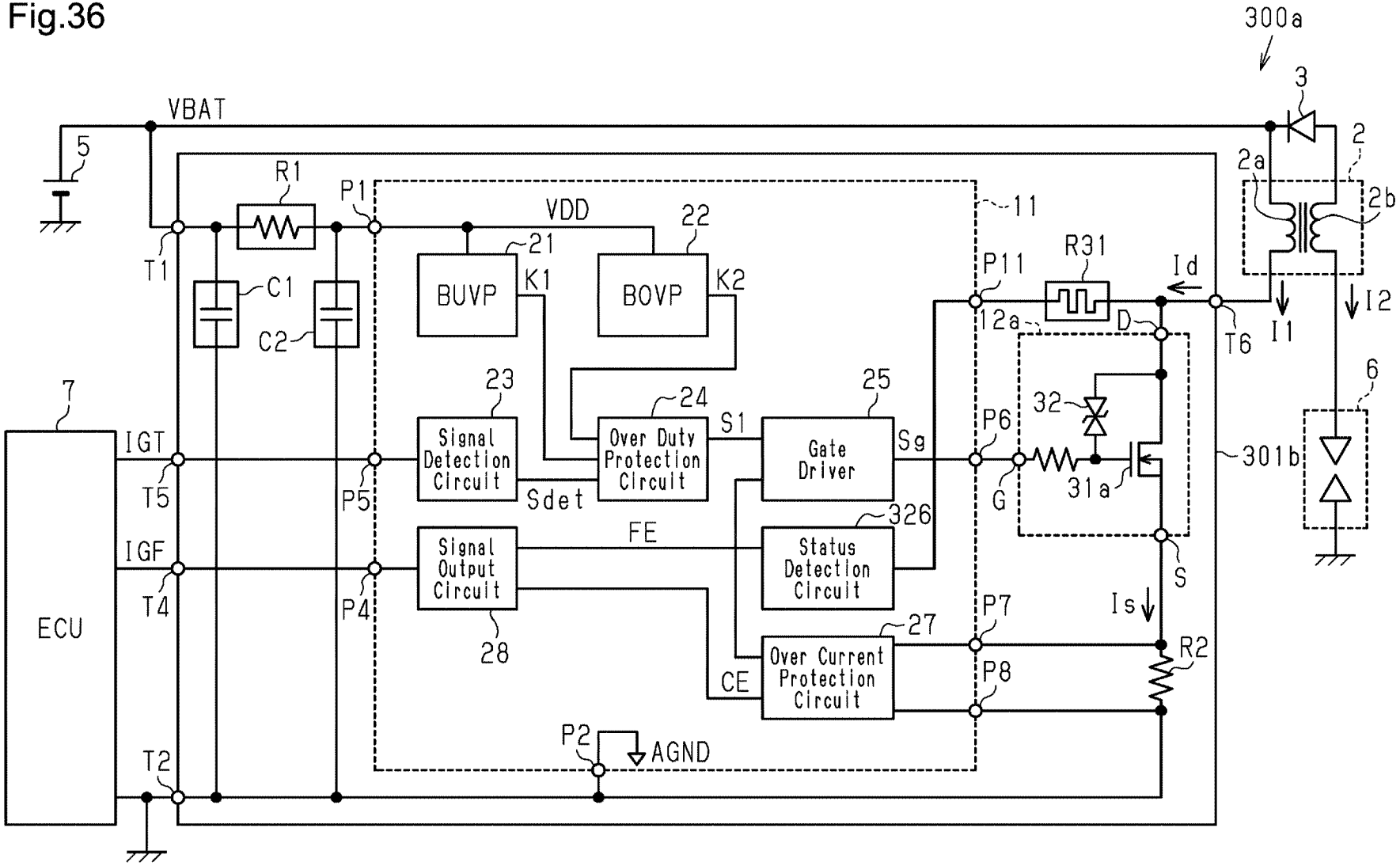
FIG. 36 is a schematic block circuit diagram showing an ignition device of a modified example.

As shown in FIG. 36, an ignition device 300*a* includes an ignition coil 2 and an igniter 301*b*.

The igniter 301*b* includes the switch element 12*a*, the switch control circuit 311, the resistor R1, the capacitors C1 and C2, and the resistor R2 and R31 and is modularized and accommodated in a single package. The switch control circuit 311 includes the under voltage protection circuit 21, the over voltage protection circuit 22, the signal detection circuit 23, the over duty protection circuit 24, the gate driver 25, a status detection circuit 326, the overcurrent protection circuit 27, and the signal output circuit 28.

The switch element 12*a* is formed by a single semiconductor chip including a transistor 31*a*. The transistor 31*a* is, for example, a SiC MOSFET. The protection element 32 is connected between the gate and drain of the transistor 31*a*. Terminals (S, G, and D) of the transistor 31*a* may be described as the terminals of the semiconductor chip, or the switch element 12*a*. The gate terminal of the transistor 31*a* is connected via a resistor to the output terminal P6 of the switch control circuit 311. The gate signal Sg, which is output from the gate driver 25, is provided via the output terminal P6 to the gate terminal G of the switch element 12*a*. The source terminal of the transistor 31*a* is connected to the resistor R2, and the drain terminal of the transistor 31*a* is connected via the output terminal T6 to the primary coil 2*a* of the ignition coil 2.

The igniter 301*b* on-off controls the switch element 12*a* based on the ignition instruction signal IGT provided from the ECU 7. By turning the switch element 12*a* on and off, the secondary voltage V2 generated at the secondary coil 2*b* of the ignition coil 2 produces a spark with the spark plug 6. The status detection circuit 326 of the switch control circuit 311 uses the collector voltage Vc of the switch element 12*a* (transistor 31*a*) as a detection voltage and outputs the detection signal FE corresponding to the detection voltage. The signal output circuit 28 combines various types of signals including the detection signal CE of the overcurrent protection circuit 27 with the detection signal FE of the status detection circuit 326 to generate the ignition confirmation signal IGF and output the ignition confirmation signal IGF. The switch control circuits 311*a*, 311*b*, 311*c*, and the like described above may be used as the switch control circuit 311.

In this manner, for example, in the igniter 301*b* with the switch element 12*a* including the transistor 31*a*, which is a SiC MOSFET, the ignition confirmation signal IGF allows a defective spark (misfire) of the spark plug 6 to be easily found in the same manner as the first embodiment.

Fourth Embodiment

A fourth embodiment will now be described.

In this embodiment, same reference numerals are given to those components that are the same as the corresponding components of the above embodiments. Such components will not be described in detail.

Figure 37:
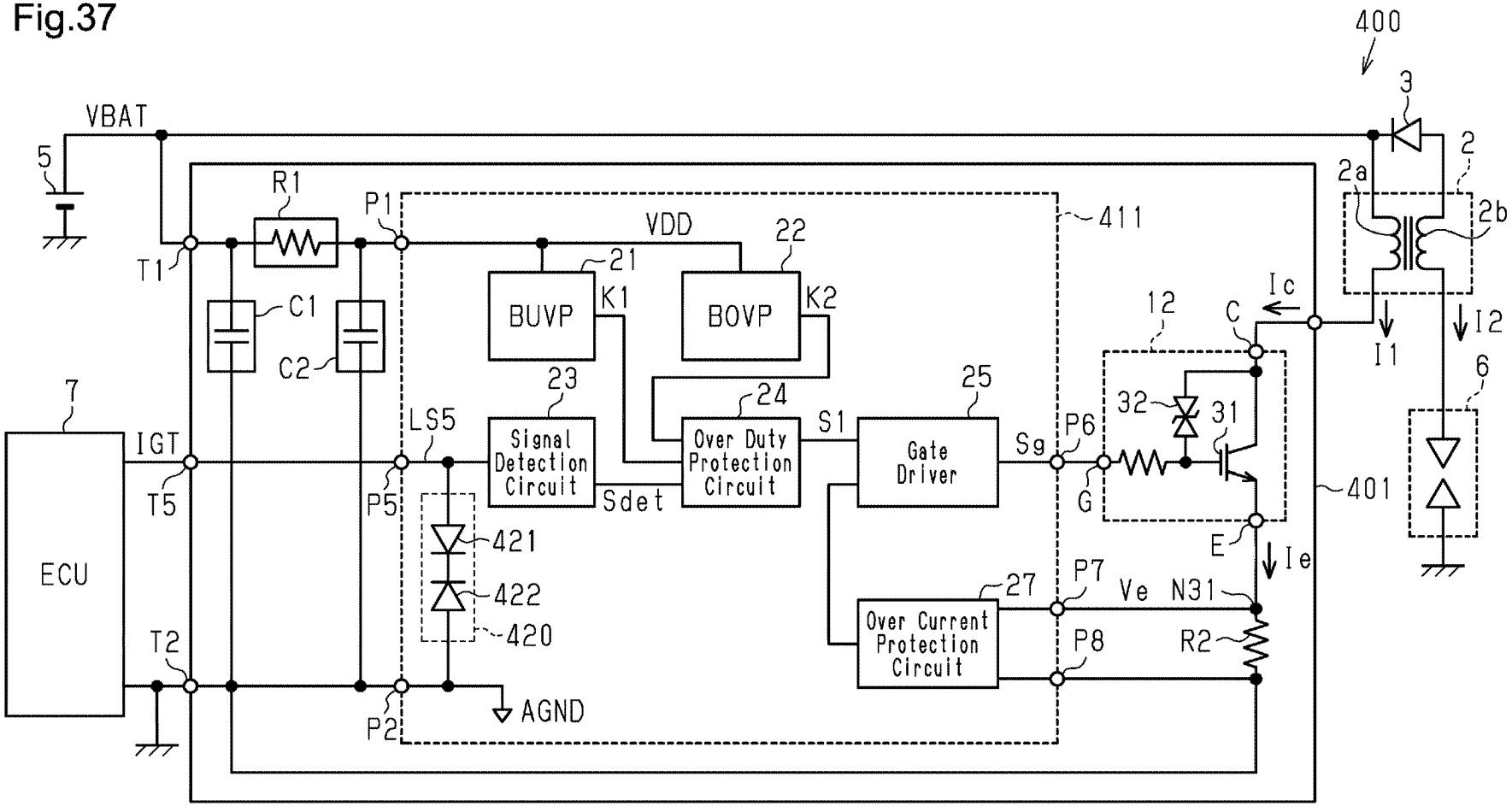
FIG. 37 is a schematic block circuit diagram showing an ignition device of a fourth embodiment.

As shown in FIG. 37, an ignition device 400 of the present embodiment includes the ignition coil 2 and an igniter 401.

The igniter 401 includes the switch element 12, a switch control circuit 411, the resistor R1, the capacitors C1 and C2, and the resistor R2 and is modularized and accommodated in a single package.

The switch element 12 includes the transistor 31 and the protection element 32 and is integrated on a single semiconductor substrate manufactured through a high-voltage process.

The switch control circuit 411 includes the high potential power terminal P1, the low potential power terminal P2, the output terminal P4, the input terminal P5, the output terminal P6, the input terminals P7 and P8, and the input terminal P11. The switch control circuit 411 receives the ignition instruction signal IGT via the input terminal P5. The switch control circuit 411 outputs the ignition confirmation signal IGF from the output terminal P4. The switch control circuit 411 detects the emitter current Ie of the switch element 12 from the potential difference between the two terminals of the resistor R2 connected to the input terminals P7 and P8.

The input terminal P11 of the switch control circuit 411 is connected to the first terminal of the resistor R31, and the second terminal of the resistor R31 is connected to the collector terminal C of the switch element 12.

The switch control circuit 411 includes the under voltage protection circuit 21, the over voltage protection circuit 22, the signal detection circuit 23, the over duty protection circuit 24, the gate driver 25, the overcurrent protection circuit 27, and a protection circuit 420.

The protection circuit 420 is connected between the input terminal P5 and the low potential power terminal P2. The switch control circuit 411 of the present embodiment includes a signal line LS5, which is connected to the input terminal P5 and which transmits the ignition instruction signal IGT, and the ground line AGND, which is connected to the low potential power terminal P2 that is connected to the low potential power terminal T2. In other words, the protection circuit 420 is connected between the signal line LS5 and the ground line AGND.

The protection circuit 420 protects internal circuits in stages subsequent to the protection circuit 420 from various types of noise superimposed on the signal line LS5 and the ground line AGND by the input terminal P5 and the low potential power terminal P2.

The protection circuit 420 of the present embodiment includes two protection elements 421 and 422 that are connected in series between the terminals P5 and P2. The protection elements 421 and 422 are diode elements. The protection element 421 corresponds to "the first diode element," and the protection element 422 corresponds to "the second diode element." In detail, a first terminal of the protection element 421 (corresponding to anode terminal of diode element) is connected to the signal line LS5, a second terminal of the protection element 421 (corresponding to cathode terminal) is connected to a second terminal of the protection element 422 (corresponding to cathode terminal), and a first terminal of the protection element 422 (corresponding to anode terminal) is connected to the ground line AGND. Thus, the protection circuit 420 is a circuit having an anti-series-connected bidirectional diode configuration. In the present specification, the diode element is an element functioning as a diode through wire-connection to a terminal.

In the present embodiment, the protection elements 421 and 422 are each formed by a P-channel Metal Oxide Semiconductor Field Effect Transistor (P-channel MOSFET). With a P-channel MOSFET, the source and back gate are connected to each other and function as the cathode terminal of the diode element. The drain of the P-channel MOSFET functions as the anode terminal of the diode element.

Example of Configuration of Protection Circuit

Figure 41:
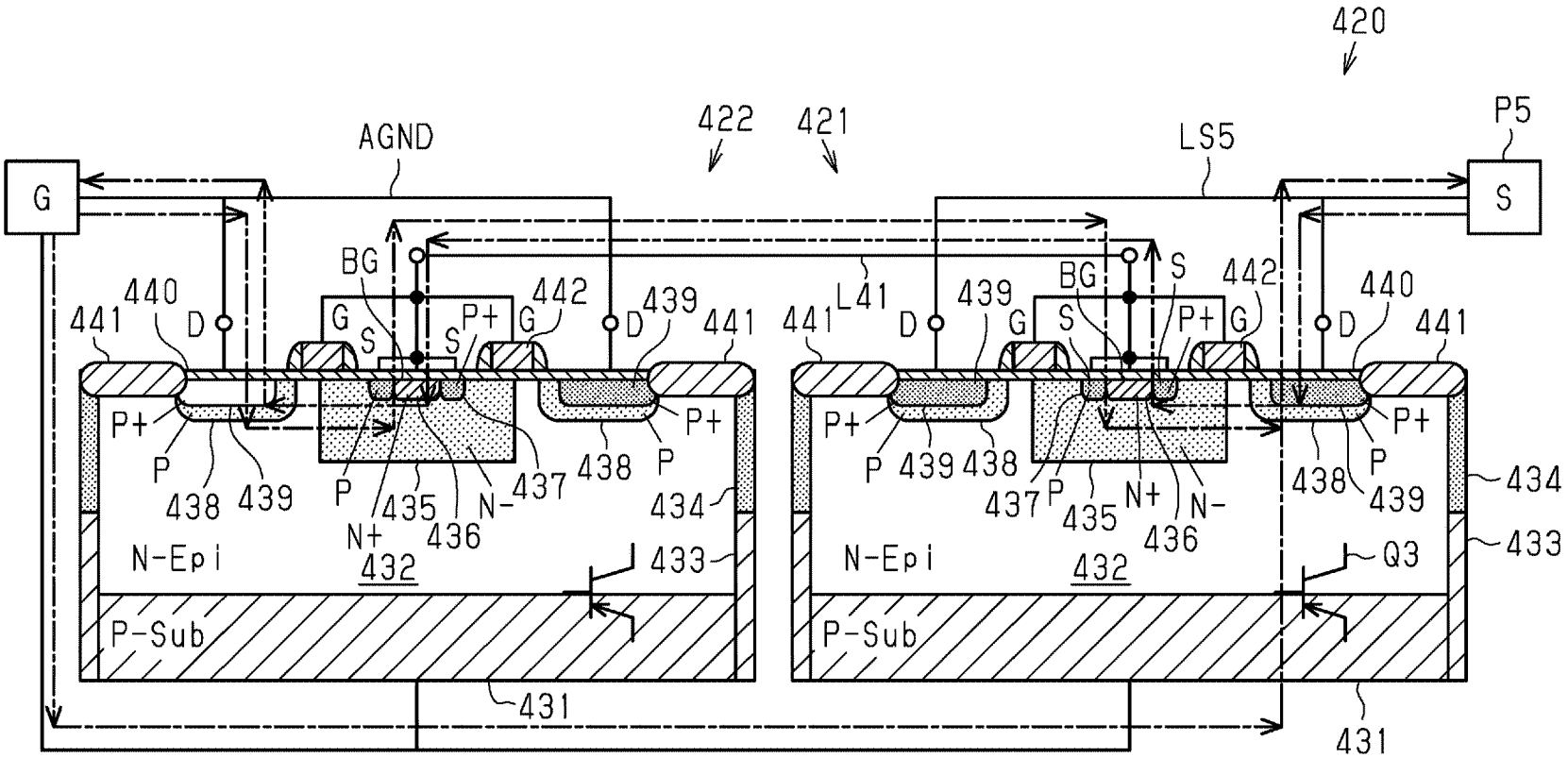
FIG. 41 is a schematic cross-sectional view illustrating the configuration of a protection circuit.

FIG. 41 shows an example of the configuration of the protection circuit 420.

The protection circuit 420 includes the two protection elements 421 and 422 connected between the input terminal P5 and a ground terminal P2.

The protection elements 421 and 422 are each formed on a P-type semiconductor substrate (P-sub) 431. An N-type epitaxial layer (N-Epi) 432 is formed on the P-type semiconductor substrate 431. The N-type epitaxial layer 432 define a region forming a single element through element isolation by a P-type region 433 and a P+ region 434. The N-type epitaxial layer 432 includes an N-well 435, and the N-well 435 includes an N+ region 436, which becomes a back gate terminal BG, and a P+ region 437, which becomes a source terminal S, at the two sides of the N+ region 436. A P region 438 and a P+ region 439, which become a drain, are formed through double diffusion at two sides of the N-well 435 spaced apart from the N-well 435. An oxide film 440 and a field oxide film 441 are formed on the upper surface of the N-type epitaxial layer 432. A gate electrode 442 (gate terminal G) is formed on the upper surface of the oxide film 440.

The drain terminal D (P+ region 439) of the protection element 421 is connected to the signal line LS5, which leads to the input terminal P5. The source terminal S (P+ region 437), the back gate terminal BG (the N+ region 436), and the gate terminal G (the gate electrode 442) of the protection element 421 are connected to one another and to line L41. Line L41 is connected to the source terminal S, the back gate terminal BG, and the gate terminal G of the protection element 422. The drain terminal D of the protection element 422 is connected to the ground line AGND, which leads to the ground terminal P2. The ground terminal P2 is connected to each of the protection elements 421 and 422 of the P-type semiconductor substrate 431.

Figure 42:
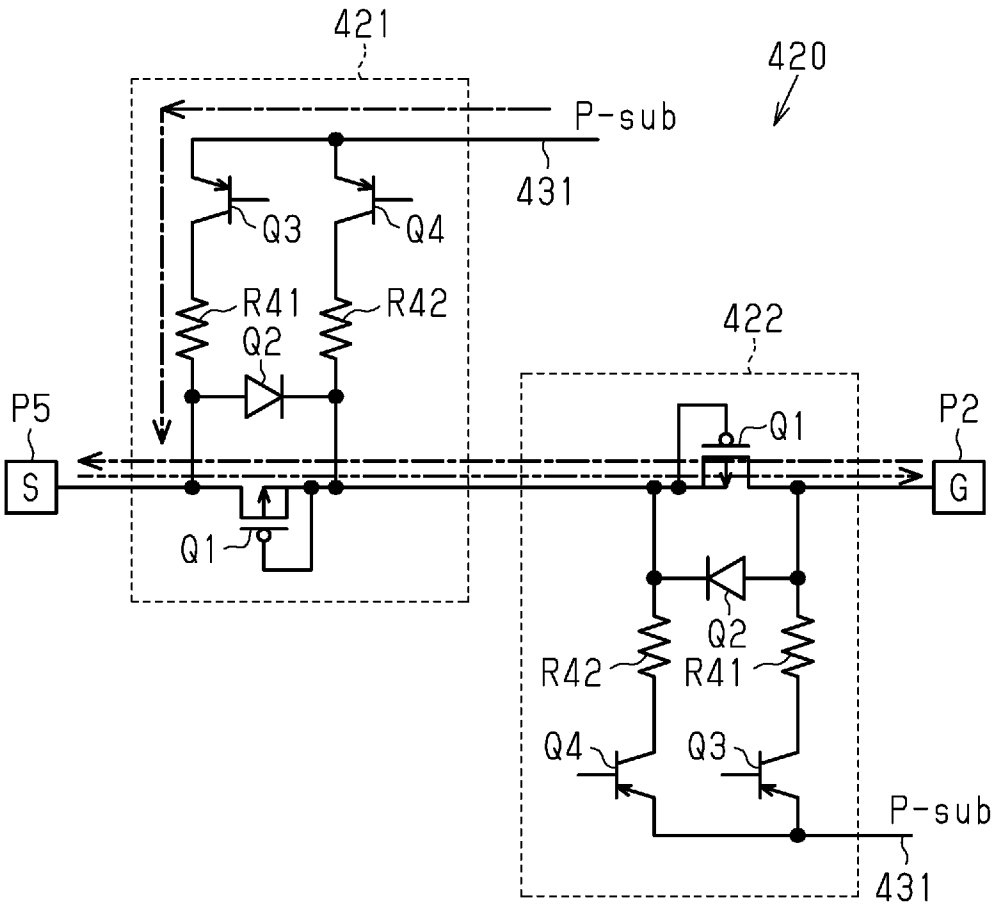
FIG. 42 is an equivalent circuit diagram of the protection circuit.

FIG. 42 is an equivalent circuit diagram of the protection circuit 420.

The protection circuit 420 includes the two protection elements 421 and 422 connected between the input terminal P5 and the ground terminal P2.

The protection elements 421 and 422 each include the P-channel MOSFET Q1, the parasitic transistor Q2 (illustrated as diode) connected between the source and drain of the P-channel MOSFET Q1, resistors R41 and R42 respectively connected to the source and the drain, and parasitic transistors Q13 and Q14 connected in series to the resistors R41 and R42. The parasitic transistor Q2 is an NPN transistor formed by a P+ region that becomes the drain terminal D, the N-type epitaxial layer 432, the N-well 435, and the P+ region 437 that becomes the source terminal S, which are shown in FIG. 41. The resistors R41 and R42 are resistor components of the N-type epitaxial layer 432. The parasitic transistors Q3 and Q4 are PNP transistors formed by the P-type semiconductor substrate 431, the N-type epitaxial layer 432, and the P region 438, which are shown in FIG. 41.

Operation of Protection Circuit

In FIGS. 41 and 42, the double-dashed lines show a current path when a breakdown occurs due to the application of a positive surge voltage, and the single-dashed lines show a current path when a breakdown occurs due to the application of a negative surface voltage.

When a positive surge voltage is applied, current flows from the input terminal P5 via the signal line LS5, the drain terminal D of the protection element 421, the source terminal S of the protection element 421, line L41, the source terminal S of the protection element 422, the drain terminal D of the protection element 422, and the ground line AGND to the ground terminal P2. In this case, voltage fluctuation at the signal line LS5, which leads to the input terminal P5, is clamped at the voltage of the sum (VF+ BVdss) of a forward voltage VF of the parasitic transistor Q2 of the protection element 421 and a reverse voltage (breakdown voltage) BVdss of a diode formed by the PMOS transistor Q1 of the protection element 422.

When a negative surge voltage is applied, current flows from the ground terminal P2 via the ground line AGND, the drain terminal D of the protection element 422, the source terminal S of the protection element 422, line L41, the source terminal S of the protection element 421, the drain terminal D of the protection element 421, and the signal line LS5 to the input terminal P5. Further, current flows from the ground terminal P2 across the protection element 421, that is, via the parasitic transistor Q3 (P-type semiconductor substrate 431, N-type epitaxial layer 432, and P region 438), and the P+ region 439, to the signal line LS5. The current flowing across the protection element 421 is limited to a subtle current (e.g., several mA) by the resistor component (e.g., resistor R41 shown in FIG. 42) of the N-type epitaxial layer 432. Thus, the voltage at the ground line AGND is clamped at substantially the same voltage as when a positive surge voltage is applied.

Igniter Package

Figure 38:
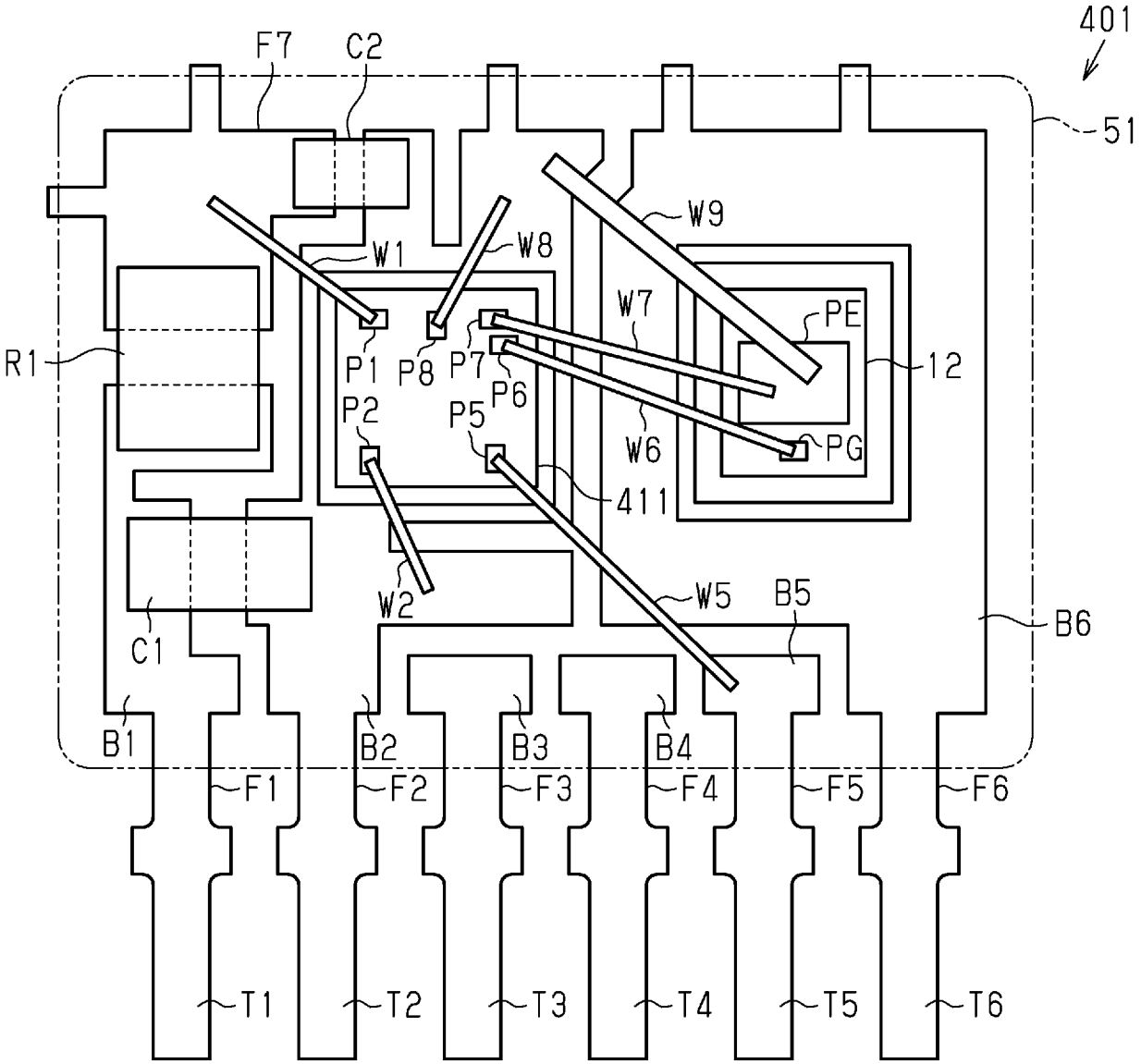
FIG. 38 is a schematic plan view showing one example of the inner configuration of the igniter.

FIG. 38 shows a package of the igniter 401 and components of the igniter 401 mounted on lead frames. The outer appearance of the igniter 401 is the same as the igniter 4 of the first embodiment and therefore not illustrated.

The igniter 401 includes the lead frames F1 to F7 and the encapsulation resin 51 that encapsulates parts of the lead frames F1 to F7 and components of the igniter 401. FIG. 38 shows the encapsulation resin 51 with double-dashed lines. The encapsulation resin 51 is substantially box-shaped and has one side surface from which the lead frames F1 to F6 project as the mounting connection terminals (lead portions) T1 to T6. The package of the ignitor 401 is a six-pin SIP. The number of pins of the package may be changed as required.

The lead frames F1 to F7 may be formed from a conductive metal, for example, Cu, a Cu alloy, Ni, a Ni alloy, 42 alloy, or the like. A Pd plating, an Ag plating, a Ni/Pd/Ag plating, or the like may be applied to the surface of each of the lead frames F1 to F7. The encapsulation resin 51 may be an insulative resin, for example, epoxy resin. Further, the encapsulation resin 51 has a predetermined color (e.g., black).

The lead frames F1 to F6 include the mount portions B1 to B6 and lead portions T1 to T6 extending from the mount portions B1 to B6. The lead portions T1 to T6 correspond to the terminals of the igniter 4.

The resistor R1 is connected between the mount portion B1 of the lead frame F1 and the lead frame F7. The capacitor C1 is connected between the mount portion B1 of the lead frame F1 and the mount portion B2 of the lead frame F2. The capacitor C1 is mounted closer to the lead portions T1 and T2 of the lead frames F1 and F2 than the resistor R1. Further, the capacitor C2 is connected between the mount portion B2 of the lead frame F2 and the lead frame F7. The capacitor C2 and the capacitor C1 are mounted on opposite sides of the resistor R1. The resistor R1 and the capacitors C1 and C2 are connected by, for example, an Ag paste, solder, or the like.

A switch control device 11 is mounted on the mount portion B2 of the lead frame F2, and the switch element 12 is mounted on the mount portion B6 of the lead frame F6. The switch control device 11 is an IC chip on which the switch control circuit 11 shown in FIG. 37 is formed. The switch control device 11 and the switch element 12 are connected by, for example, an Ag paste, solder, or the like. The lower surface of the switch element 12 includes a collector electrode PC (refer to FIG. 10), and the collector electrode PC is connected by an Ag paste, solder, or the like to the mount portion B6.

The gate pad PG and the emitter pad PE are exposed from the upper surface of the switch element 12. Pads P1, P2, P4, P5, P6, P7, and P8 are exposed from the upper surface of the switch control device 11. Pad P1 is connected by wire W1 to the lead frame F7. Pad P2 is connected by wire W2 to the mount portion B2 of the lead frame F2. Pad P5 is connected by wire W5 to the mount portion B5 of the lead frame F5. Pad P6 is connected by wire W6 to the gate pad PG of the switch element 12. Pad P7 is connected by wire W7 to the emitter pad PE of the switch element 12. The emitter pad PE of the switch element 12 is connected by wire W9 to the mount portion B2 of the lead frame F2. Pad P8 of the switch control device 11 is connected by wire W8 to the mount portion B2 of the lead frame F2. Wires W1, W2, W5, W6, W7, and W8 are, for example, aluminum wires each having a diameter of, for example, 125 μm. Wire W9 is, for example, an aluminum wire having a diameter of, for example, 250 μm. Wire W9 has a resistance of several mΩ to several tens of mΩ, for example, 5 mΩ. The resistance component of wire W9 functions as the resistor R2 shown in FIG. 37.

Layout of Switch Control Circuit

Figure 39:
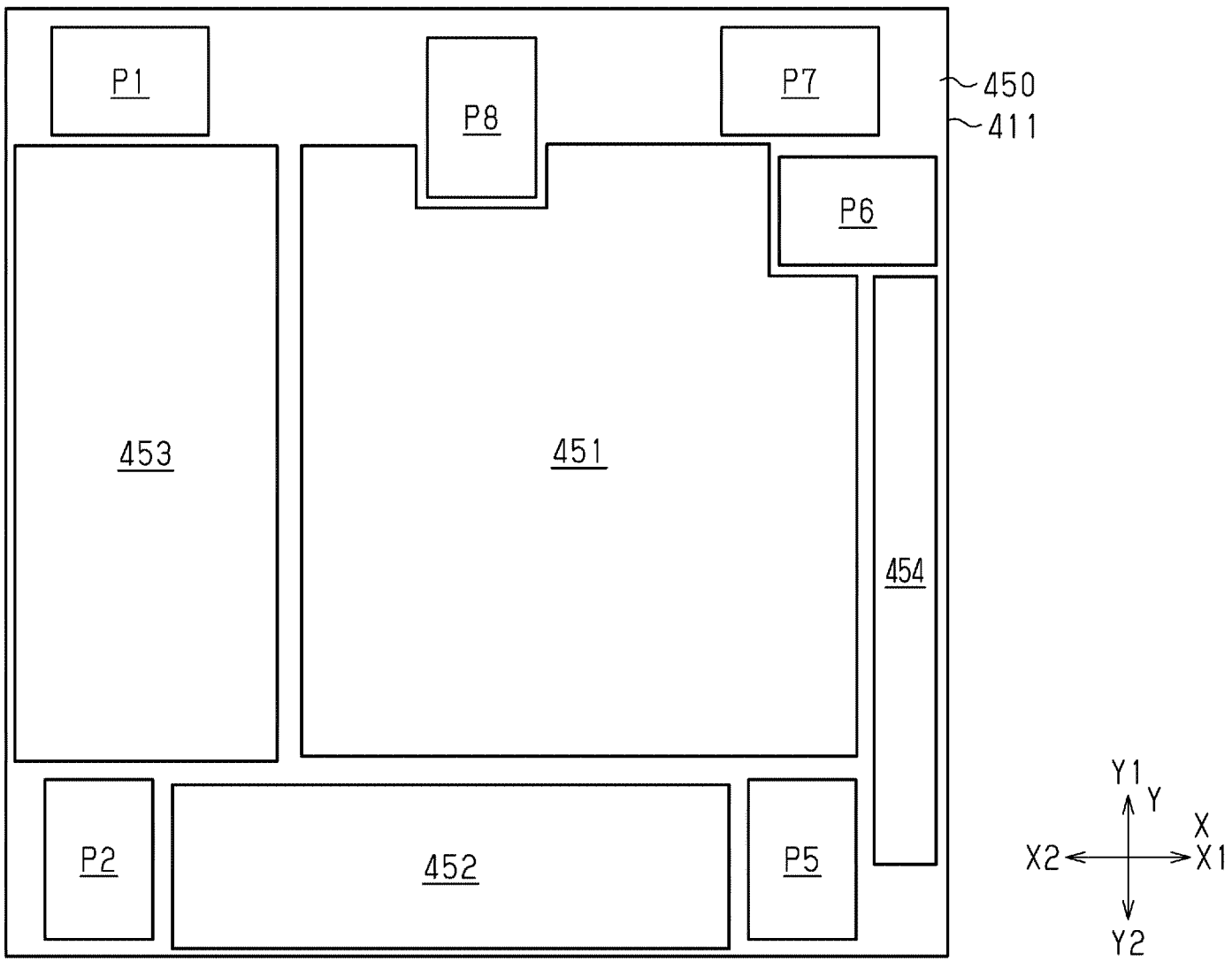
FIG. 39 is a schematic plan view illustrating one example of the layout of functional ICs of a switch control circuit.

FIG. 39 shows one example of the IC layout of the switch control circuit 411.

The switch control circuit 411 includes a semiconductor substrate 450. Pads P1, P2, P5, P6, P7, and P8, which correspond to the terminals shown in FIG. 37, are arranged on the semiconductor substrate 450. Functional elements of the switch control circuit 411 are formed on the semiconductor substrate 450. In FIG. 39, the direction parallel to one side of the semiconductor substrate 450 (horizontal direction in FIG. 39) is referred to as the X direction (X1-X2 direction), and a direction parallel to a side orthogonal to the above side (vertical direction in FIG. 39) is referred to as the Y direction (Y1-Y2 direction).

Pad P1, pad P7, and pad P8 are arranged on a Y1-direction end of the semiconductor substrate 450. Pad P1 is arranged on an X2-direction end and has a longer dimension in the X direction than the Y direction. Pad P7 is arranged proximate to the X1-direction end and has a Y-direction dimension Y6 that is longer than an X-direction dimension X6. Pad P8 is arranged proximate to the central part with respect to the X direction and has a Y-direction dimension Y7 that is longer than an X-direction dimension X7. Pad P7 and pad P8 respectively correspond to "the first pad" and "the second pad" of the present invention. Pads P2 and P5 are arranged on a Y2-direction end of the semiconductor substrate 450. Pad P2 is arranged on an X2-direction end and has a longer dimension in the Y direction than the X direction. Pad P5 is arranged proximate to the X1-direction end and has a longer dimension in the Y direction than the X direction. Pad P6 is arranged at the Y2 side of pad P7 in the X1 direction and has a longer dimension in the X direction than the Y direction. Pads P1, P2, and P5 to P8 are shaped in correspondence to the direction in which bonding wires are bonded.

The semiconductor substrate 450 includes a plurality of regions 451, 452, 453, and 454. Region 451 is where functional elements of the circuits 21 to 25 and 27 of the switch control circuit 411 are formed. Region 452 is where the protection elements 421 and 422 of the protection circuit 420 are formed. Region 453 is where a protection circuit, which protects the switch control circuit 411 from a surge or noise received from pads P1 and P2, is formed. Region 454 is where a test pad is formed. The IC chip layout of the switch control circuit 411 is not limited to that shown in FIG. 42.

Schematic Plan View of Protection Element

Figure 40:
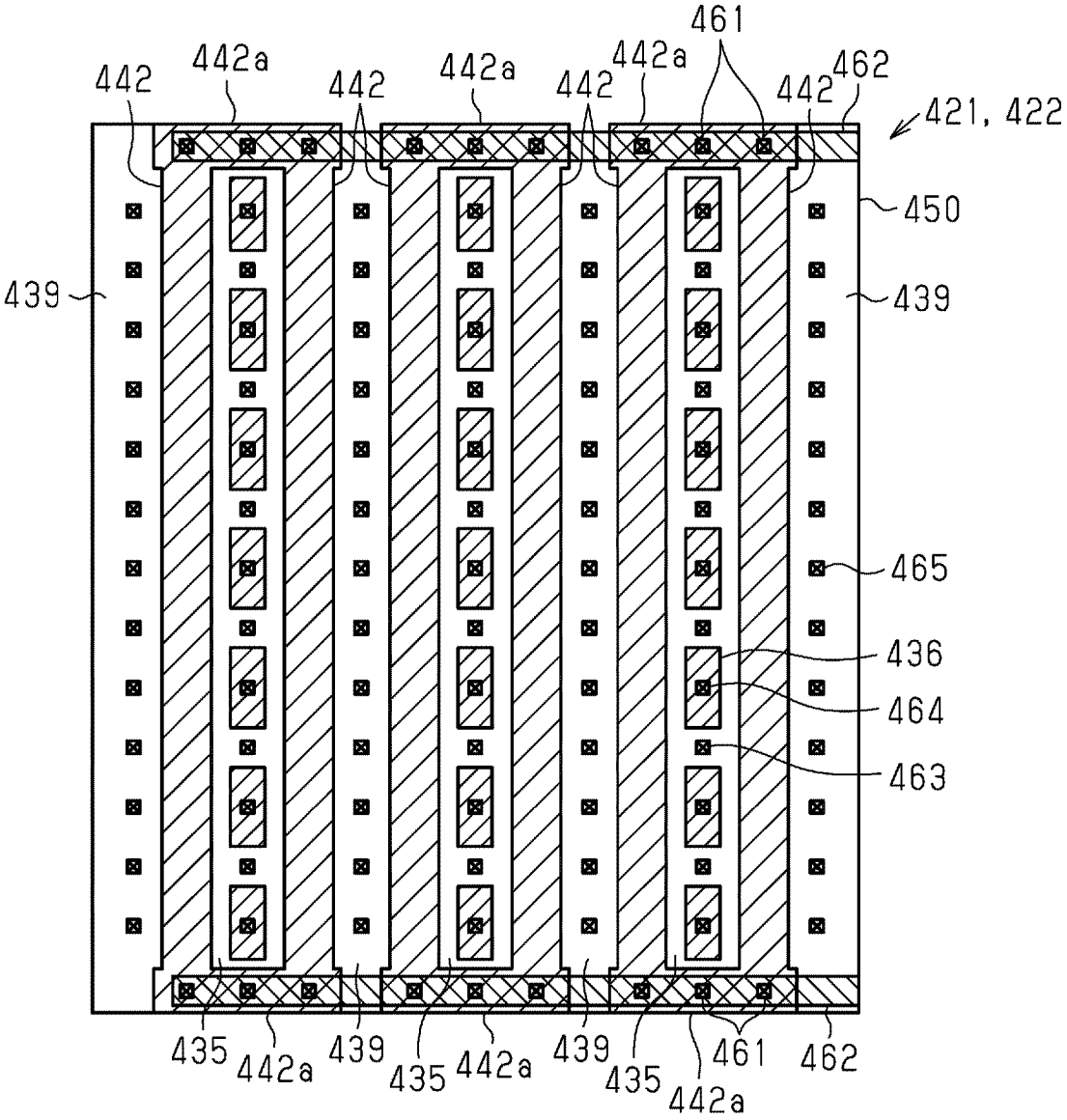
FIG. 40 is a schematic plan view of a protection element.

FIG. 40 is a partially enlarged plan view of the protection elements 421 and 422.

The protection elements 421 and 422 include the semiconductor substrate 450 and a plurality of gate electrodes 442 formed on the semiconductor substrate 450. The gate electrodes 442 extend in a predetermined direction (vertical direction in FIG. 40). The ends of a predetermined number (e.g., two) of the gate electrodes 442 are connected by connectors 442*a*. The connectors 442*a* are connected by contacts 461 to a wire 462 in a layer above the gate electrode 442.

One of the regions sandwiching the gate electrode 442 is an N-well region 435 and the other one is a drain region 439. A source contact 463 and a back gate contact 464 are alternately arranged in the N-well region 435. A drain contact 465 is arranged in the drain region 439. The source contact 463 is connected to the P+ region 437 (not shown), which has substantially the same size as the source contact 463. Each back gate contact 464 is surrounded by an N+ region 436.

The operation of the protection circuit 420 in the present embodiment will now be described.

The protection circuit 420, which has a bi-directional diode structure, includes the protection elements 421 and 422. The protection elements 421 and 422 each have a PMOSFET structure that is a diode element connecting the source terminal S of the PMOSFET to the gate terminal G and the back gate terminal BG. The anode terminals of the protection elements 421 and 422 are connected to the signal line LS5 that leads to the input terminal P5, the ground line AGND that leads to the ground terminal P2. Further, the cathode terminals of the protection elements 421 and 422 are connected to each other. The protection circuit 420 including the protection elements 421 and 422 that are configured and connected as described above limits damage inflicted by surge to the protection elements 421 and 422 and improves immunity.

A comparative example of the protection circuit 420 (the protection elements 421 and 422) of the present embodiment will now be described.

As a comparative example, for example, an NMOSFET can be diode-connected to form a protection element. However, there is a tendency of the characteristics varying between protective elements using NMOSFETs, and a protection element will have low surge resistance when its characteristics vary.

Figure 43A:
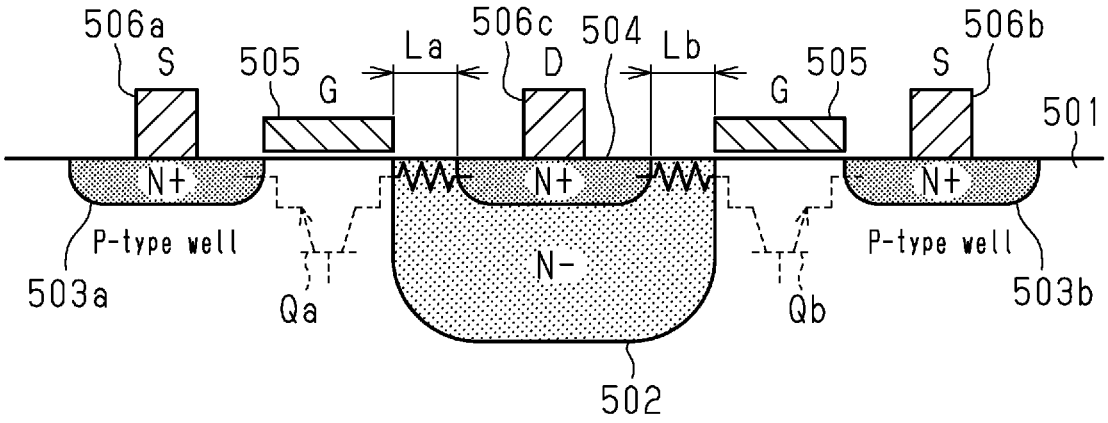
FIG. 43A is a schematic cross-sectional view of an NMOSFET.

FIG. 43A shows the cross-sectional structure of the NMOSFET. This NMOSFET includes an N− region 502 and N+ regions 503*a* and 503*b* in a P-type well 501, and an N+ region 504 in the N− region 502. A gate electrode 505 is formed on the P-type well 501 with an insulation film (gate insulation film), which is not shown, located in between. Contacts 506*a*, 506*b*, and 506*c* are connected to the N+ regions 503*a*, 503*b*, and 504. The contact 506*c* is the drain terminal D of the NMOSFET, and the contacts 506*a* and 506*b* are the source terminal S.

In the NMOSFET, parasitic NPN transistors Qa and Qb are formed between the N− region 502 and the N+ regions 503*a* and 503*b*, and the parasitic NPN transistors Qa and Qb are connected via a parasitic resistor, which is formed by the resistor components of the N− region 502 and the N+ region 504, to the contact 506*c*.

Figure 43B:
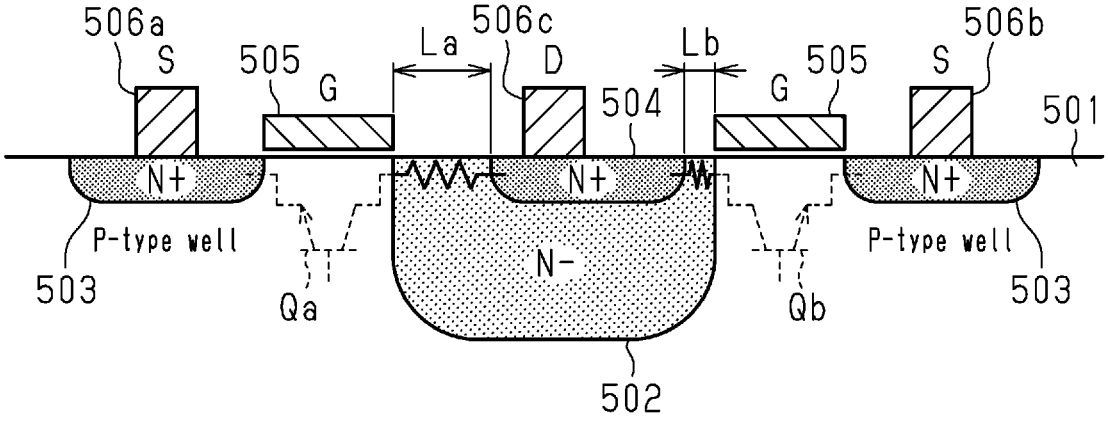
FIG. 43B is a schematic cross-sectional view of an NMOSFET in which a displacement has occurred.

FIG. 43B shows the cross section of an NMOSFET in which displacement has occurred. In this NMOSFET, the N+ region 504 is displaced in the N− region 502. In this case, distances La and Lb from the ends of the N+ region 504 to the boundary of the N-region 502 and the P-type well 501 (PN junction boundary) differ between the left side and right side as viewed in the drawing. Designing is performed so that the distances La and Lb are set to be equal as shown in FIG. 43A in accordance with the required characteristics.

Such a displacement produces a difference in resistance between the contact 506*c* and the parasitic NPN transistors Qa and Qb. The sheet resistance of the N− region 502 is ten times or greater than the sheet resistance of the N+ region 504. Thus, the resistance between the collector of the parasitic NPN transistor Qb and the contact 506*c* is lower than the resistance between the collector of the parasitic transistor Qa and the contact 506*c*. This reduces the current-limiting effect. In this case, the current resulting from a surge may concentrate at a portion where the resistance is small, namely, the parasitic NPN transistor Qb, and thereby inflict damage.

The displacement in the NMOSFET may occur during a manufacturing process.

Figure 44A:
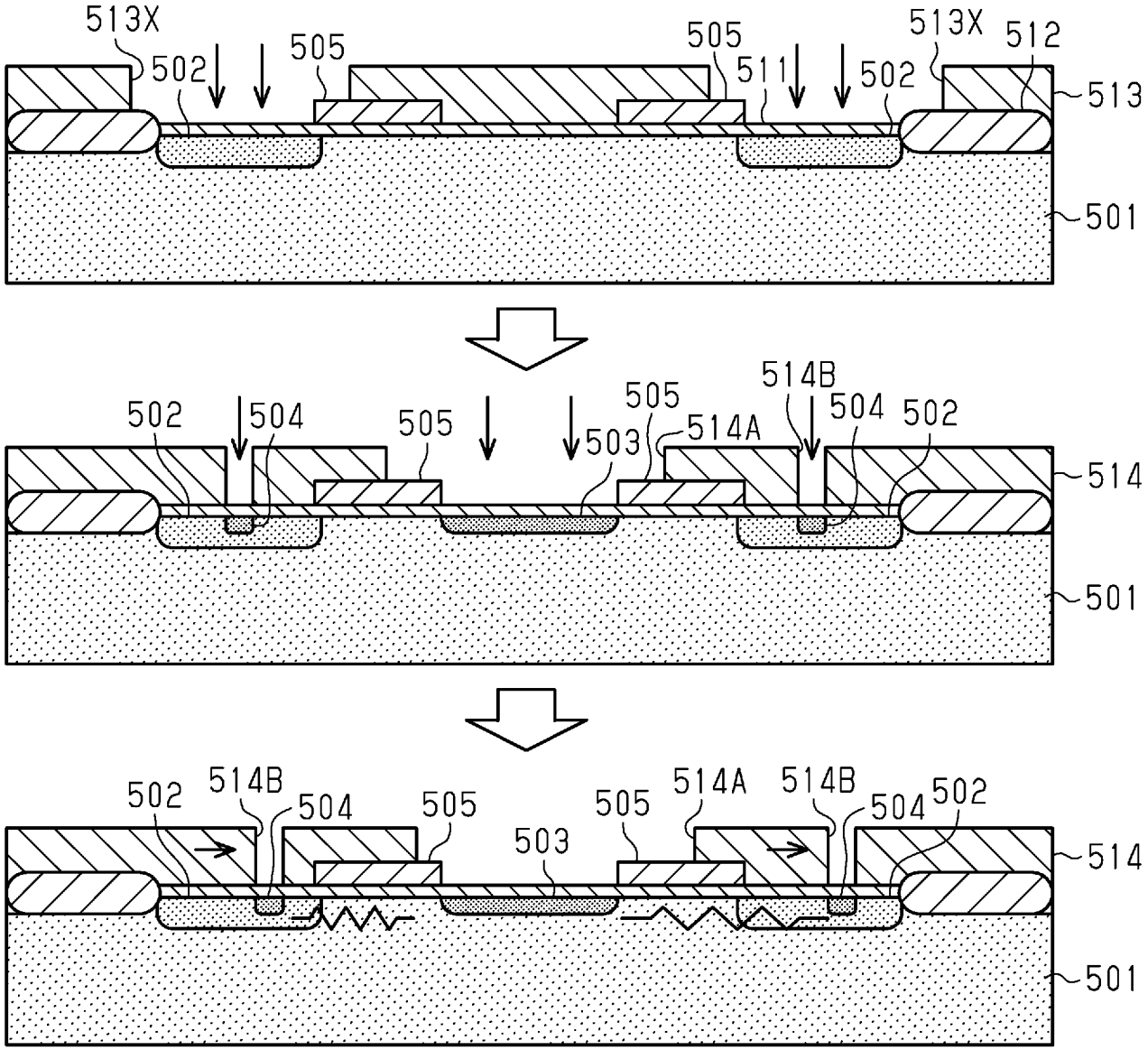
FIG. 44A is an explanatory diagram illustrating how the protection element is formed with an NMOSFET.

FIG. 44A shows part of a manufacturing process of the NMOSFET. FIG. 44A shows the manufacturing process of the NMOSFET focusing on the source in correspondence with the manufacturing process of the PMOSFET in the present embodiment.

In the step shown in the upper section of FIG. 44A, the N− region 502 is formed in the P-type well 501. An oxide film 511 and a field oxide film 512 are formed on the upper surface of the P-type well 501, and the gate electrodes 505 are formed on the oxide film 511. Further, a resist film 513 including openings 513X is formed, and an N-type impurity is implanted to the P-type well 501 from the openings 513X to form the N− region 502. Then, the resist film 513 is removed.

In the step shown in the middle section of FIG. 44A, an N+ region 503 is formed between the gate electrodes 505, and the N+ region 504 is formed in the N− region 502. The N+ regions 503 and 504 are for connection with contacts. A resist film 514 including openings 514A and 514B is formed. The openings 514B are formed at positions corresponding to contacts of the N− region 502, and the opening 514A is the region that becomes the source. An N-type impurity is implanted from the openings 514A and 514B to form the N+ regions 503 and 504.

In the step shown in the lower section of FIG. 44A, when forming the resist film 514, the openings 514A and 514B of the resist film 514 are displaced from the given positions during the alignment process. The openings 514B are smaller in size than the N-region 502. Accordingly, displacement of the resist film 514 will displace the N+ region 504 formed in the N− region 502. However, since the impurity is implanted to the P-type well 501 using the gate electrodes 505 as a mask, the N+ region 503 between the gate electrodes 505 will not be affected by the displacement of the resist film 514. This produces a difference in the distance from the N+ region 503 between the gate electrodes 505 to the N+ regions 504 in the N− regions 502 at the two sides of the N+ region 503. In this manner, the N+ region 503 is displaced relative to the N+ region 504, which is for the contact. As a result, current concentration occurs as described above.

In this regard, the protection elements 421 and 422 of the protection circuit 420 in the present embodiment have PMOS configurations. This limits displacement such as that described above.

Figure 44B:
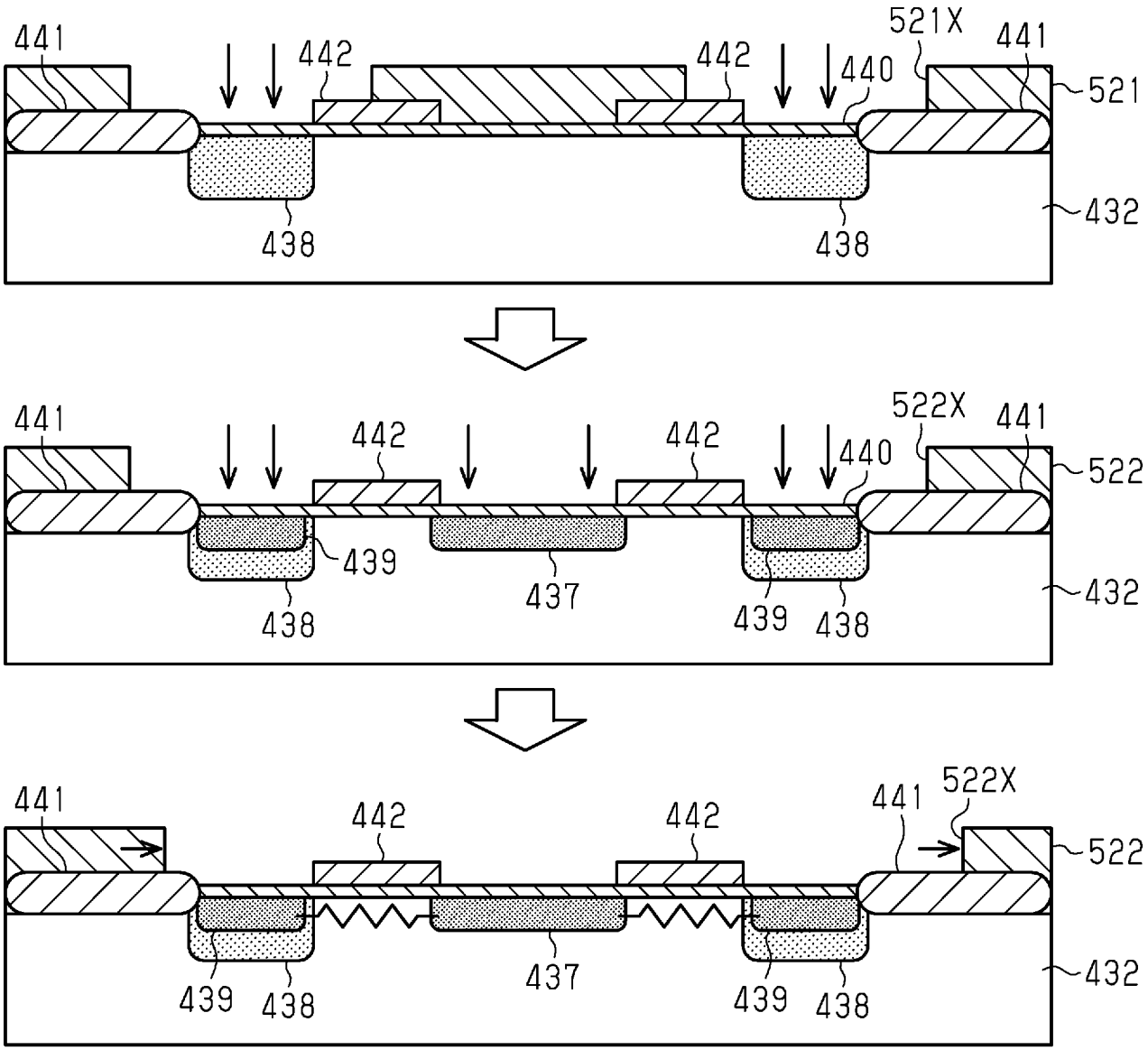
FIG. 44B is an explanatory diagram illustrating how the protection element is formed with a PMOSFET.

FIG. 44B shows part of a manufacturing process of the PMOSFET. FIG. 44B illustrates the formation of a P-type region and does not show the N-type well 435 of FIG. 41.

In the step shown in the upper section of FIG. 44B, the P region 438 is formed in the N-type epitaxial layer 432. The oxide film 440 and the field oxide film 441 are formed on the N-type epitaxial layer 432, and the gate electrode 442 is formed on the oxide film 440. Further, a resist film 521 including an opening 521X is formed, and P-type impurity is implanted from the opening 521X to the N-type epitaxial layer 432 to form the P region 438. The opening 521X exposes a region that forms the drain between the gate electrode 442 and the field oxide film 441. In this step, the gate electrode 442 and the field oxide film 441 function as a mask when implanting a P-type impurity. Then, the resist film 521 is removed.

In the step shown in the middle section of FIG. 44B, the P+ region 437 is formed between the gate electrodes 442, and the P+ region 439 is formed in the P region 438. A resist film 522 including an opening 522X is formed. The opening 522X is formed to expose part of the field oxide film 441 so that the inner region of the field oxide film 441 is entirely exposed in accordance with the region where a P-type impurity is implanted. Then, the P-type impurity is implanted from the opening 522X. In this step, the gate electrode 442 and the field oxide film 441 function as a mask when implanting the P-type impurity. Accordingly, as shown in the lower section in FIG. 44B, the resist film 522 is displaced, and the relative positions of the N+ regions 437 and 439 do not change. Accordingly, the resistance between the N+ region 437 and the N+ region 439 is not affected by misalignment in the manufacturing process. This limits the concentration of current resulting from a surge and protects the protection elements 421 and 422 from damage.

As described above, the present embodiment has the advantages described below.

(4-1) The protection circuit 420 includes the two protection elements 421 and 422 connected in series between the input terminal P5 and the low potential power terminal P2. The protection elements 421 and 422 are diode elements. The protection circuit 420 is a circuit having an anti-series-connected bidirectional diode configuration. The diode element is an element functioning as a diode through wire-connection to a terminal, and the protection elements 421 and 422 are formed by PMOSFETs. The protection circuit 420 including the protection elements 421 and 422 improve the immunity of the switch control circuit 411.

(4-2) The protection elements 421 and 422 are formed by PMOSFETs. In the manufacturing process of the PMOSFETs, the gate electrode 442 and the field oxide film 441 are used as a mask when forming the P+ regions 437 and 439, which become the source terminal S and the drain terminal D. Such a structure limits current concentration that would result from a surge and protects the protection elements 421 and 422 from damage.

Modified Examples of Fourth Embodiment

Modified examples of the fourth embodiment will now be described. In the description hereafter, same reference numerals are given to those components that are the same as the corresponding components of the first to fourth embodiments. Such components will not be described in detail.

Figure 45:
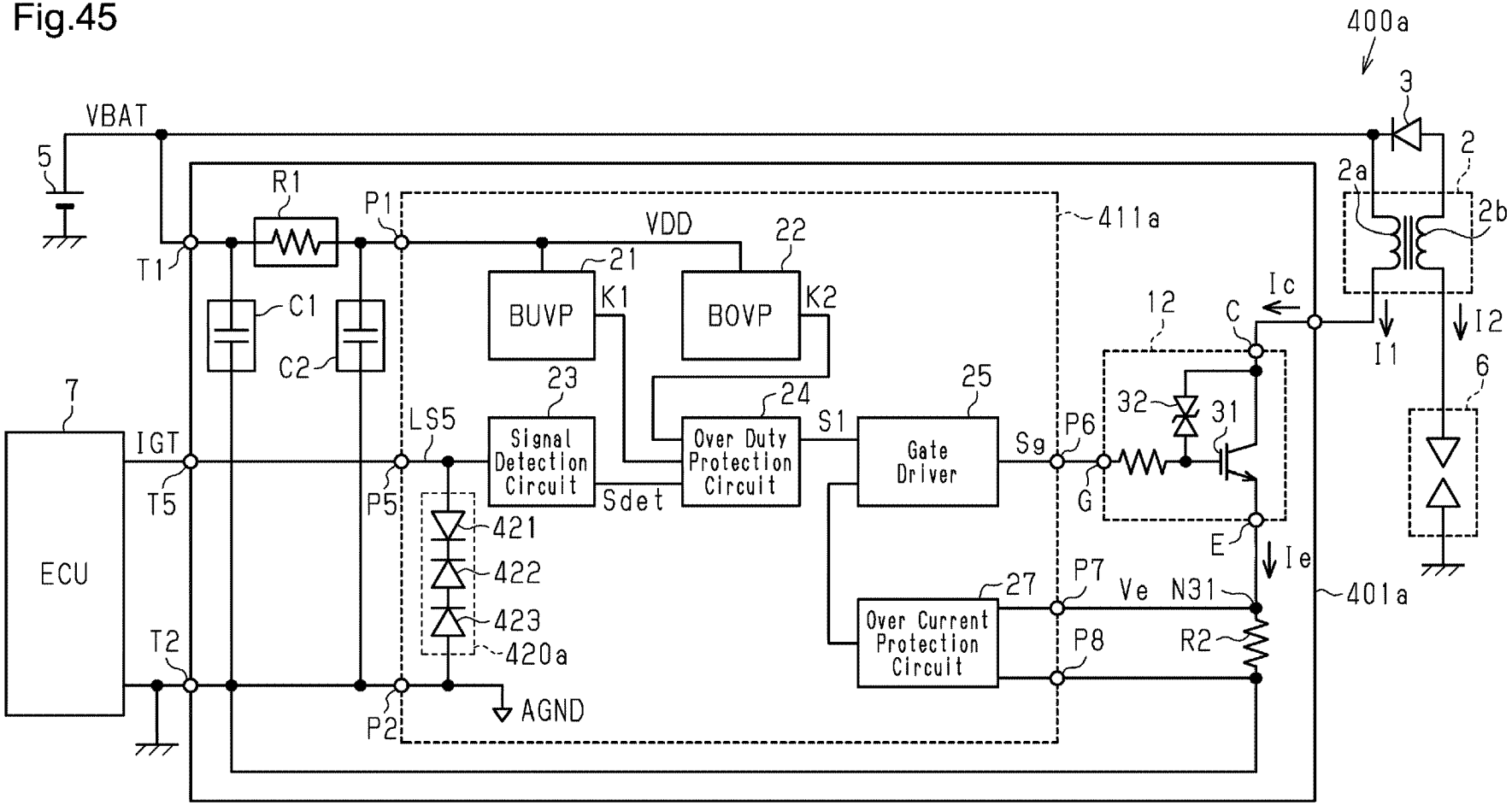
FIG. 45 is a schematic block circuit diagram showing an ignition device of a modified example of the fourth embodiment.

As shown in FIG. 45, an ignition device 400*a* includes the ignition coil 2 and an igniter 401*a*.

The igniter 401*a* includes the switch element 12, the switch control circuit 411*a*, the resistor R1, the capacitors C1 and C2, and the resistor R2 and is modularized and accommodated in a single package.

The switch control circuit 411*a* includes the under voltage protection circuit 21, the over voltage protection circuit 22, the signal detection circuit 23, the over duty protection circuit 24, the gate driver 25, the overcurrent protection circuit 27, and a protection circuit 420*a*.

The protection circuit 420*a* is connected between the input terminal P5 and the low potential power terminal P2. The protection circuit 420*a* protects internal circuits in stages subsequent to the protection circuit 420*a* from various types of noise superimposed on the signal line LS5 and the ground line AGND by the input terminal P5 and the low potential power terminal P2.

The protection circuit 420*a* includes three protection elements 421, 422, and 423 connected in series between the terminals P5 and P2. The protection elements 421, 422, and 423 are diode elements. The protection element 421 corresponds to "the first diode element," and the protection elements 422 and 423 correspond to "the second diode element." Further, the protection elements 421, 422, and 423 are each formed by a PMOSFET.

A first terminal (corresponding to anode terminal) of the protection element 421 is connected to the signal line LS5, and a second terminal (corresponding to cathode terminal) of the protection element 421 is connected to a second terminal (corresponding to cathode terminal) of the protection element 422. A first terminal (corresponding to anode terminal) of the protection element 422 is connected to a second terminal (corresponding to cathode terminal) of the protection element 423, and a first terminal (corresponding to anode terminal) of the protection element 423 is connected to the ground line AGND. Thus, the protection circuit 420 is a circuit having a bidirectional diode configuration in which the two protection elements 422 and 423 are anti-series connected to the single protection element 421.

Example of Configuration of Protection Circuit

Figure 46:
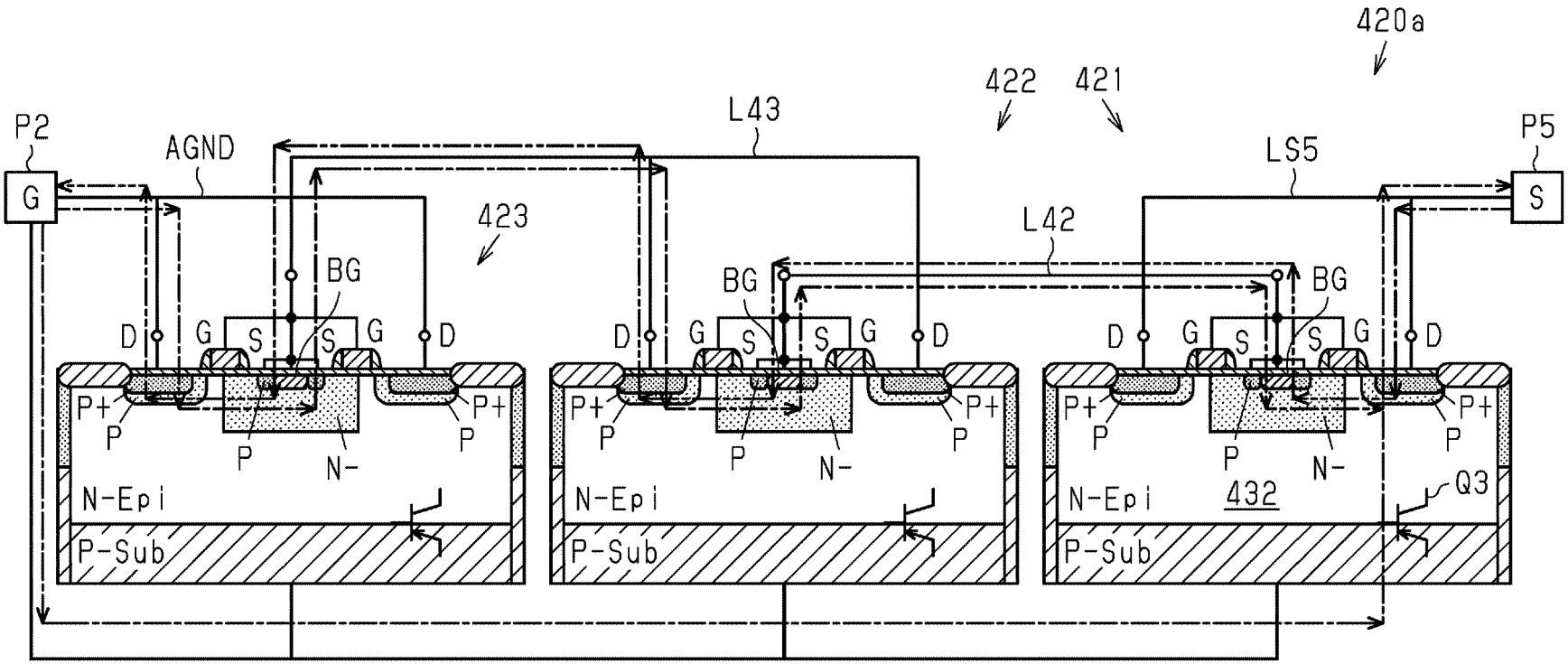
FIG. 46 is a schematic cross-sectional view illustrating a protection element of a protection circuit.

FIG. 46 shows an example of the configuration of the protection circuit 420.

The protection circuit 420*a* includes the three protection elements 421, 422, and 423 connected between the input terminal P5 and the ground terminal P2.

The protection elements 421, 422, and 423 have the same structure as the fourth embodiment (FIG. 37). Thus, each region will not be described nor denoted with a reference character.

The drain terminal D of the protection element 421 is connected to the signal line LS5, which leads to the input terminal P5. The source terminal S, back gate terminal BG, and gate terminal G of the protection element 421 are connected to one another and to line L42, and line L42 is connected to the source terminal S, back gate terminal BG, and gate terminal G of the protection element 422. The drain terminal D of the protection element 422 is connected by line L43 to the source terminal S, back gate terminal BG, and gate terminal G of the protection element 423, and the drain terminal D of the protection element 423 is connected to the ground line AGND, which leads to the ground terminal P2. The ground terminal P2 is connected to the P-type semiconductor substrate 431 of each of the protection elements 421, 422, and 423.

Figure 47:
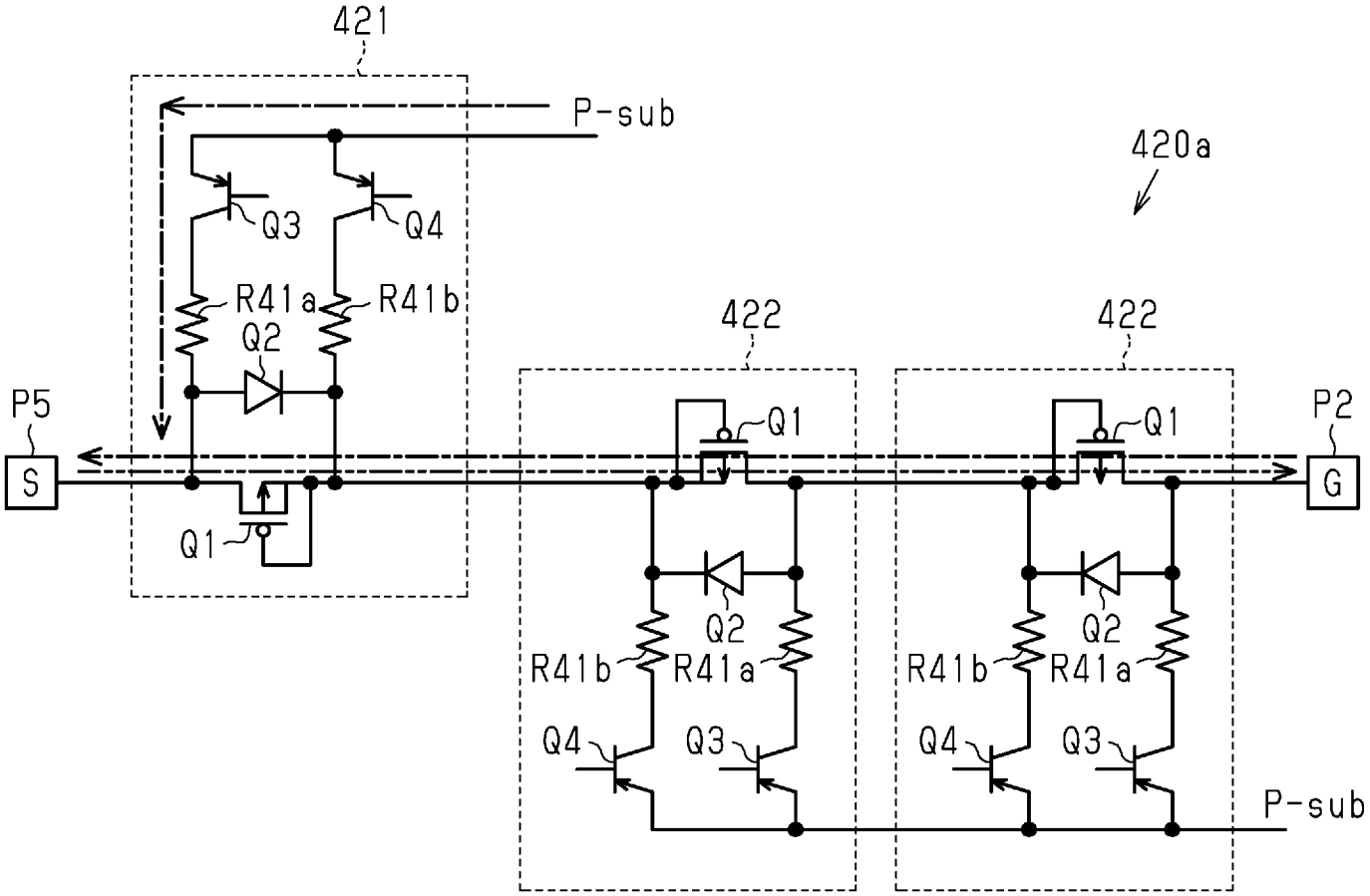
FIG. 47 is an equivalent circuit diagram of the protection circuit.

FIG. 47 is an equivalent circuit diagram of the protection circuit 420*a*.

The protection circuit 420*a* includes the three protection elements 421, 422, and 423 connected between the input terminal P5 and the ground terminal P2.

Each of the protection elements 421 to 423 includes the P-channel MOSFET Q1, the parasitic transistor (illustrated as diode) Q2 between the source and drain of the P-channel MOSFET Q1, resistors R41*a* and R41*b* respectively connected to the source and drain, and the parasitic transistors Q3 and Q4 connected in series to the resistors R41*a* and R41*b*.

Operation of Protection Circuit

In FIGS. 46 and 47, the double-dashed lines show a current path when a breakdown occurs due to the application of a positive surge voltage, and the single-dashed lines show a current path when a breakdown occurs due to the application of a negative surface voltage.

When a positive surface voltage is applied, current flows from the input terminal P5 via the signal line LS5, the drain terminal D of the protection element 421, the source terminal S of the protection element 421, line L42, the source terminal S of the protection element 422, the drain terminal D of the protection element 422, line L43, the source terminal S of the protection element 423, the drain terminal D of the protection element 423, and the ground line AGND to the ground terminal P2. In this case, voltage fluctuation at line LS5, which leads to the input terminal P5, is clamped at the voltage of the sum (VF+2×BVdss) of the forward voltage VF of the parasitic transistor Q2 of the protection element 421 and the reverse voltage (breakdown voltage) of a diode formed by the PMOS transistor Q1 of the two protection elements 422 and 423.

When a negative surge voltage is applied, current flows from the ground terminal P2 via the ground line AGND, the drain terminal D of the protection element 423, the source terminal S of the protection element 423, line L43, the drain terminal D of the protection element 422, the source terminal S of the protection element 422, line L42, the source terminal S of the protection element 421, the drain terminal D of the protection element 421, and the signal line LS5 to the input terminal P5. Further, current flows from the ground terminal P2 across the protection element 421, that is, via the parasitic transistor Q3 to the signal line LS5. The current flowing across the protection element 421 is limited to a subtle current (e.g., several mA) by the resistor component of the N-type epitaxial layer 432 (resistor R41*a* shown in FIG. 47). Thus, the voltage at the ground line AGND is clamped at substantially the same voltage as when a positive surge voltage is applied.

Figure 48:
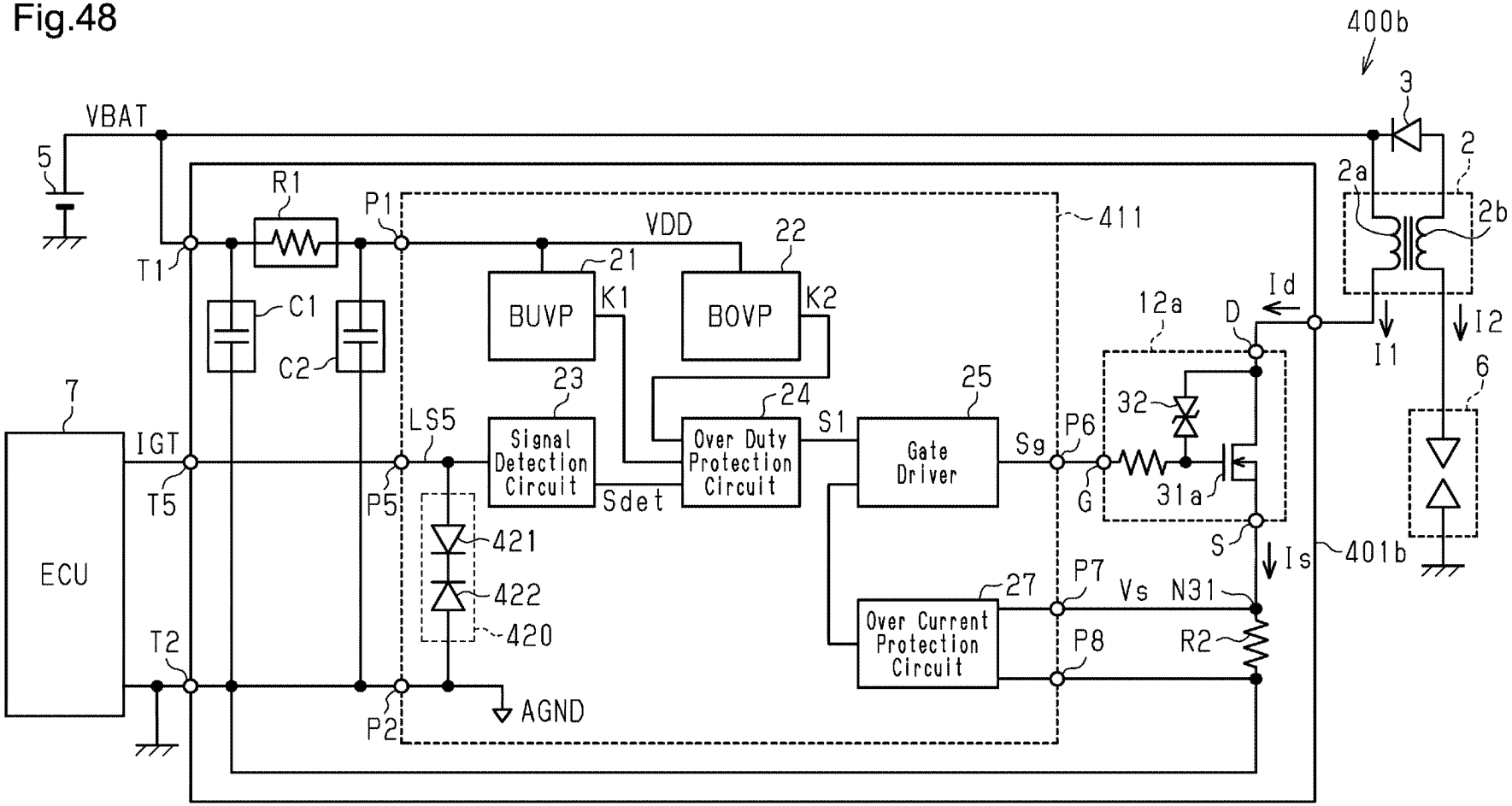
FIG. 48 is a schematic block circuit diagram showing an ignition device of a modified example.

As shown in FIG. 48, an ignition device 400*b* includes the ignition coil 2 and an igniter 401*b*.

The igniter 401*b* includes the switch element 12*a*, the switch control circuit 411, the resistor R1, the capacitors C1 and C2, and the resistor R2 and is modularized and accommodated in a single package. The switch element 12*a* is formed by a single semiconductor chip including the transistor 31*a*, and the transistor 31*a* is, for example, a SiC MOSFET. In this manner, in the igniter 401*b* with the switch element 12*a* including the transistor 31*a*, which is a SiC MOSFET, damage is limited in the protection elements 421 and 422 of the protection circuit 420 and immunity is improved in the same manner as the fourth embodiment. The protection circuit 420 can also use the protection circuit 420*a* of FIG. 45.

Other Modified Examples

In the above embodiments and modified examples, IGBTs and SiC MOSFETs are used as transistors. However, GaN power devices or the like can also be used as transistors.

Each of the above embodiments and modified examples may be combined.

The technical ideas which can be recognized from each of the embodiments described above and each of the modified examples described above will now be described.

Embodiment 1

A switch control circuit that controls a switch element connected to a primary coil of an ignition coil in accordance with an ignition signal, wherein the switch element includes a transistor and a protection element connected between a collector and gate of the transistor, the switch control circuit comprising:

a status detection circuit that uses a voltage at a gate terminal controlling the transistor or a voltage corresponding to a collector current of the transistor as a detection voltage and generates a status detection signal corresponding to a change in the detection voltage.

Embodiment 2

The switch control circuit according to embodiment 1, wherein the status detection circuit includes a first comparator that compares the detection voltage and a first reference voltage and a second comparator that compares the detection voltage and a second reference voltage, and the status detection circuit generates the status detection signal based on output signals of the first comparator and the second comparator.

Embodiment 3

The switch control circuit according to embodiment 1 or 2, wherein the detection voltage corresponding to the collector current is a voltage at a terminal connected between an emitter of the transistor and a resistor connected to the emitter.

Embodiment 4

The switch control circuit according to embodiment 2, wherein the status detection circuit includes a capacitor, charges and discharges the capacitor with the output signals of the first comparator and the second comparator, and generates the status detection signal based on a charge voltage of the capacitor.

Embodiment 5

The switch control circuit according to any one of embodiments 1 to 4, comprising a signal output circuit that outputs the status detection signal to a terminal.

Embodiment 6

The switch control circuit according to any one of embodiments 1 to 4, comprising a signal output circuit that outputs an ignition confirmation signal based on the status detection signal.

Embodiment 7

The switch control circuit according to embodiment 5 or 6, comprising:

a current detection circuit that detects the collector current of the transistor, wherein the signal output circuit combines a detection signal of the current detection circuit and a detection signal of the status detection circuit to generate an ignition confirmation signal.

Embodiment 8

The switch control circuit according to any one of embodiments 5 to 7, wherein the signal output circuit outputs the status detection signal at a time corresponding to the ignition signal.

Embodiment 9

The switch control circuit according to any one of embodiments 1 to 8, wherein the switch element includes a protection element connected between an emitter and gate of the transistor.

Embodiment 10

An ignitor, comprising:

a switch element connected to a primary coil of an ignition coil; and a switch control circuit that controls the switch element in accordance with an ignition signal, wherein the switch element includes a transistor and a protection element connected between a collector and gate of the transistor, and the switch control circuit includes a status detection circuit that uses a voltage at a gate terminal controlling the transistor or a voltage corresponding to a collector current of the transistor as a detection voltage and generates a status detection signal corresponding to a change in the detection voltage.

Embodiment 11

A switch control circuit that controls a switch element connected to a primary coil of an ignition coil in accordance with an ignition signal, wherein the switch element includes a transistor and a protection element connected between a collector and gate of the transistor, the switch control circuit comprising:

a status detection circuit that uses a collector voltage of the transistor as a detection voltage and generates a status detection signal corresponding to a change in the detection voltage.

Embodiment 12

The switch control circuit according to embodiment 11, wherein the status detection circuit includes a second resistor that generates the detection voltage by voltage-dividing the collector voltage of the transistor with a first resistor connected to a collector terminal of the switch element.

Embodiment 13

The switch control circuit according to embodiment 11 or 12, wherein the status detection circuit includes a first comparator, which compares the detection voltage and a first reference voltage, and generates the status detection signal based on output signals of the first comparator.

Embodiment 14

The switch control circuit according to embodiment 13, wherein the status detection circuit includes a capacitor, a first current source that charges the capacitor based on the output signal of the first comparator, a second current source that discharges the capacitor, and a second comparator that compares a charge voltage of the capacitor and a second reference voltage to output the status detection signal.

Embodiment 15

The switch control circuit according to any one of embodiments 11 to 14, comprising a signal output circuit that outputs the status detection signal to a terminal.

Embodiment 16

The switch control circuit according to any one of embodiments 11 to 14, comprising a signal output circuit that outputs an ignition confirmation signal based on the status detection signal.

Embodiment 17

The switch control circuit according to embodiment 15 or 16, comprising:

a current detection circuit that detects a collector current of the transistor, wherein the signal output circuit combines a detection signal of the current detection circuit and a detection signal of the status detection circuit to generate an ignition confirmation signal.

Embodiment 18

The switch control circuit according to any one of embodiments 15 to 17, wherein the signal output circuit outputs the status detection signal at a time corresponding to the ignition signal.

Embodiment 19

The switch control circuit according to any one of embodiments 11 to 18, wherein the switch element includes a protection element connected between an emitter and gate of the transistor.

Embodiment 20

An ignitor, comprising:

a switch element connected to a primary coil of an ignition coil; and a switch control circuit that controls the switch element in accordance with an ignition signal, wherein the switch element includes a transistor and a protection element connected between a terminal, which is connected to the primary coil, and a control terminal of the transistor, and the switch control circuit includes a status detection circuit that uses a voltage corresponding to a collector voltage of the transistor as a detection voltage and generates a status detection signal corresponding to a change in the detection voltage.

Embodiment 21

A switch control circuit that controls a switch element connected to a primary coil of an ignition coil in accordance with an ignition signal, the switch control circuit comprising:

a protection circuit connected between an input terminal, which is provided with the ignition signal, and a ground terminal, which is connected to ground, wherein the protection circuit includes one first diode element connected to the input terminal and arranged toward the ground terminal from the input terminal in a forward direction, and at least one second diode element connected between the first diode element and the ground terminal and arranged toward the ground terminal from the input terminal in a reverse direction, wherein the first diode element and the second diode element are each formed by a PMOSFET.

Embodiment 22

The switch control circuit according to embodiment 21, wherein the protection circuit includes two series-connected second diode elements.

Embodiment 23

The switch control circuit according to embodiment 21 or 22, wherein the protection circuit is formed on a semiconductor substrate on which the switch control circuit is integrated in a region between a first pad, to which the input terminal is connected, and a second pad, to which the ground terminal is connected.

Embodiment 24

The switch control circuit according to any one of embodiments 1 to 9 and 11 to 19, comprising:

a protection circuit connected between an input terminal, which is provided with the ignition signal, and a ground terminal, which is connected to ground, wherein the protection circuit includes one first diode element connected to the input terminal and arranged toward the ground terminal from the input terminal in a forward direction, and at least one second diode element connected between the first diode element and the ground terminal and arranged toward the ground terminal from the input terminal in a reverse direction, wherein the first diode element and the second diode element are each formed by a PMOSFET.

Embodiment 25

The igniter according to embodiment 10 or 20, comprising:

a protection circuit connected between an input terminal, which is provided with the ignition signal, and a ground terminal, which is connected to ground, wherein the protection circuit includes one first diode element connected to the input terminal and arranged toward the ground terminal from the input terminal in a forward direction, and at least one second diode element connected between the first diode element and the ground terminal and arranged toward the ground terminal from the input terminal in a reverse direction, wherein the first diode element and the second diode element are each formed by a PMOSFET.

DESCRIPTION OF REFERENCE CHARACTERS

4, 4*a*, 201, 201*a*, 301, 301*a*, 401, 401*a*, 401*b*) ignitor; 11, 11*a* to 11*c*, 211, 211*a*, 211*b*) switch control circuit; 26, 26*c*, 226, 326) status detection circuit; 12, 12*a*) switch element

The invention claimed is:

1. A switch control circuit that controls a switch element connected to a primary coil of an ignition coil in accordance with an ignition signal, wherein the switch element includes a transistor and a protection element connected between a collector and gate of the transistor, the switch control circuit comprising:

a status detection circuit that uses a voltage at a gate terminal controlling the transistor or a voltage corresponding to a collector current of the transistor as a detection voltage and generates a status detection signal corresponding to a change in the detection voltage;

a signal output circuit that outputs the status detection signal to a terminal; and a current detection circuit that detects the collector current of the transistor, wherein the signal output circuit combines a detection signal of the current detection circuit and a detection signal of the status detection circuit to generate an ignition confirmation signal.

2. The switch control circuit according to claim 1, wherein the status detection circuit includes a first comparator that compares the detection voltage and a first reference voltage and a second comparator that compares the detection voltage and a second reference voltage, and the status detection circuit generates the status detection signal based on output signals of the first comparator and the second comparator.

3. The switch control circuit according to claim 1, wherein the detection voltage corresponding to the collector current is a voltage at a terminal connected between an emitter of the transistor and a resistor connected to the emitter.

4. The switch control circuit according to claim 2, wherein the status detection circuit includes a capacitor, charges and discharges the capacitor with the output signals of the first comparator and the second comparator, and generates the status detection signal based on a charge voltage of the capacitor.

5. The switch control circuit according to claim 1, comprising a signal output circuit that outputs an ignition confirmation signal based on the status detection signal.

6. The switch control circuit according to claim 1, wherein the signal output circuit outputs the status detection signal at a time corresponding to the ignition signal.

7. The switch control circuit according to claim 5, wherein the signal output circuit outputs the status detection signal at a time corresponding to the ignition signal.

8. An ignitor, comprising:

a switch element connected to a primary coil of an ignition coil; and a switch control circuit that controls the switch element in accordance with an ignition signal, wherein the switch element includes a transistor and a protection element connected between a collector and gate of the transistor, and the switch control circuit includes:

a status detection circuit that uses a voltage at a gate terminal controlling the transistor or a voltage corresponding to a collector current of the transistor as a detection voltage and generates a status detection signal corresponding to a change in the detection voltage;

a signal output circuit that outputs the status detection signal to a terminal; and a current detection circuit that detects a collector current of the transistor, wherein the signal output circuit combines a detection signal of the current detection circuit and a detection signal of the status detection circuit to generate an ignition confirmation signal.

9. A switch control circuit that controls a switch element connected to a primary coil of an ignition coil in accordance with an ignition signal, wherein the switch element includes a transistor and a protection element connected between a collector and gate of the transistor, the switch control circuit comprising:

a status detection circuit that uses a collector voltage of the transistor as a detection voltage and generates a status detection signal corresponding to a change in the detection voltage;

a signal output circuit that outputs the status detection signal to a terminal; and a current detection circuit that detects a collector current of the transistor, wherein the signal output circuit combines a detection signal of the current detection circuit and a detection signal of the status detection circuit to generate an ignition confirmation signal.

10. The switch control circuit according to claim 9, wherein the status detection circuit includes a second resistor that generates the detection voltage by voltage-dividing the collector voltage of the transistor with a first resistor connected to a collector terminal of the switch element.

11. The switch control circuit according to claim 9, wherein the status detection circuit includes a first comparator, which compares the detection voltage and a first reference voltage, and generates the status detection signal based on output signals of the first comparator.

12. The switch control circuit according to claim 11, wherein the status detection circuit includes a capacitor, a first current source that charges the capacitor based on the output signal of the first comparator, a second current source that discharges the capacitor, and a second comparator that compares a charge voltage of the capacitor and a second reference voltage to output the status detection signal.

13. The switch control circuit according to claim 9, comprising a signal output circuit that outputs an ignition confirmation signal based on the status detection signal.

* * * * *